US008104927B2

(12) United States Patent
Gordin et al.

(10) Patent No.: US 8,104,927 B2
(45) Date of Patent: Jan. 31, 2012

(54) GEARED TILT MECHANISM FOR ENSURING HORIZONTAL OPERATION OF ARC LAMP

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 227 days.

(21) Appl. No.: 12/258,001

(22) Filed: Oct. 24, 2008

(65) Prior Publication Data

US 2009/0122550 A1 May 14, 2009

Related U.S. Application Data

(63) Continuation-in-part of application No. 11/332,938, filed on Jan. 17, 2006, now Pat. No. 7,452,108, which is a continuation-in-part of application No. 12/165,212, filed on Jun. 30, 2008, now Pat. No. 7,736,024.

(60) Provisional application No. 60/644,536, filed on Jan. 18, 2005, provisional application No. 60/644,639, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005, provisional application No. 60/644,687, filed on Jan. 18, 2005.

(51) Int. Cl.
*F21V 19/02* (2006.01)

(52) U.S. Cl. ..... 362/285; 362/418; 362/263

(58) Field of Classification Search ..... 362/285, 362/287, 289, 288, 418, 263, 286, 419, 422–425
See application file for complete search history.

(56) References Cited

U.S. PATENT DOCUMENTS 2,190,439 A 2/1940 Wohl
2,447,923 A 8/1948 Tuck
(Continued)

FOREIGN PATENT DOCUMENTS

CN 200680008830.2 2/2010
(Continued)

*Primary Examiner* — Bao Q Truong
(74) *Attorney, Agent, or Firm* — McKee, Voorhees & Sease, P.L.C.

(57) ABSTRACT

An apparatus and method for adjusting a high intensity discharge arc tube to a predetermined (e.g., relatively horizontal) operating position in a light fixture regardless of aiming orientation of the light fixture towards a target. In one aspect, the light source is mounted in an independently pivotal yoke in the light fixture. A mechanical linkage proportionally pivots the light source relative to any pivoting motion of the fixture over a range of positions such that a selected light source orientation can be approximately maintained regardless of aiming orientation of the fixture.

23 Claims, 64 Drawing Sheets

U.S. PATENT DOCUMENTS

| | | | | | |
|---|---|---|---|---|---|
| 4,173,037 | A | | 10/1979 | Henderson, Jr. et al. | |
| 4,395,750 | A | * | 7/1983 | Scheidemann et al. | 362/239 |
| 4,450,507 | A | * | 5/1984 | Gordin | 362/463 |
| 4,716,505 | A | | 12/1987 | Chan | |
| 4,729,077 | A | | 3/1988 | Gordin et al. | |
| 4,816,974 | A | | 3/1989 | Gordin | |
| 4,864,476 | A | | 9/1989 | Lemons et al. | |
| 4,947,303 | A | | 8/1990 | Gordin et al. | |
| 5,161,883 | A | | 11/1992 | Gordin et al. | |
| 5,600,537 | A | | 2/1997 | Gordin et al. | |
| 5,816,691 | A | | 10/1998 | Gordin et al. | |
| 5,856,721 | A | | 1/1999 | Gordin et al. | |
| 6,036,338 | A | | 3/2000 | Gordin | |
| 6,203,176 | B1 | | 3/2001 | Gordin | |
| 6,733,159 | B1 | | 5/2004 | Wu | |
| 7,212,706 | B2 | | 5/2007 | White et al. | |
| 7,452,108 | B2 | * | 11/2008 | Gordin et al. | 362/285 |
| 7,736,024 | B2 | | 6/2010 | Gordin et al. | |
| 2003/0117805 | A1 | | 6/2003 | Pasternak et al. | |
| 2009/0002993 | A1 | | 1/2009 | Gordin et al. | |

FOREIGN PATENT DOCUMENTS

| | | | |
|---|---|---|---|
| EP | 1172839 | A2 | 1/2002 |
| WO | 2006091298 | A1 | 8/2006 |

* cited by examiner

FRONT VIEW

TOP VIEW

SECTION A-A

SIDE VIEW

VIEW C-C

VIEW E-E

SECTION F-F

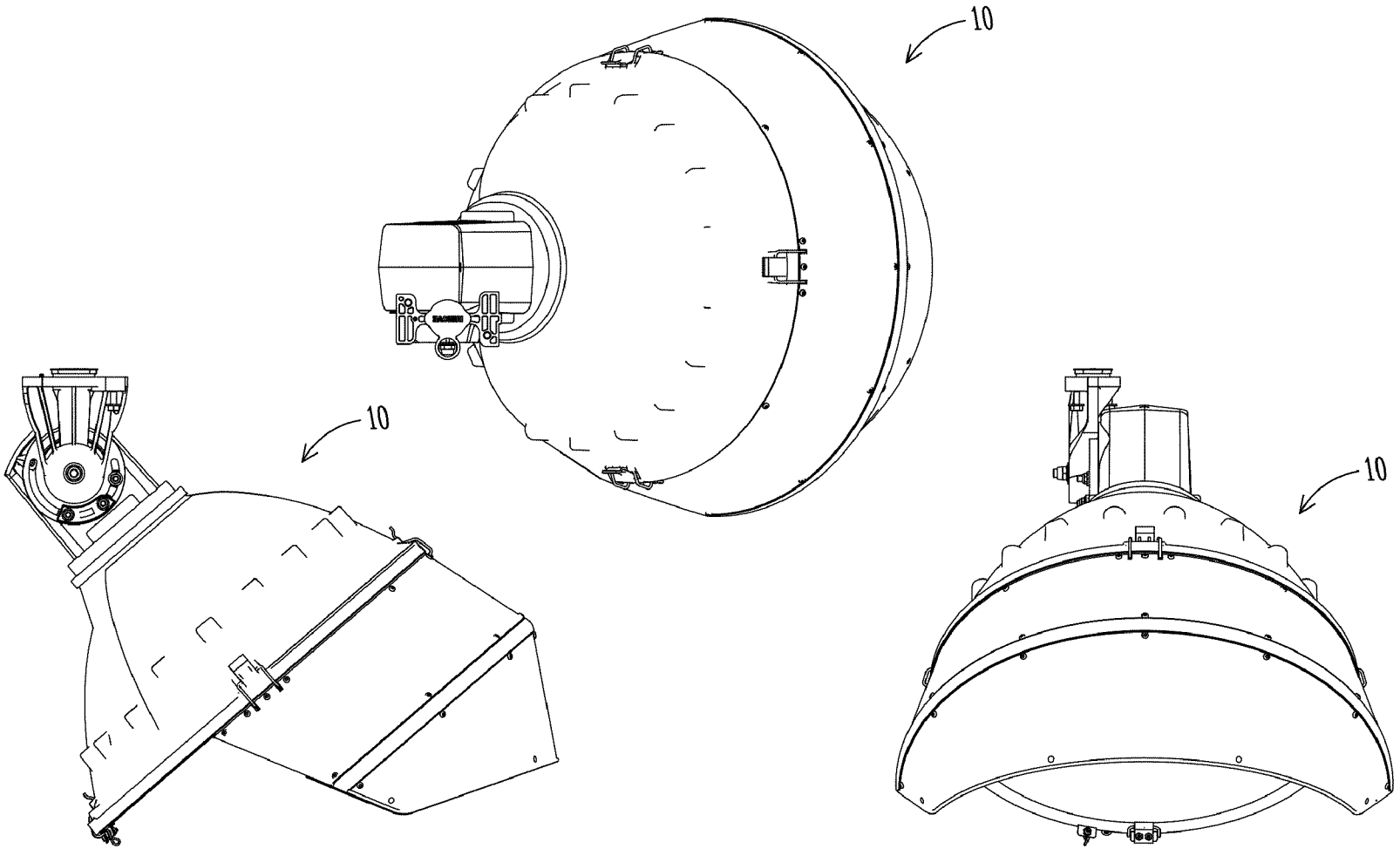
Fig. 5G1

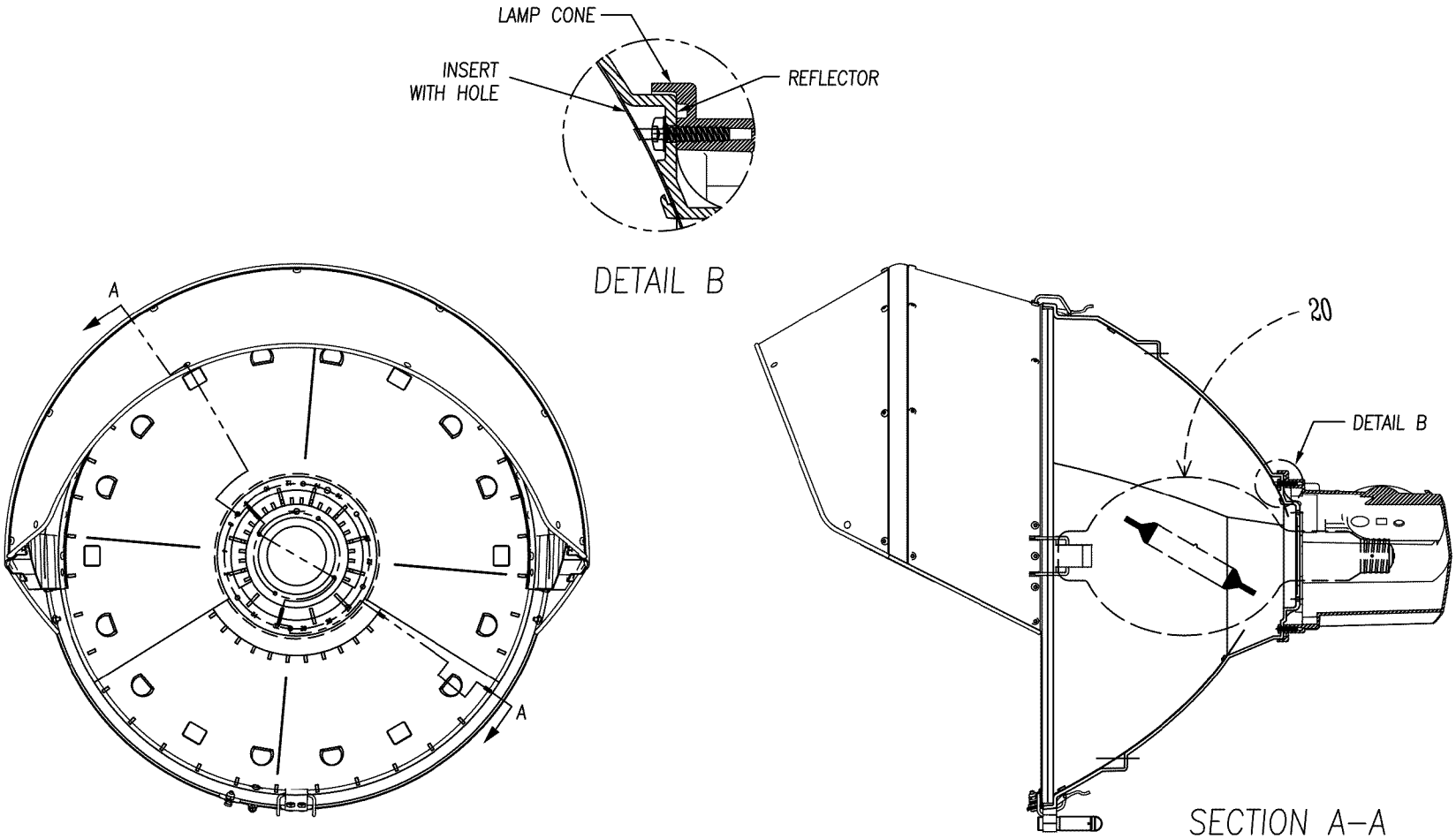
Fig. 5G2

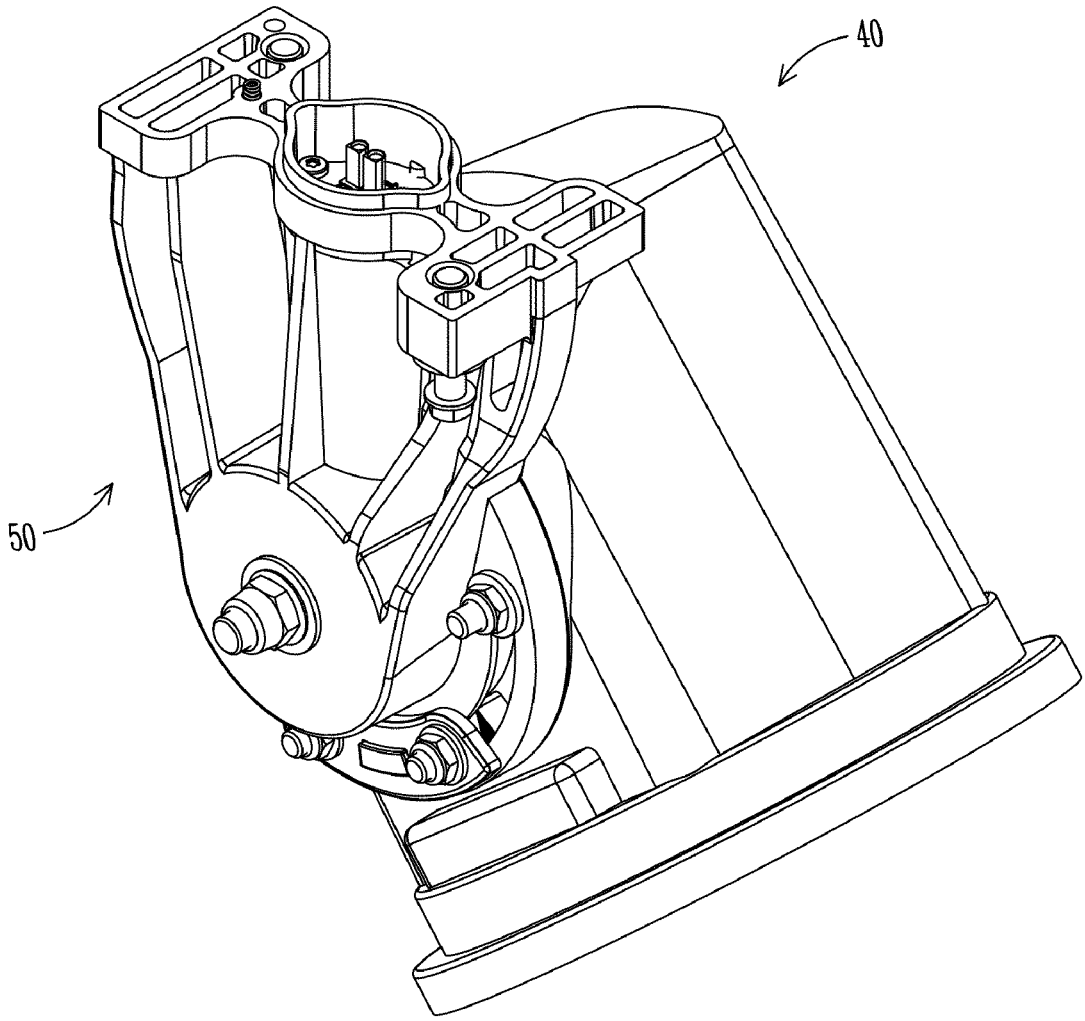
Fig. 5J1

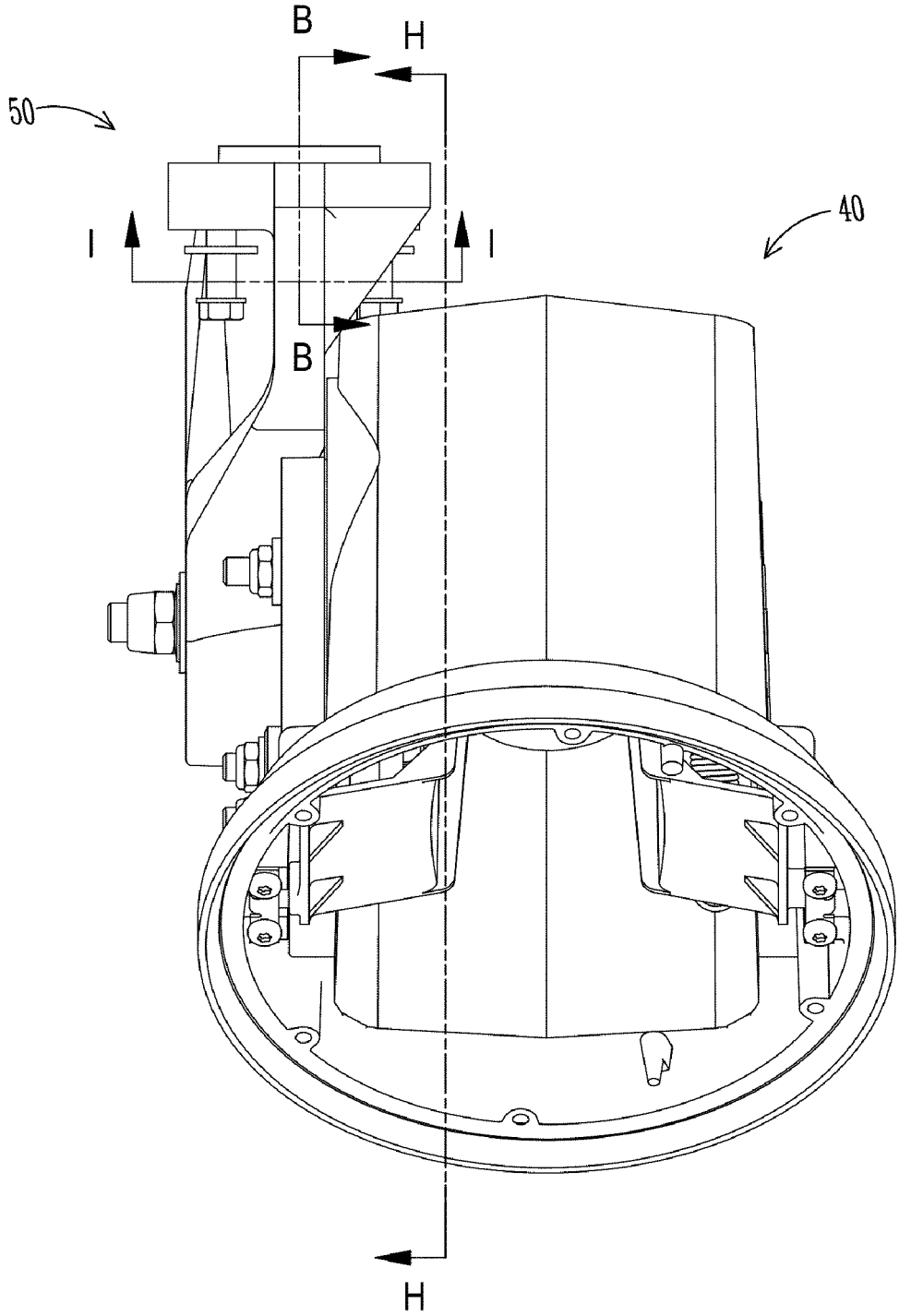
FRONT VIEW
Fig. 5J2

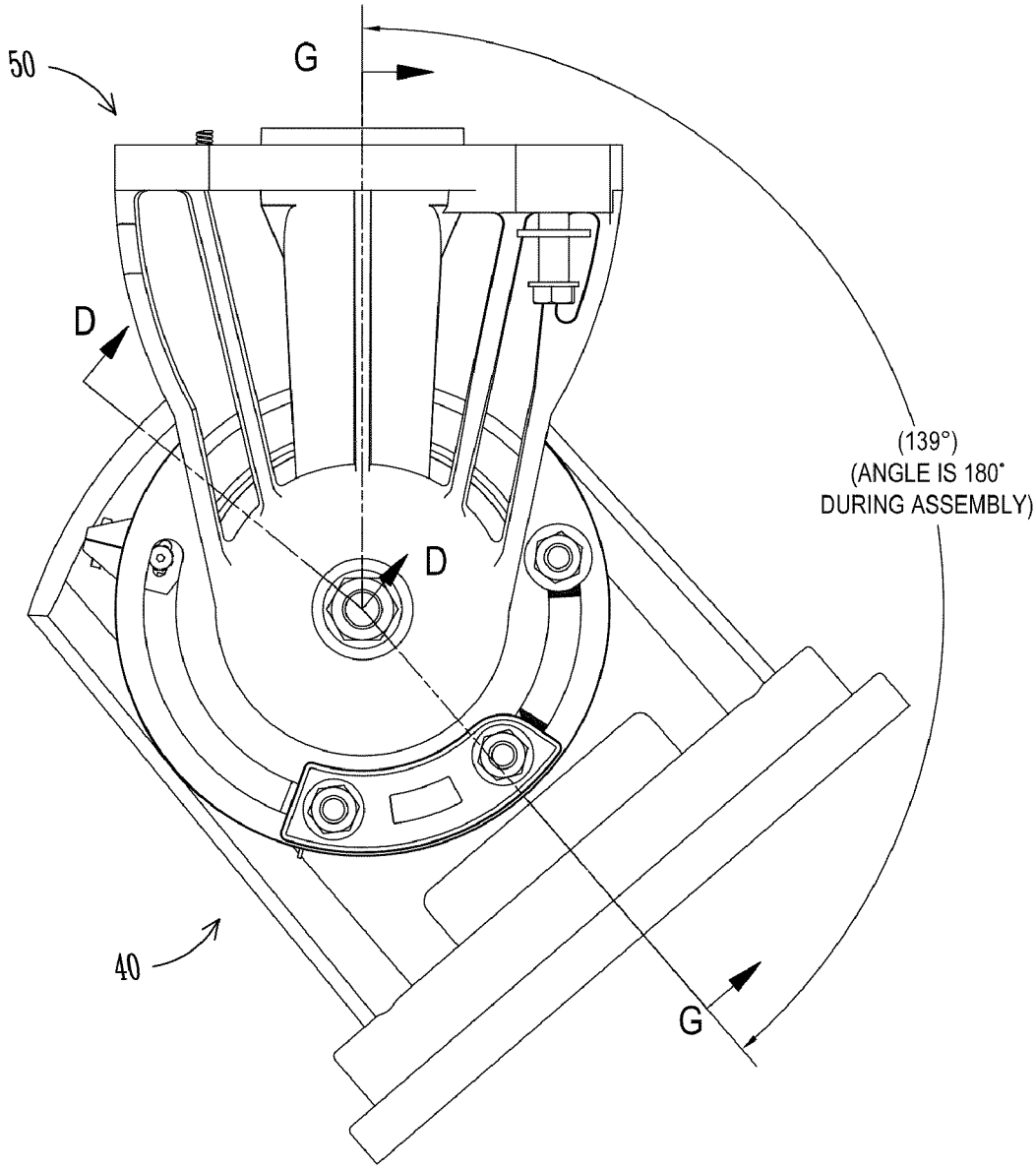
SIDE VIEW
Fig. 5J3

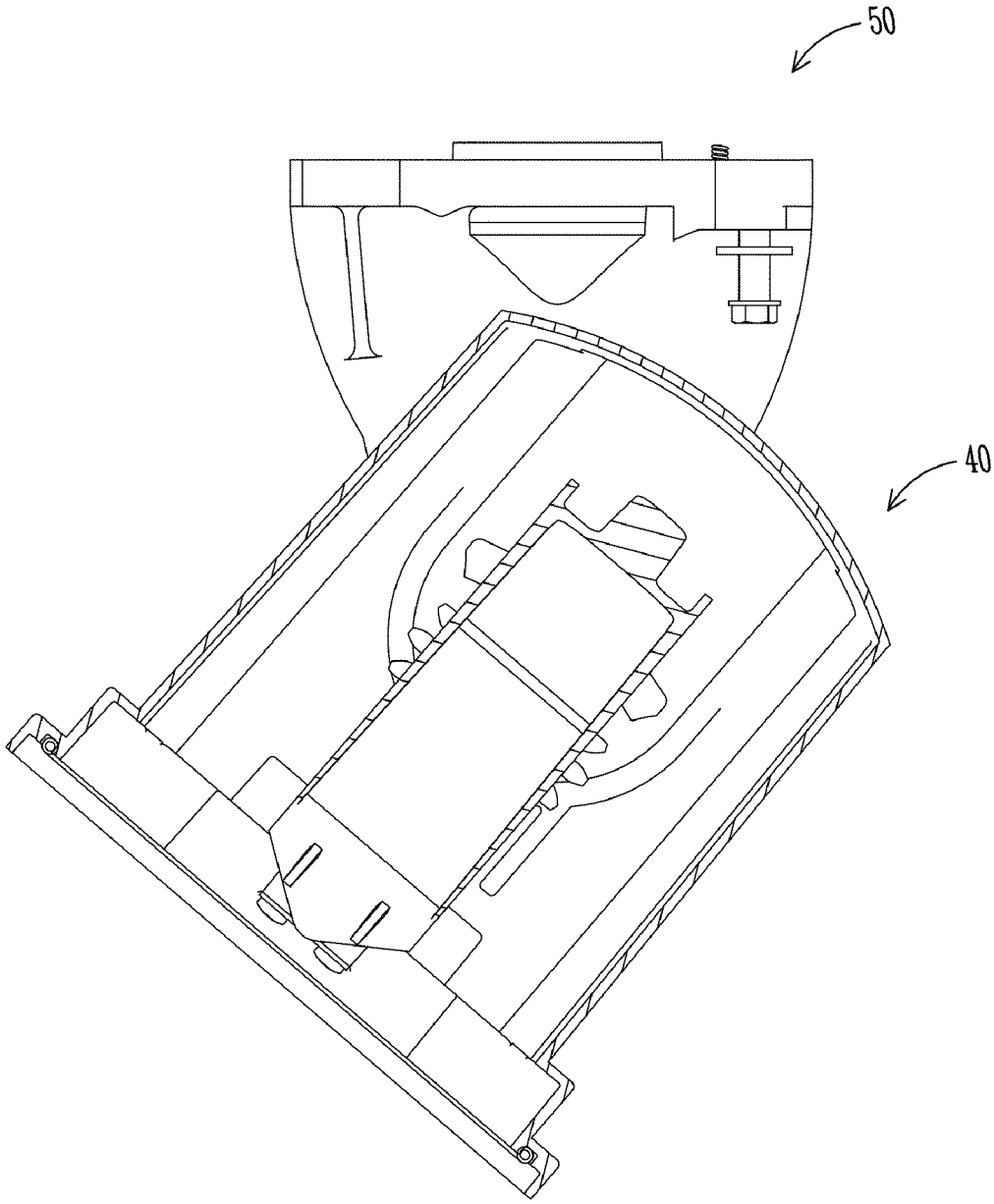
SECTION H-H
SHOWN AIMED AT 47° VERTICAL
Fig. 5J4

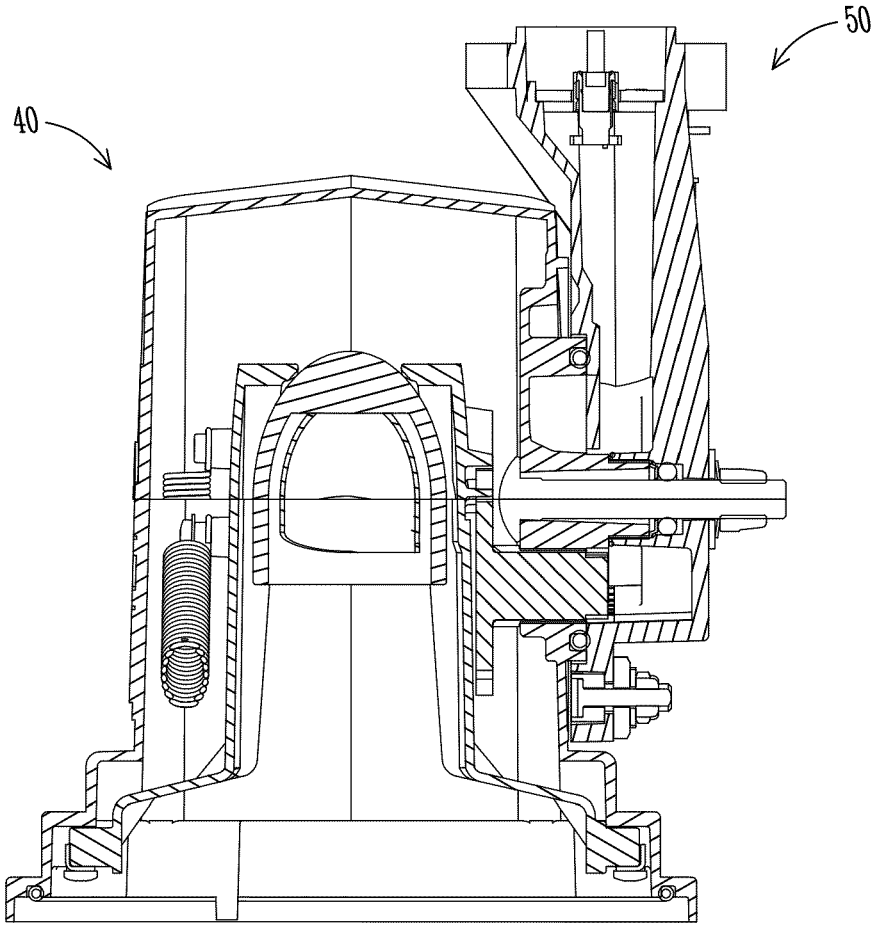
SECTION G-G
*Fig. 5J5*
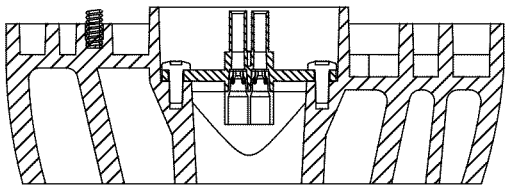
SECTION B-B
*Fig. 5J6*

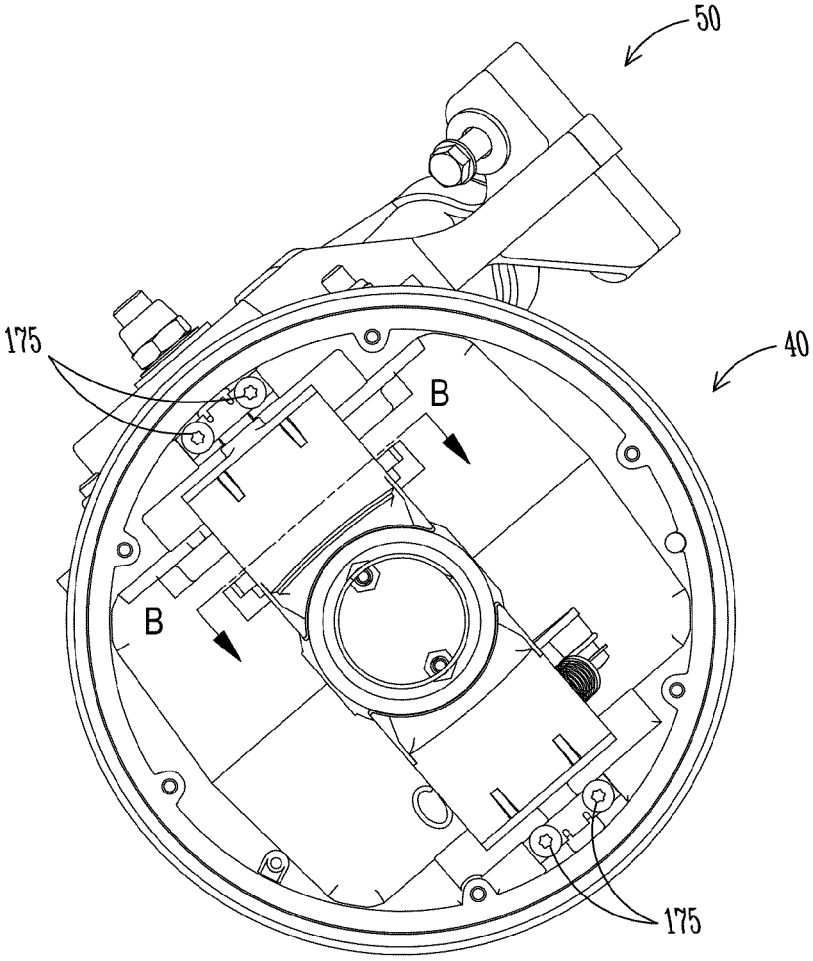
BOTTOM VIEW
*Fig. 5J7*
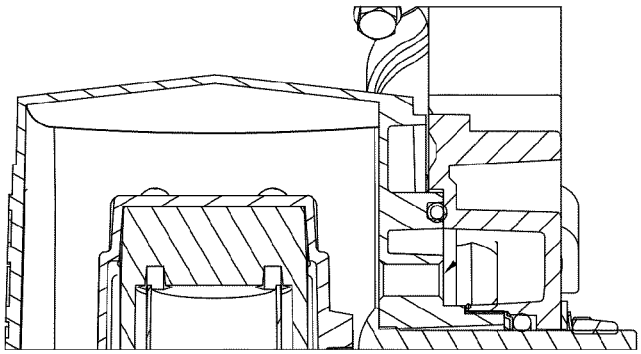
SECTION D-D
*Fig. 5J8*

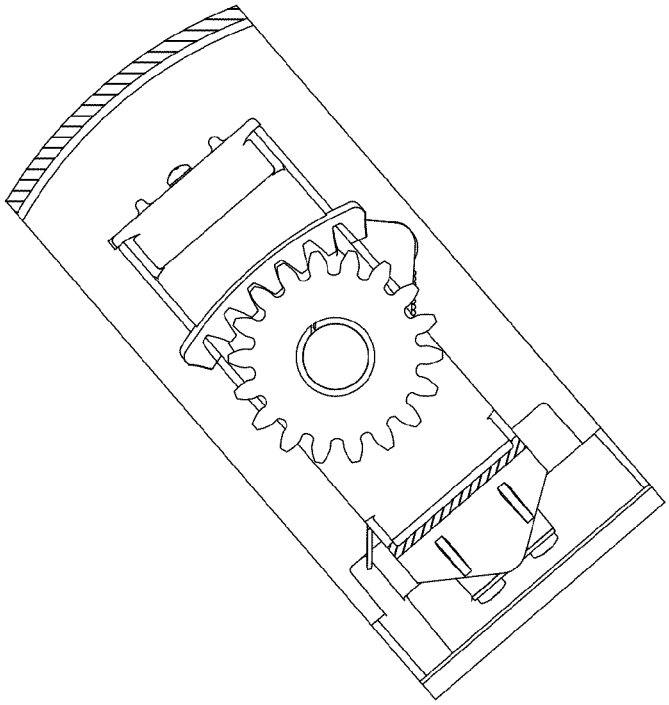
SECTION B-B
*Fig. 5J9*
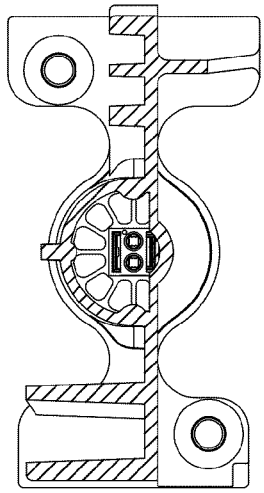
SECTION I-I
*Fig. 5J10*

TOP VIEW

SIDE VIEW

BOTTOM VIEW

SECITON A-A

VIEW D-D

VIEW E-E

SECITON C-C

SECTION B-B

FRONT VIEW

SIDE VIEW

BACK VIEW

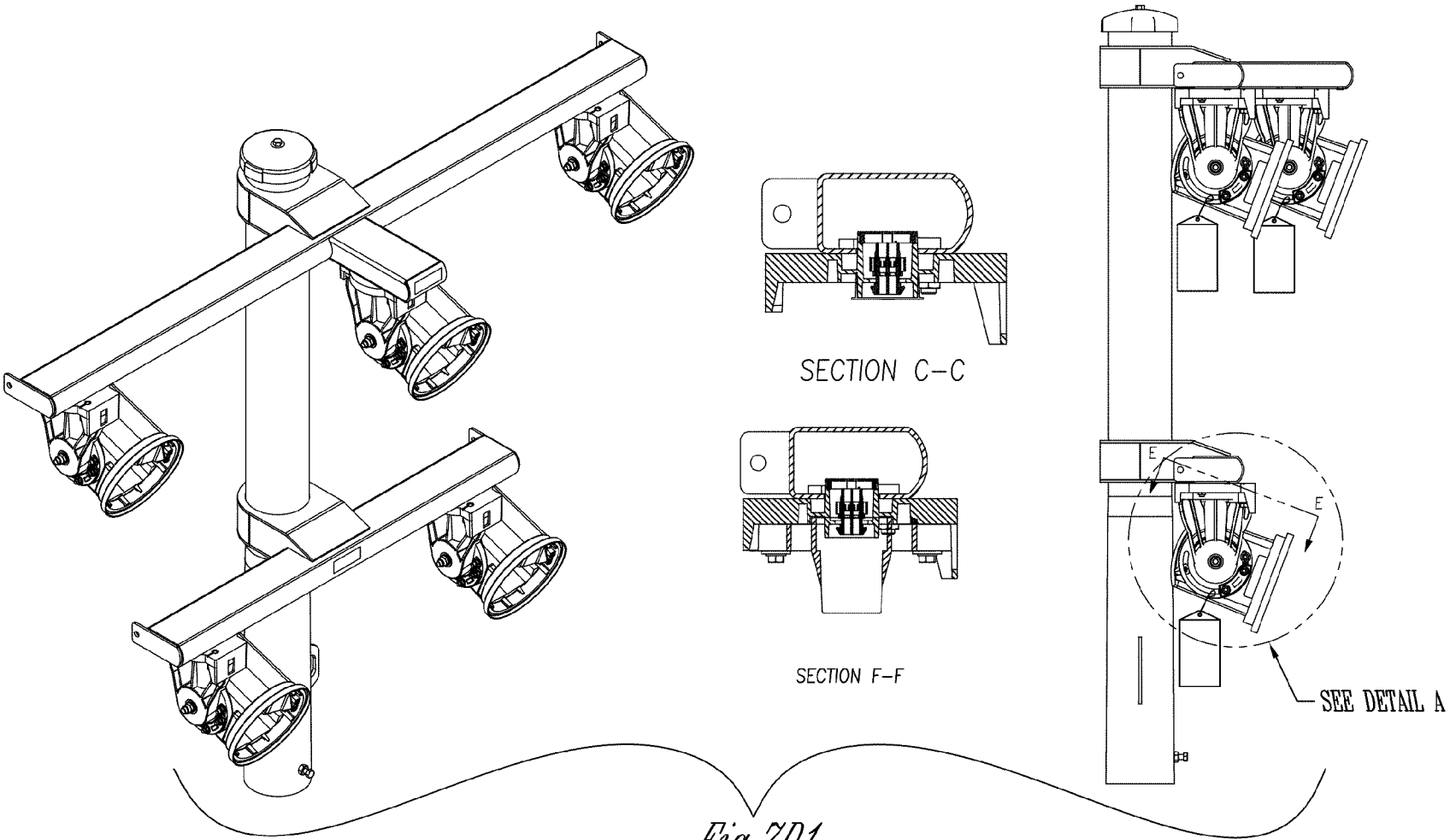
Fig. 7D1

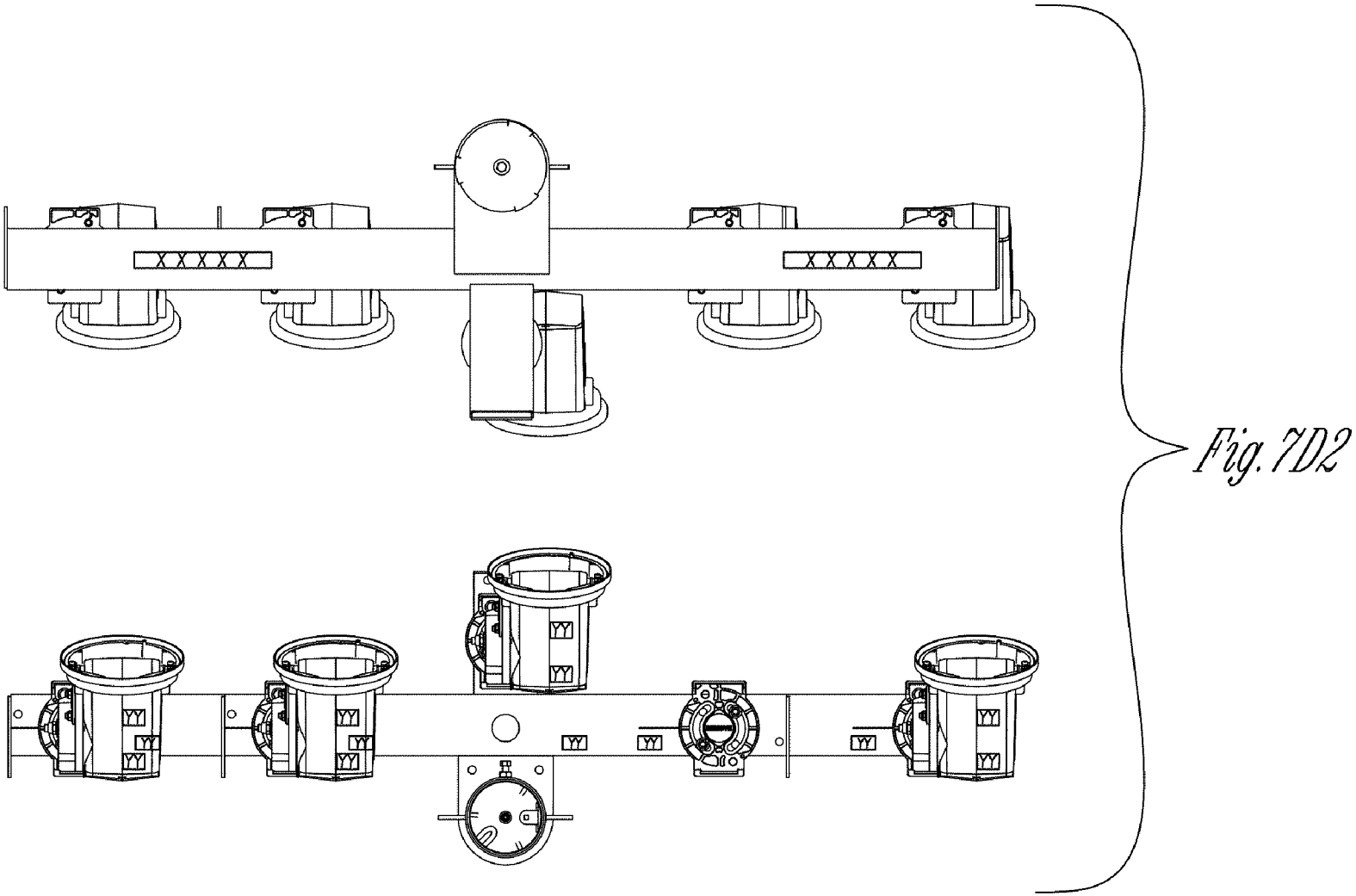
Fig. 7D2

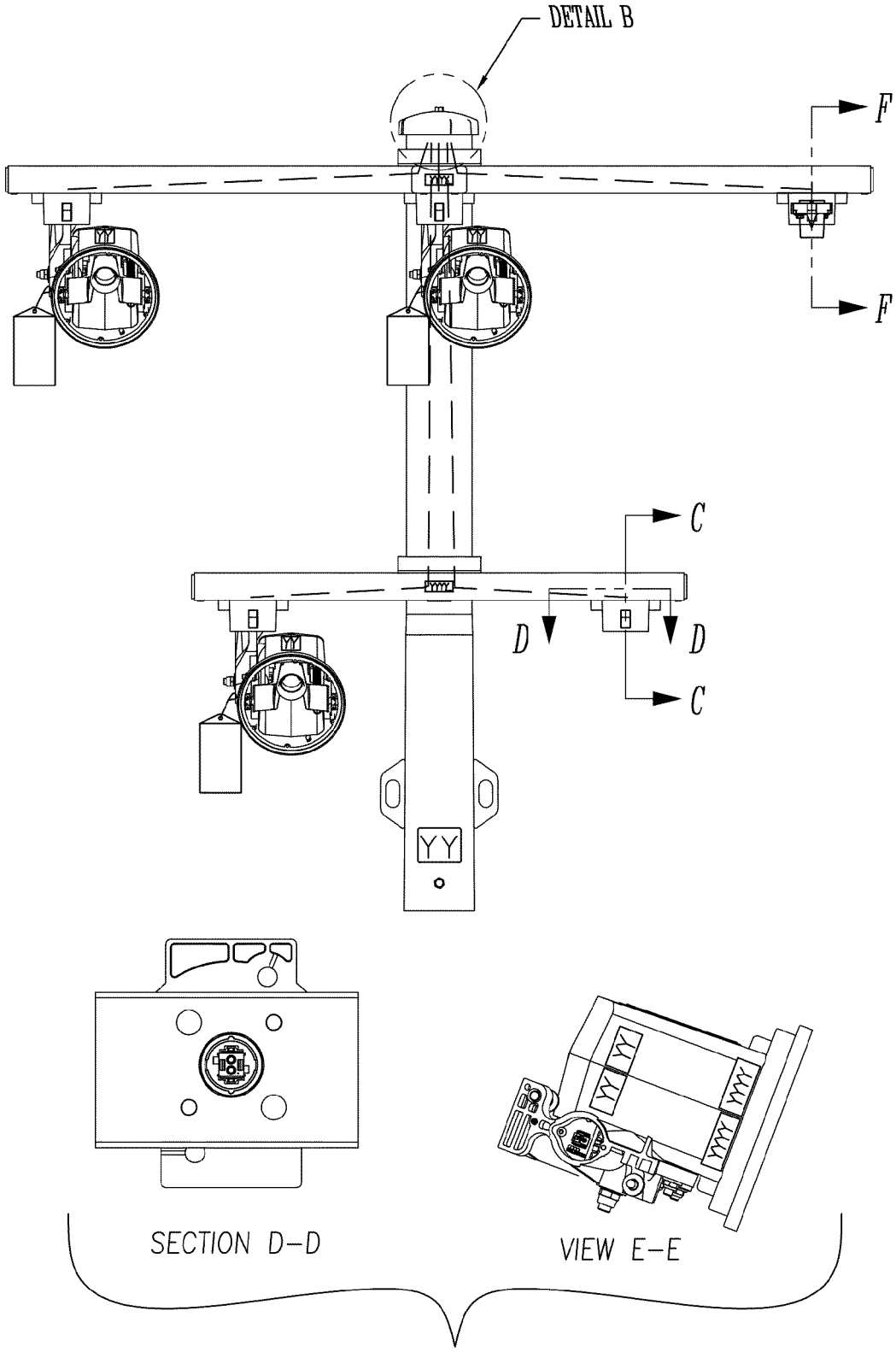
Fig. 7D3

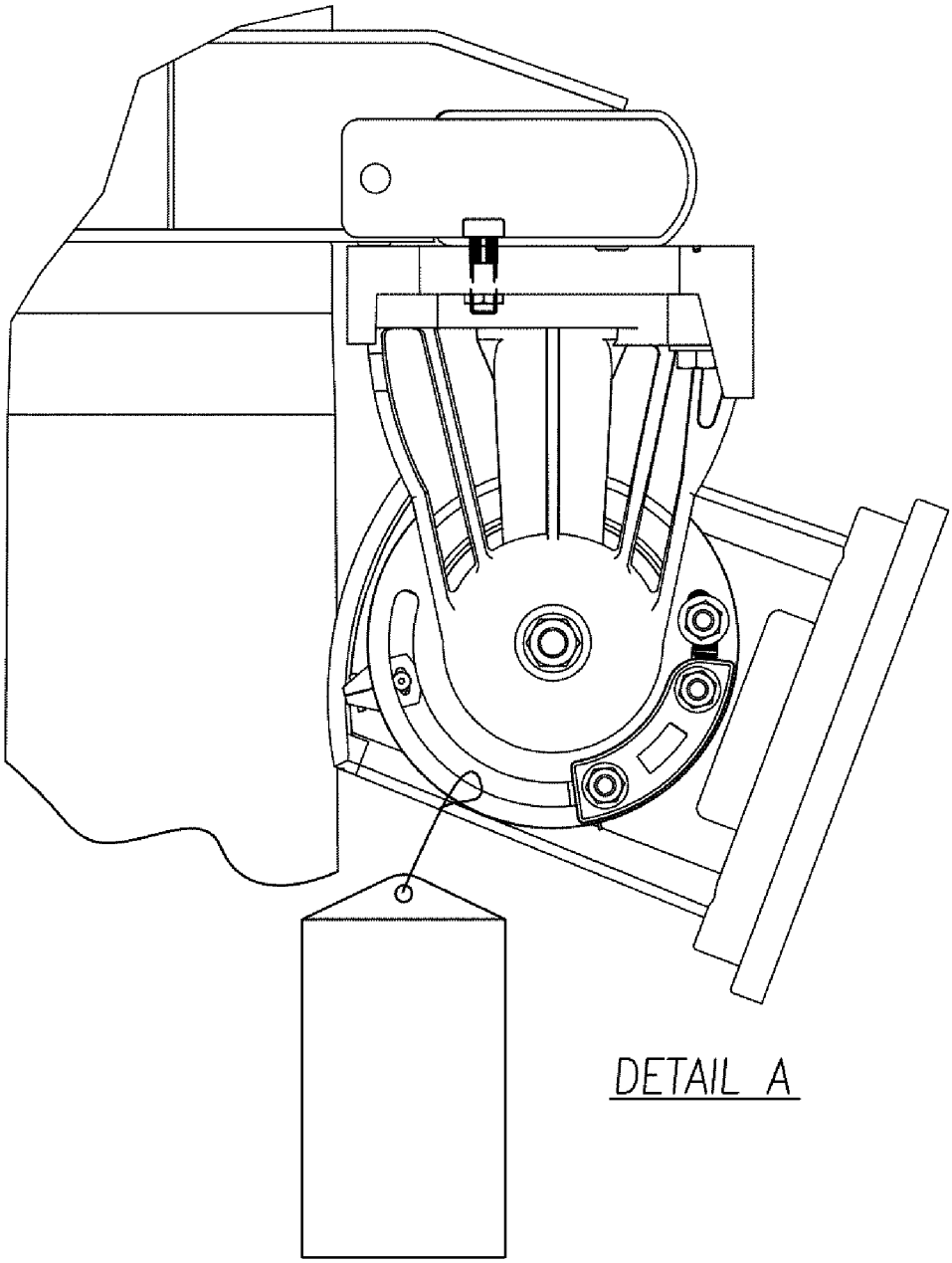
Fig. 7D4

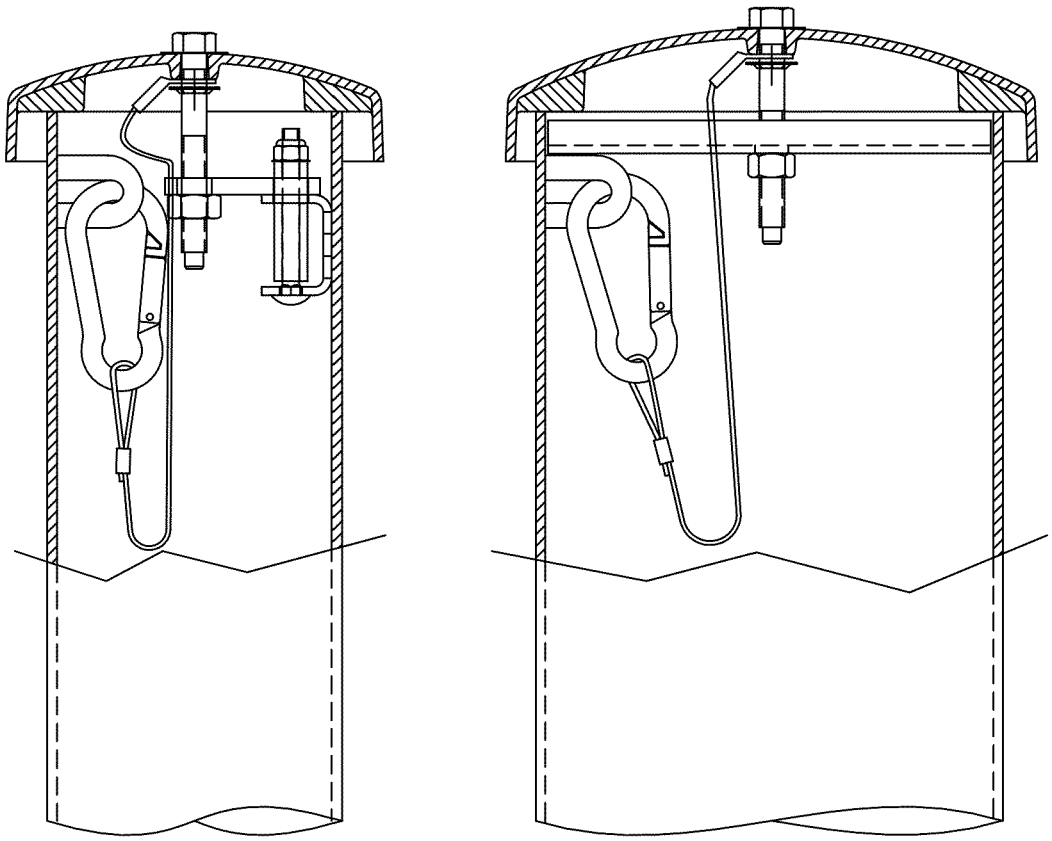
DETAIL B
Fig. 7D5

VIEW G-G

SECTION A-A

SECTION B-B

SECION H-H

SECTION I–I

SECTION J–J

DETAIL C

SIDE VIEW

FRONT VIEW

DETAIL A

FRONT VIEW

SIDE VIEW

SECTION A-A

DETAIL A

DETAIL A

FRONT VIEW

TOP VIEW

SECTION A-A

DETAIL A

DETAIL B

FRONT VIEW

SIDE VIEW

BACK VIEW

SECITON A-A

DETAIL A

FRONT VIEW

SECTION A-A

SIDE VIEW

FRONT VIEW

LEFT SIDE VIEW

RIGHT SIDE VIEW

DETIAL A

BOTTOM VIEW

FRONT VIEW

SIDE VIEW

BOTTOM VIEW

GEARED TILT MECHANISM FOR ENSURING HORIZONTAL OPERATION OF ARC LAMP

CROSS REFERENCE TO RELATED APPLICATIONS

This application is a continuation-in-part of and claims priority under 35 U.S.C. §120 of U.S. Ser. No. 11/332,938 filed Jan. 17, 2006, which issued as U.S. Pat. No. 7,452,108, which claims priority under 35 U.S.C. §119 to provisional application U.S. Ser. No. 60/644,536 filed Jan. 18, 2005, both incorporated herein by reference in their entirety, and to provisional U.S. applications, all filed Jan. 18, 2005: U.S. Ser. No. 60/644,639; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

This application is a continuation-in-part of and claims priority under 35 U.S.C. §120 of co-pending U.S. Ser. No. 12/165,212 filed Jun. 30, 2008, which is a continuation of Ser. No. 11/332,938 filed Jan. 17, 2006, which issued as U.S. Pat. No. 7,452,108, which claims priority under 35 U.S.C. §119 to provisional application U.S. Ser. No. 60/644,536 filed Jan. 18, 2005, which applications are incorporated herein by reference in their entirety, and to provisional U.S. applications, all filed Jan. 18, 2005: U.S. Ser. No. 60/644,639; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. patents are incorporated by reference in their entirety: U.S. Pat. Nos. 4,816,974; 4,947,303; 5,161,883; 5,600,537; 5,816,691; 5,856,721; 6,036,338.

The contents of published U.S. Application No. 2006/0181880-A1 is incorporated by reference in its entirety.

I. BACKGROUND OF THE INVENTION

A. Field of the Invention

FIGS. 1A-G generally illustrate a sports field lighting system (see also the patents incorporated by reference). There is room for improvement with such fixtures and how they are operated.

B. Problems in the Art

The problem of light loss from tilt factor in certain HID lamps is well known. The present applicant has created and patented several ways to operate an arc tube in a glass envelope in a generally horizontal position. See certain of the above-cited patents which are incorporated by reference herein.

There is still room for improvement in this area. Some solutions require structure that must be manually adjusted after the fixture is elevated. This is subject to error and is labor intensive. Some solutions fix the relationship of the arc tube relative the fixture. However, in most sports lighting systems the fixtures vary in angular orientation to the ground. In these cases, it is not possible to insure that all arc tubes for the system end up installed in a horizontal position.

Published Application US 2006/0181880-A1 discloses a method and apparatus for automatic adjustment. However, there remains room for improvement in the art.

II. SUMMARY OF THE INVENTION

The present invention relates to an apparatus and method for keeping the arc tube of an HID lamp in a pre-determined orientation relative the fixture. It comprises a mechanism or method that maintains the arc tube in the same general orientation to the reflector of a light fixture regardless if the orientation of the reflector relative to the fixture is changed or is not consistent.

In one aspect a gearing arrangement between a yoke holding the lamp, a mounting elbow for the fixture, and the reflector presents a new way of lighting a target space. The invention pertains to apparatus, methods, and systems to effectively and more energy-efficiently deliver light to the target space, and reduce glare and spill light outside the target space.

It is therefore a principal object, feature, or advantage of the present invention to present a high intensity lighting fixture, its method of use, and its incorporation into a lighting system, which improves over or solves certain problems and deficiencies in the art.

An apparatus according to one aspect of the invention comprises a high intensity lighting fixture apparatus with a yoke adapted to hold the arc lamp so that its arc tube operates in a horizontal position, or as close as possible thereto, over most conventional operating positions for the fixture.

In another aspect of the invention, an arc lamp with an arc tube offset from the longitudinal axis of the lamp envelope is used in combination with the yoke. The arc tube offset can be at an aiming angle within the typical range of aiming angles for sports lighting. The yoke and associated structure would keep the arc tube at or about horizontal automatically even though the reflector is moved anywhere in that typical range.

In another aspect of the invention, instead of automatic alignment, a manually activated or controlled method of adjustment is used to change or maintain the orientation of the arc tube. An arc lamp (in one embodiment with an arc tube offset from the longitudinal axis of the lamp envelope) is used in combination with a yoke. The arc tube offset can be at an aiming angle within the typical range of aiming angles for sports lighting. Through manual adjustment of the yoke, the arc tube could be positioned at or about horizontal even though the reflector is moved anywhere in that typical range.

These and other objects, features, advantages and aspects of the present invention will become more apparent with reference to the accompanying specification and claims.

III. BRIEF DESCRIPTION OF THE DRAWINGS

FIGS. 1A-G illustrate general components of a sports lighting system.

FIGS. 2A-C illustrate a high intensity discharge arc lamp that is used with an exemplary embodiment of the present invention.

FIG. 3 is a diagrammatic, partial exploded view of a light fixture 10 according to an exemplary embodiment of the present invention.

FIGS. 4A-D is a diagrammatic illustration of operation of an automatic tilt factor correction mechanism according to an exemplary embodiment of the invention.

FIGS. 5A-F, 5G1, 5G2, 5H, 5I, 5J1, 5J2, 5J3, 5J4-5J10 are various views of a bulb cone into which an HID lamp can be removably mounted and to which a reflector can be mounted.

FIGS. 6A-I are various views of an elbow mount for connection to a cross arm on a pole.

FIGS. 7A-J are various views of an elbow connectable to the elbow mount of FIG. 6A and to the cone of FIG. 5A.

FIGS. 8A-D are various views of a gearing piece useful with the preferred embodiment.

FIGS. 9A-E are various views of a bushing used with a bolt to pivotably connect the elbow and cone.

FIGS. 10A-B show a spring used with the preferred embodiment.

FIGS. 11A-C show a strap member used to lock the cone to the elbow.

FIGS. 12A-F show additional straps used for such locking.

FIGS. 13A-F show an end stop also used for adjustable locking of the angular orientation of the cone to the elbow.

FIGS. 14A-I are various views of a yoke into which the HID lamp is mounted which can pivot angularly relative to the cone.

FIGS. 15A-D are views of yoke retainers.

Figure 18A:
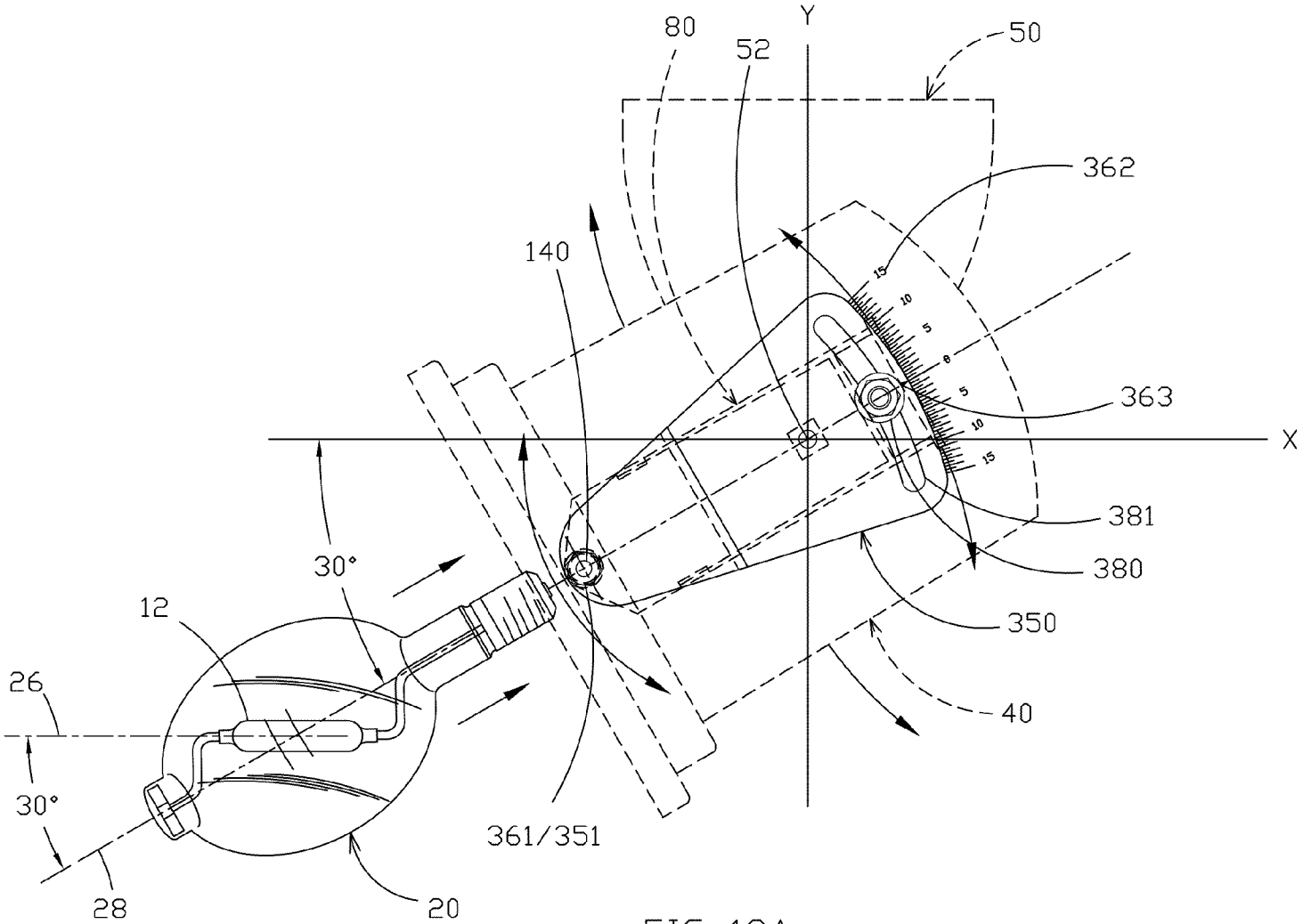
FIG. 18A is a diagrammatic illustration of operation of a manual tilt factor correction mechanism according to an alternative exemplary embodiment of the invention.
Figure 18B:
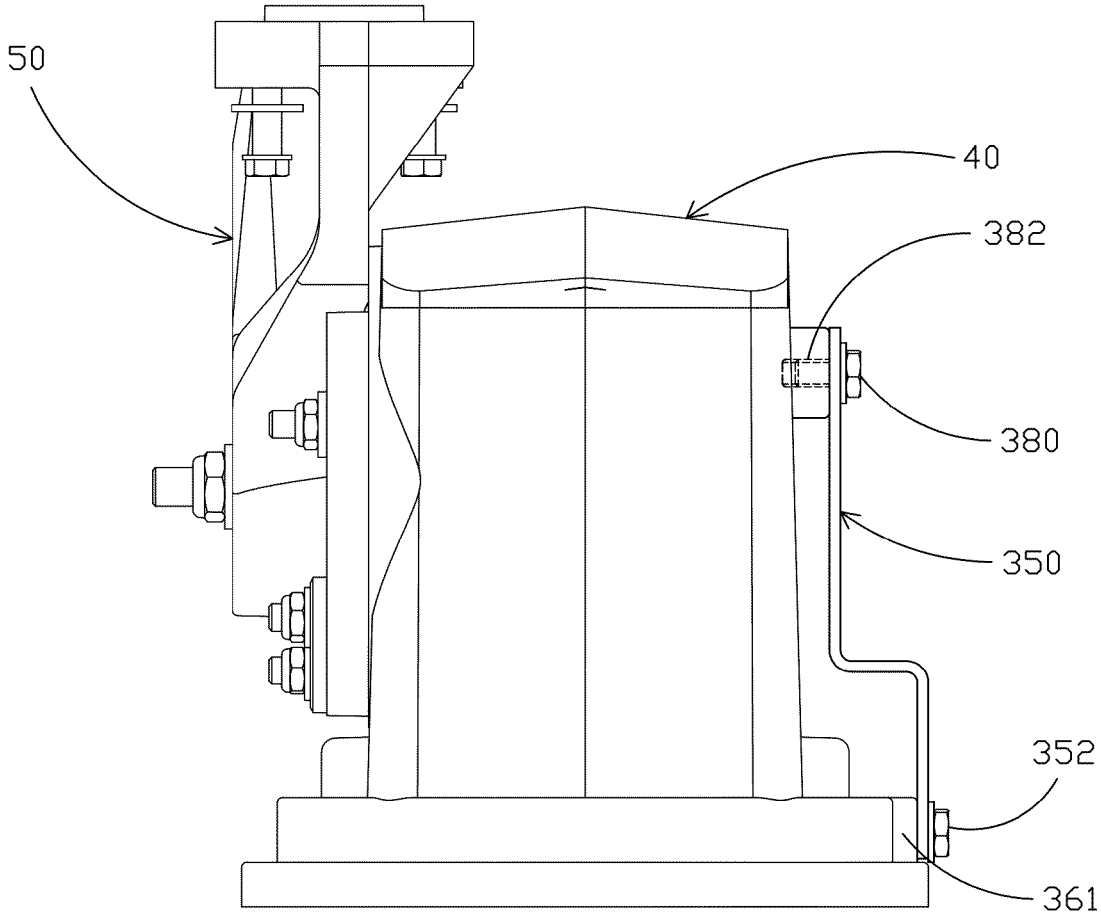
FIG. 18B is a front elevation view of FIG. 18A without lamp 20.
Figure 18C:
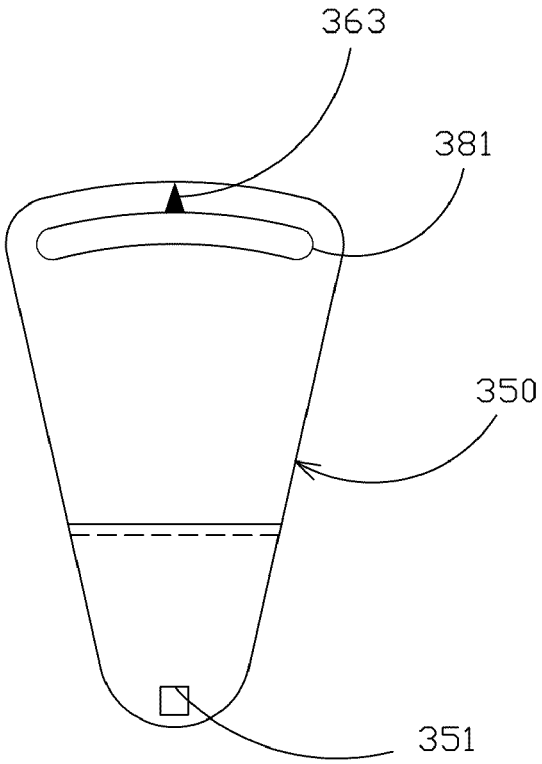
Figure 18D:
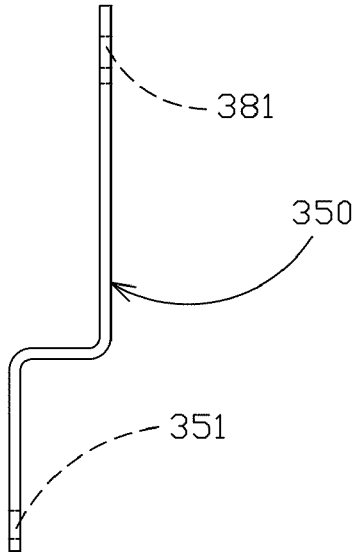

FIGS. 18C and D are views of the adjustment arm 350 of FIGS. 18A and B.

Figure 18E:
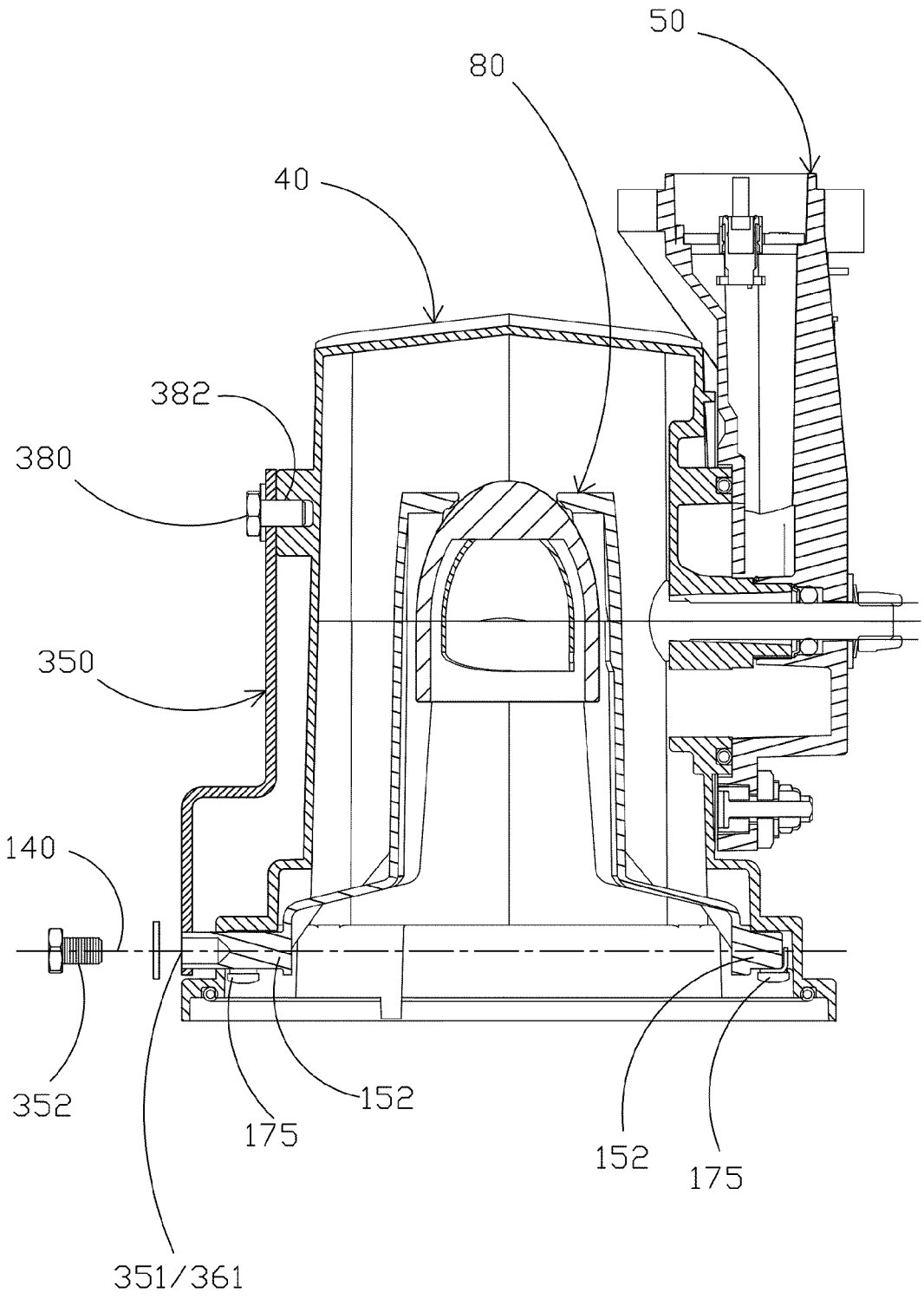

FIG. 18E is a back elevation view of FIG. 18B showing components in section in a similar fashion to FIG. 5J5.

Figure 19:
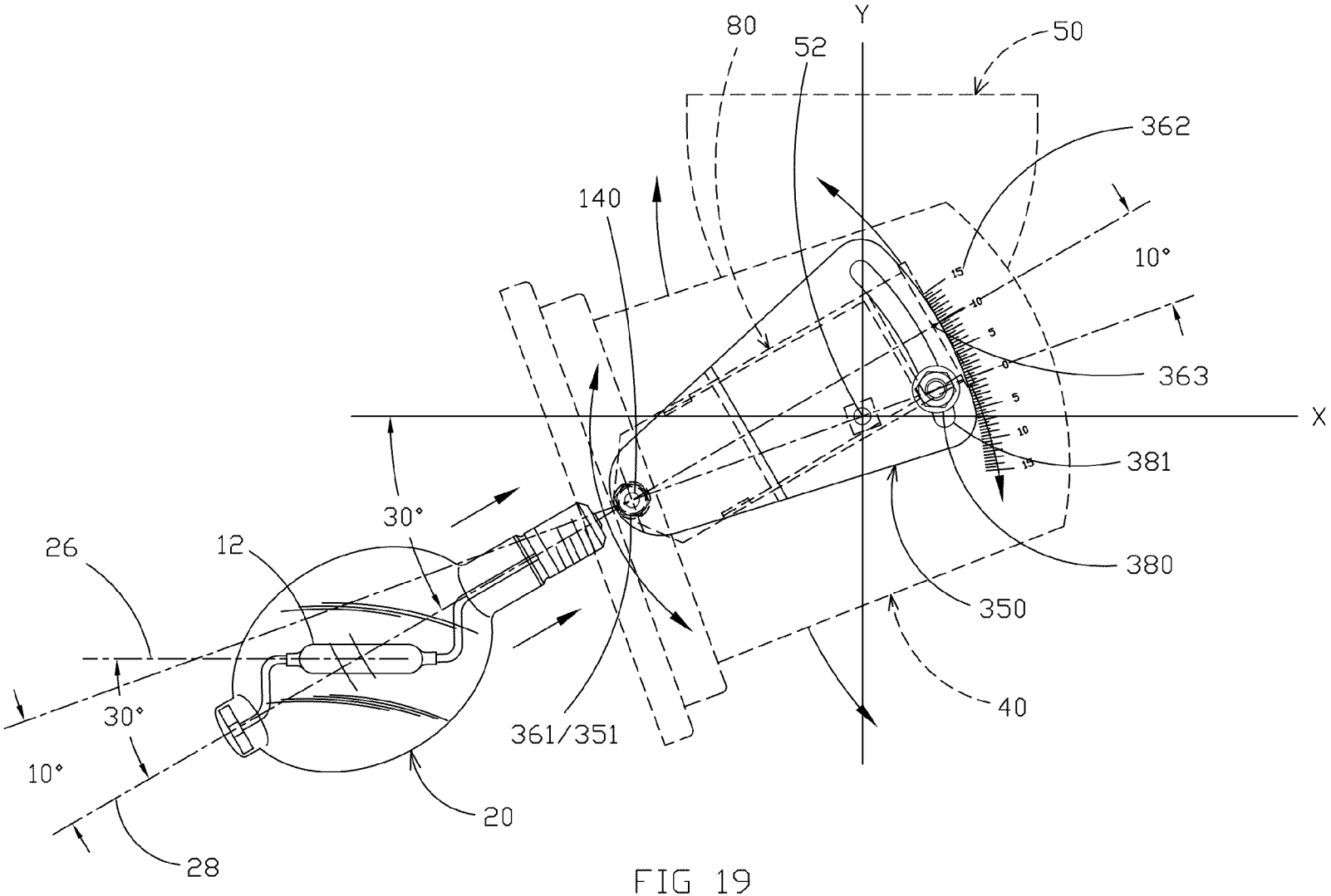

FIG. 19 is similar to FIG. 18A but showing adjustment of lamp 20 for a lamp cone 40 pivoted around axis 52 compared to its position in FIG. 18A.

Figure 20:
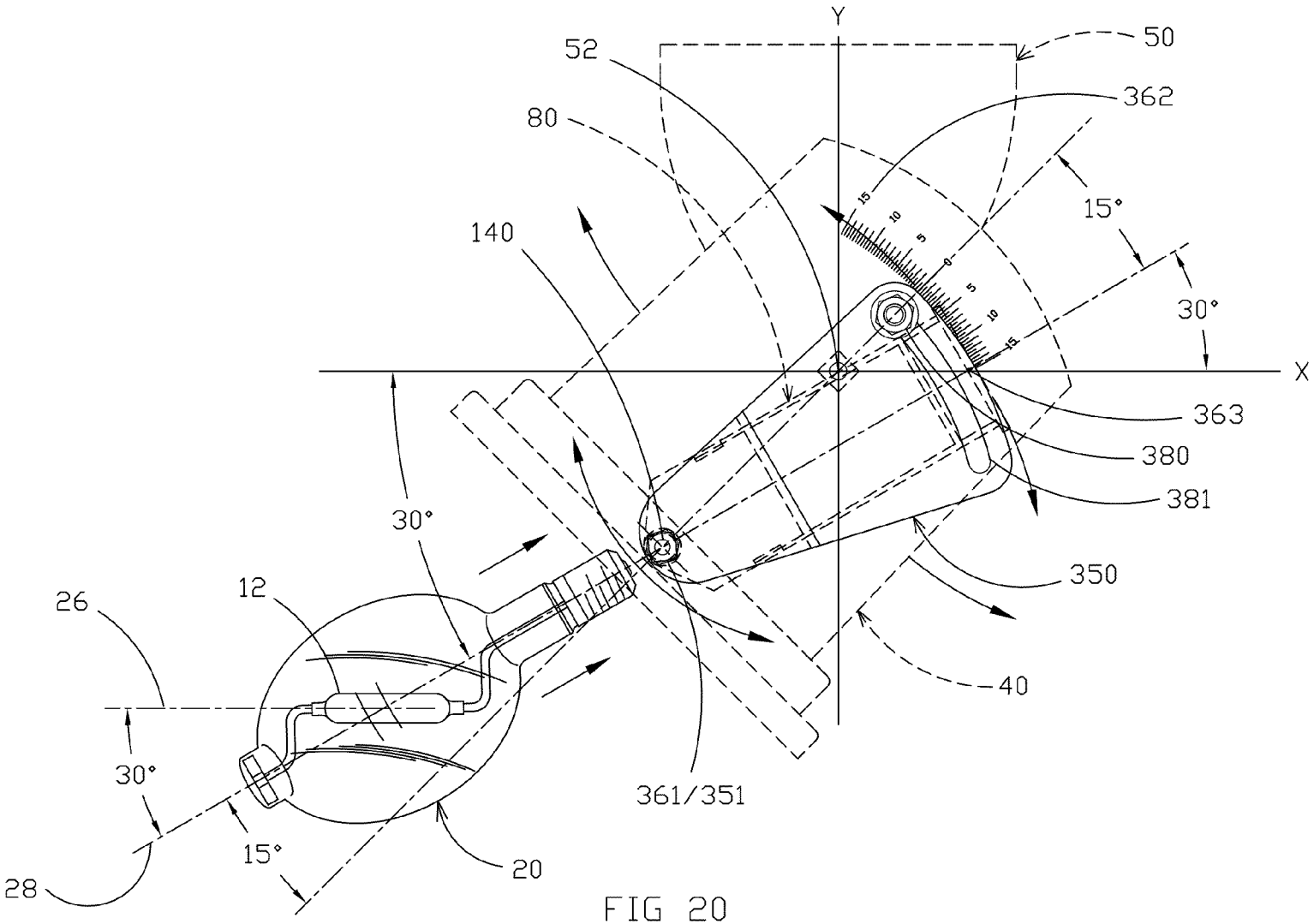

FIG. 20 is similar to FIG. 19 but showing adjustment of lamp 20 for lamp cone 40 pivoted in opposite fashion.

Figure 21A:
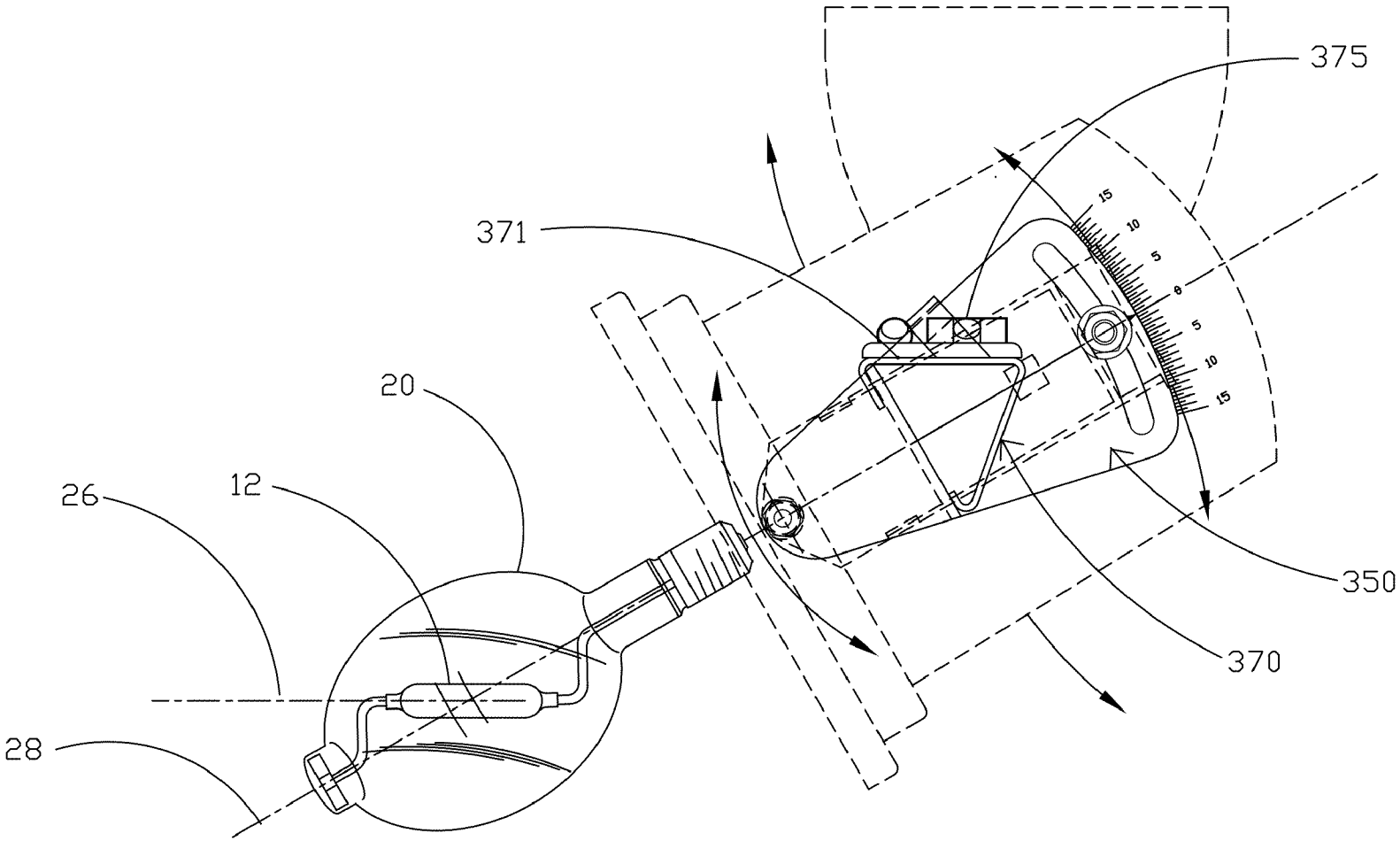

FIG. 21A is similar to FIG. 18A but with an optional bubble level tool 370.

Figure 21B:
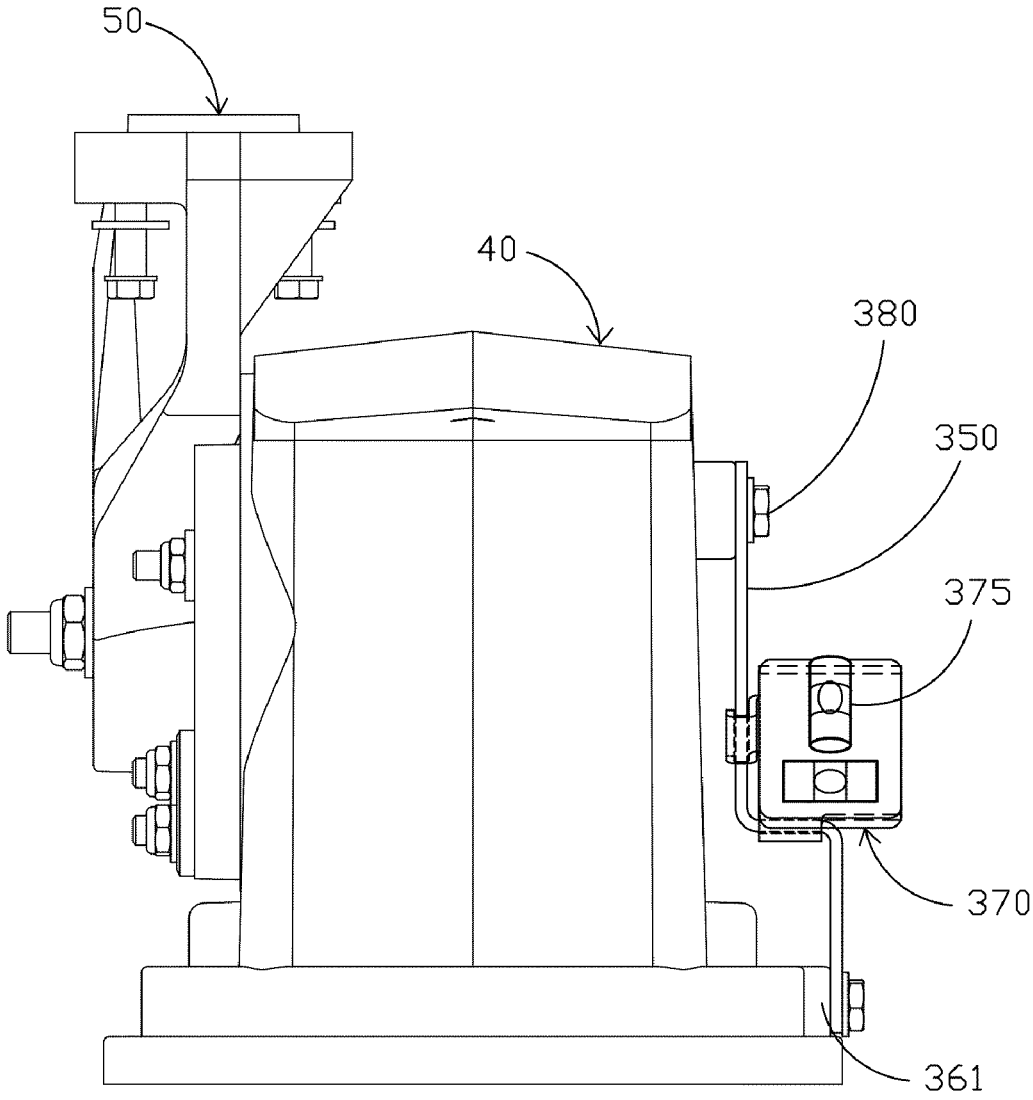

FIG. 21B is a front elevation view of FIG. 21A.

Figure 22:
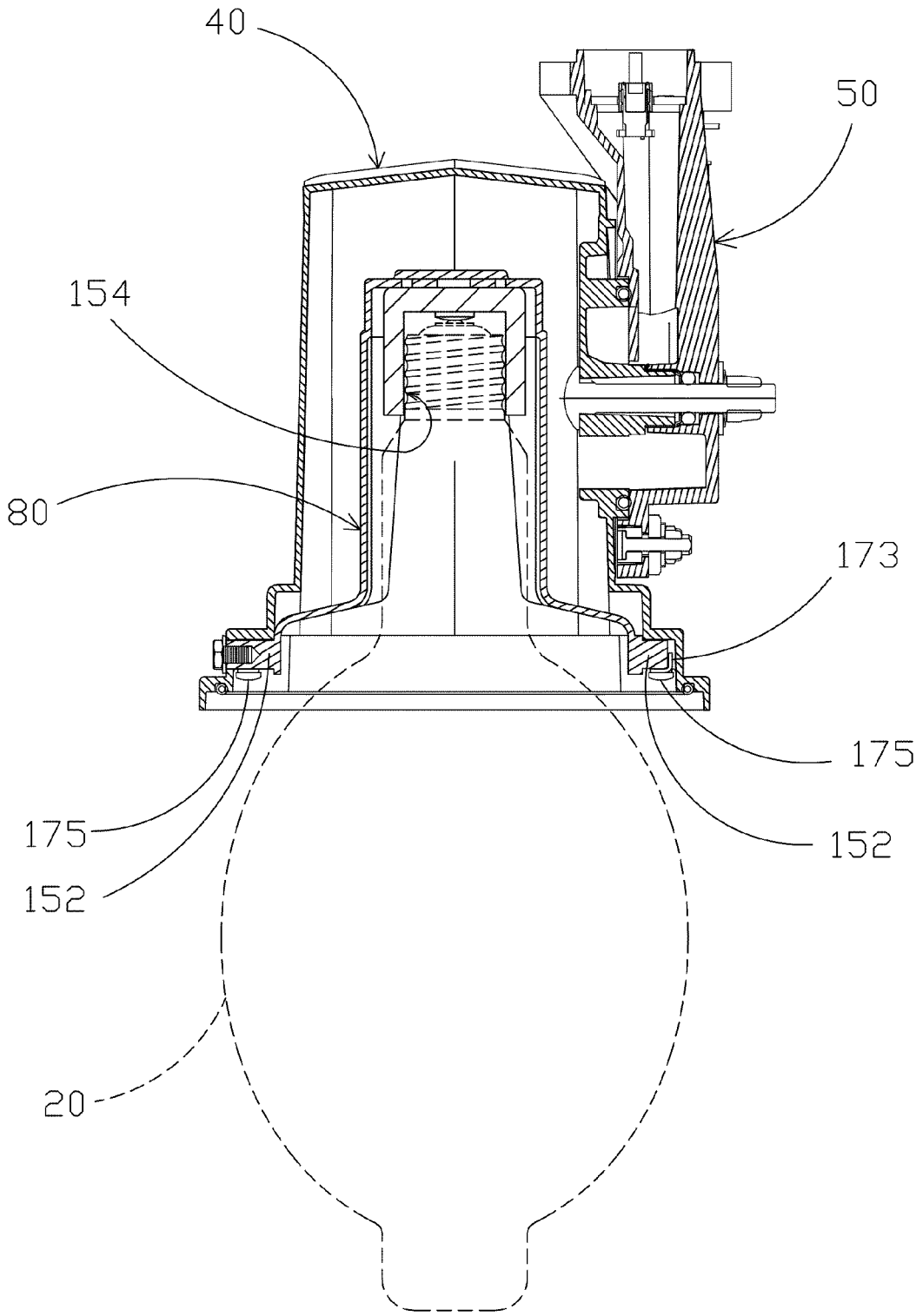

FIG. 22 is a back elevation view similar to FIG. 18E but without an adjustment arm 350, and diagrammatically illustrating a lamp in operational orientation.

Figure 23A:
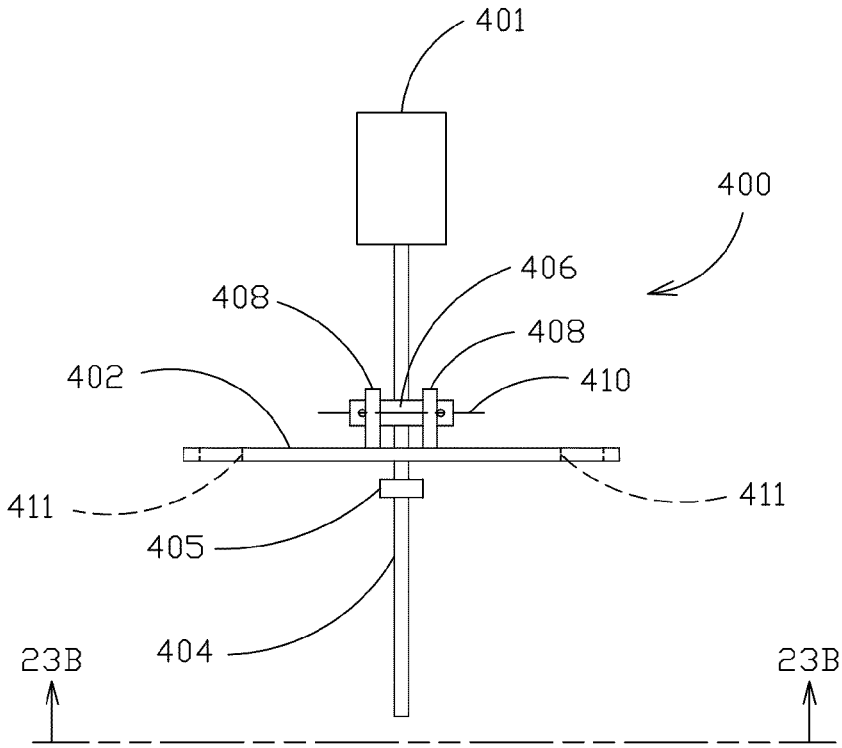

FIG. 23A is a top plan view of an optional tool 400 that can be used to adjust lamp position.

Figure 23B:
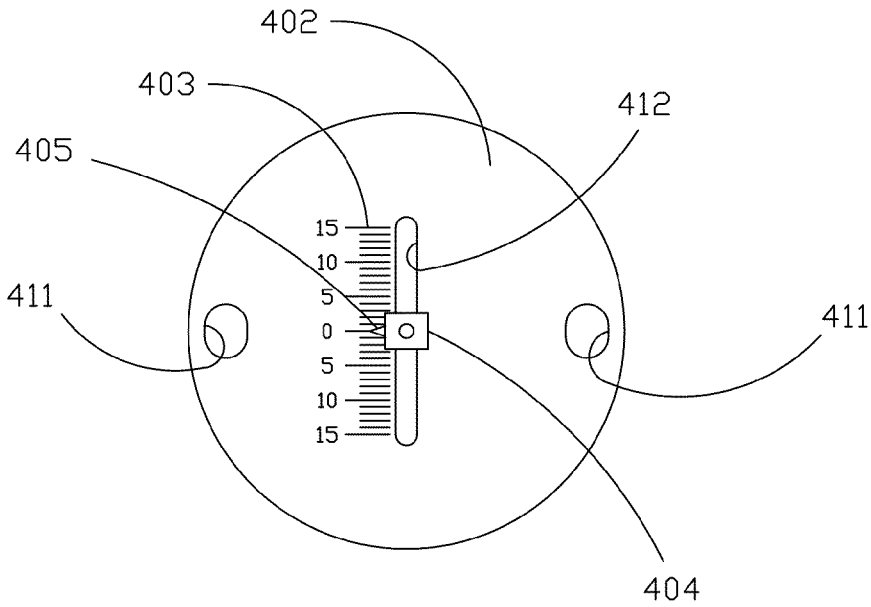

FIG. 23B is a front plan view of FIG. 23A along line 23B-23B.

IV. DETAILED DESCRIPTION OF EXEMPLARY EMBODIMENTS

A. Exemplary Apparatus

1. Lighting Fixture 10 Generally

Figure 3:
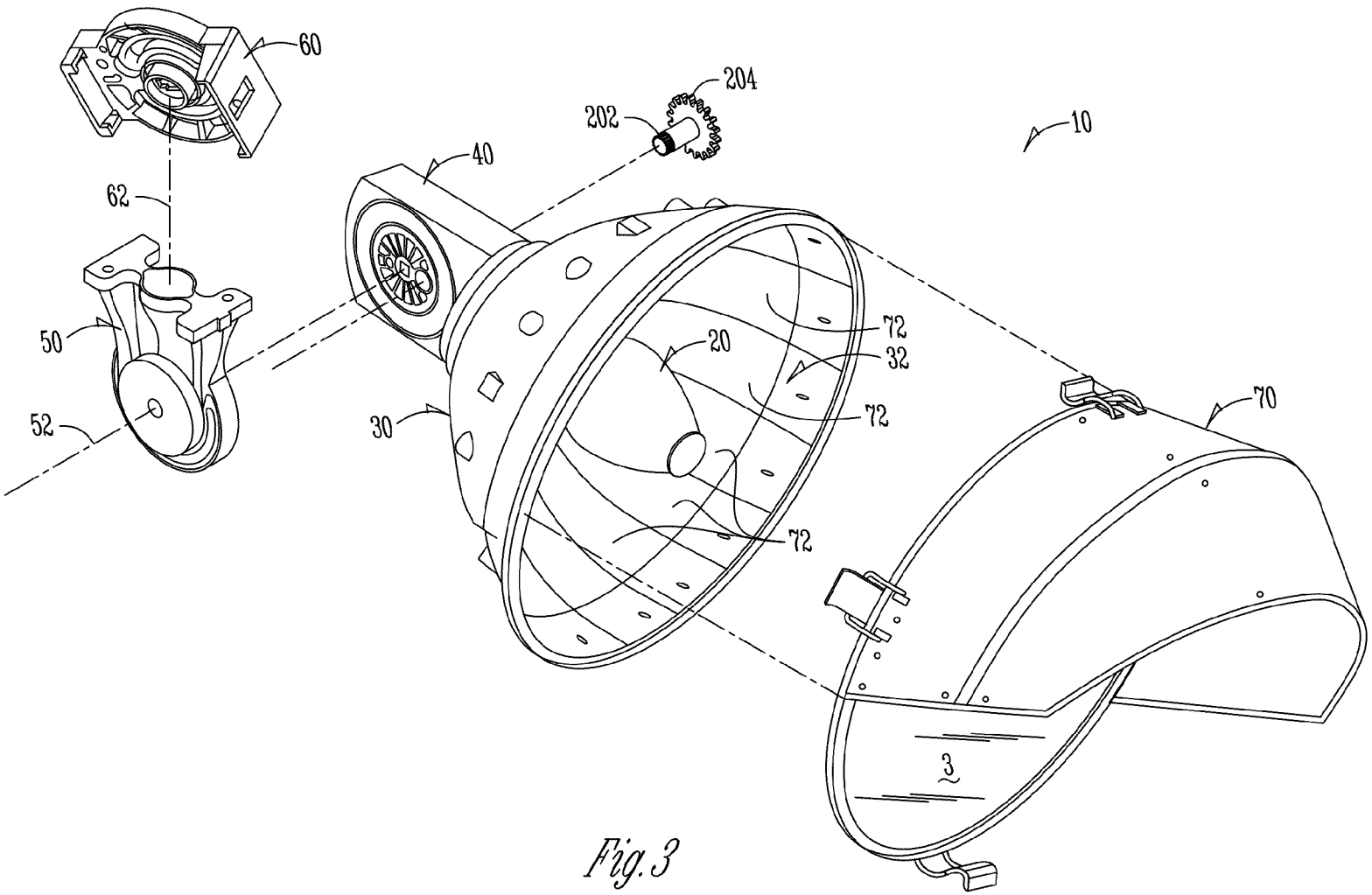
Figure 4A:
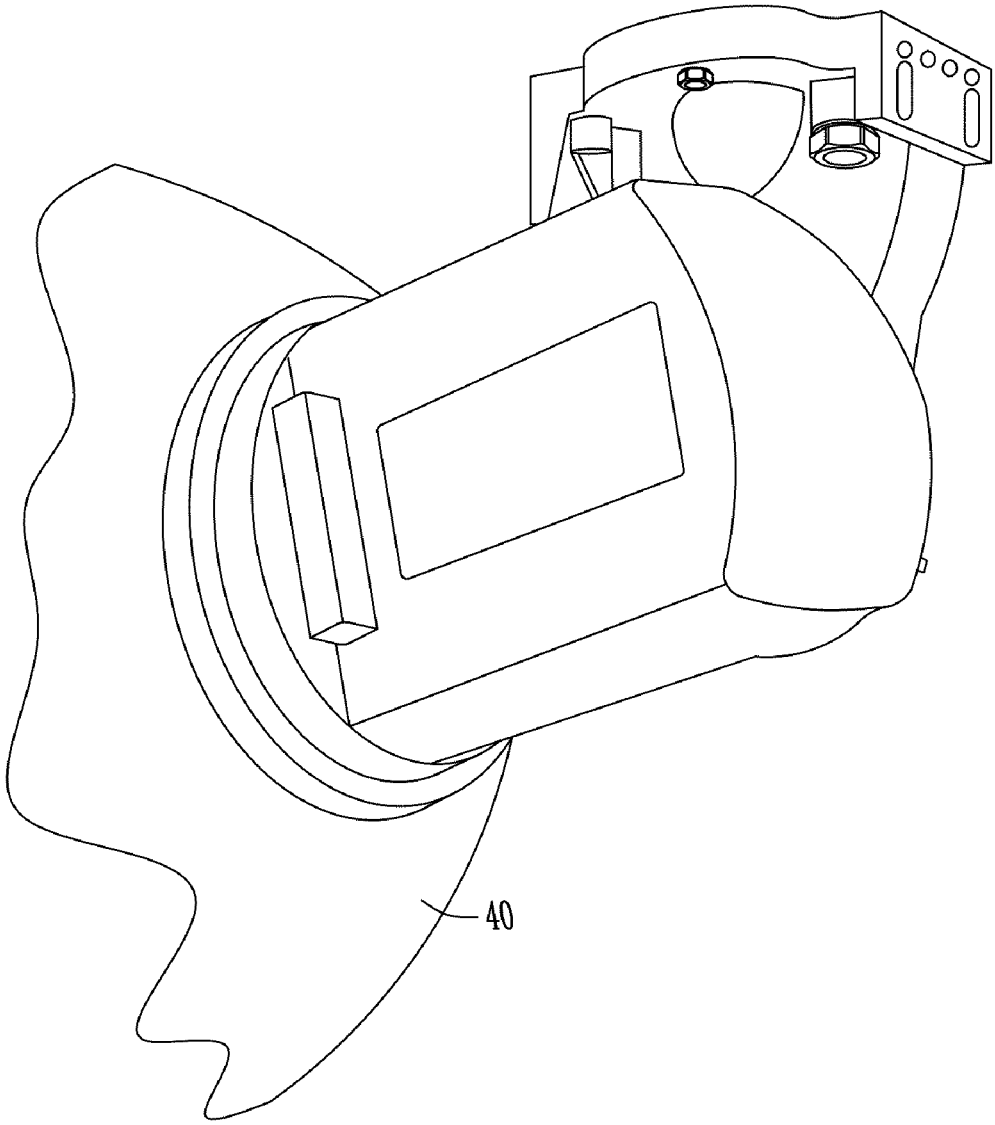
Figure 4B:
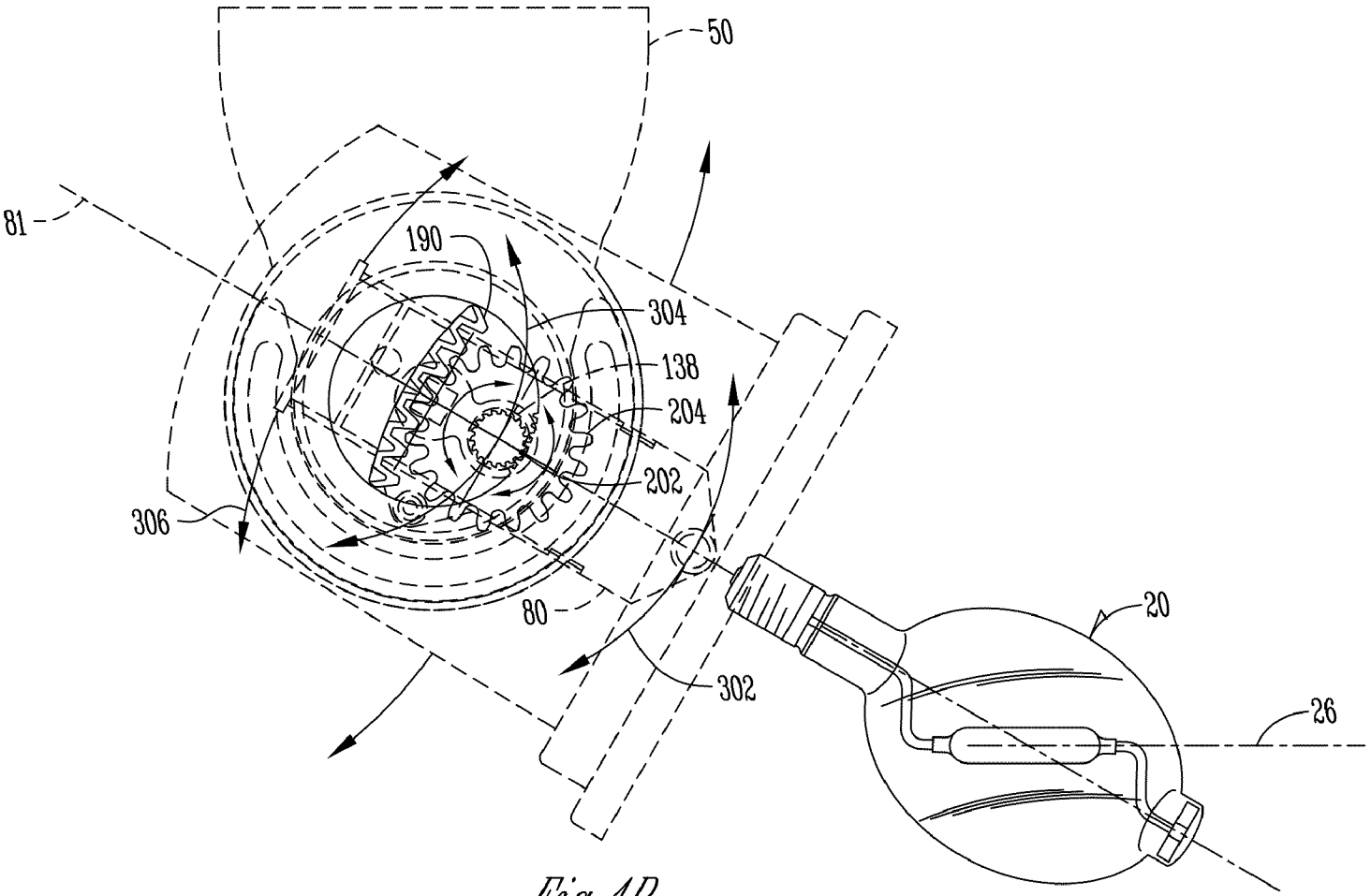
Figure 4C:
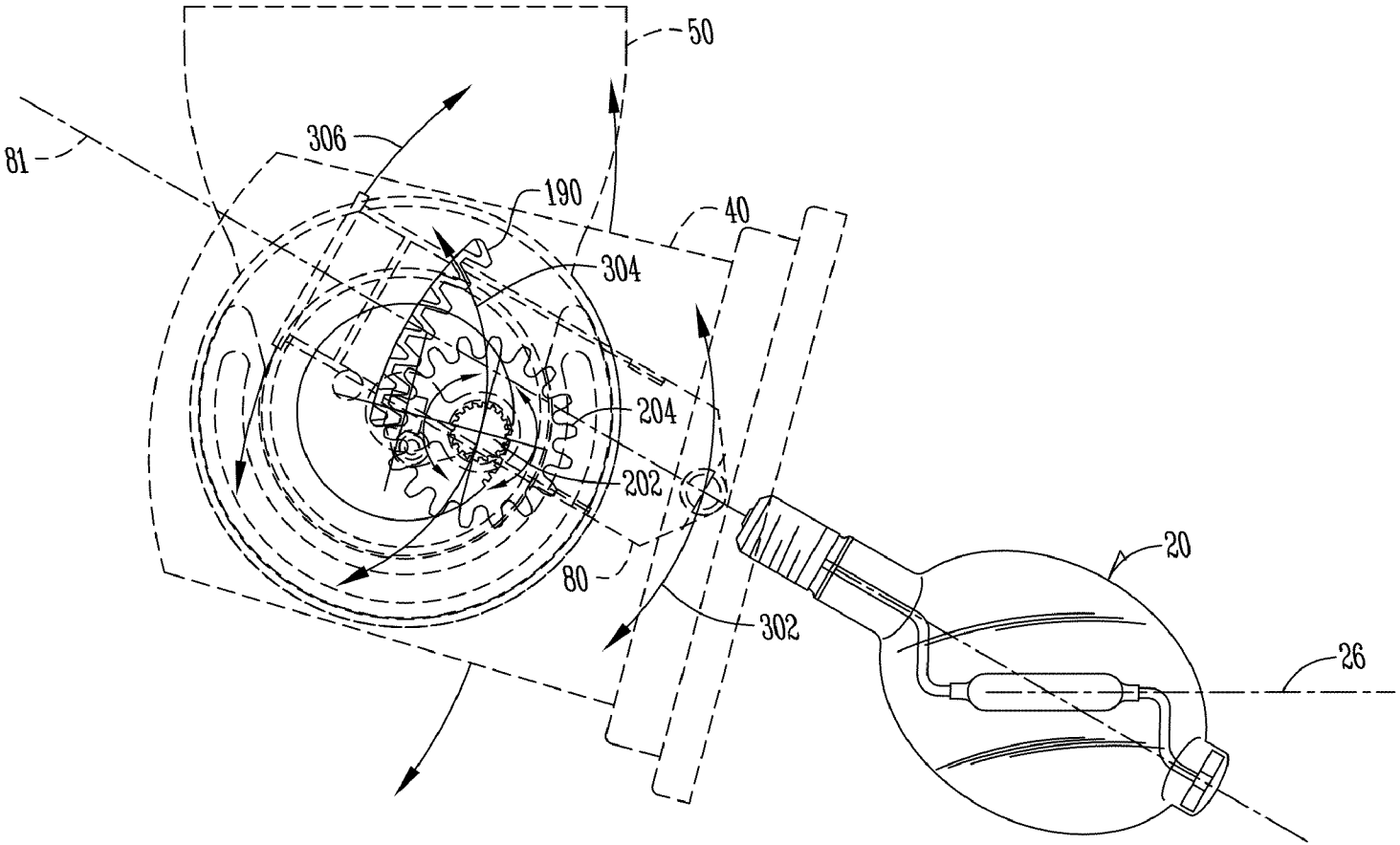
Figure 4D:
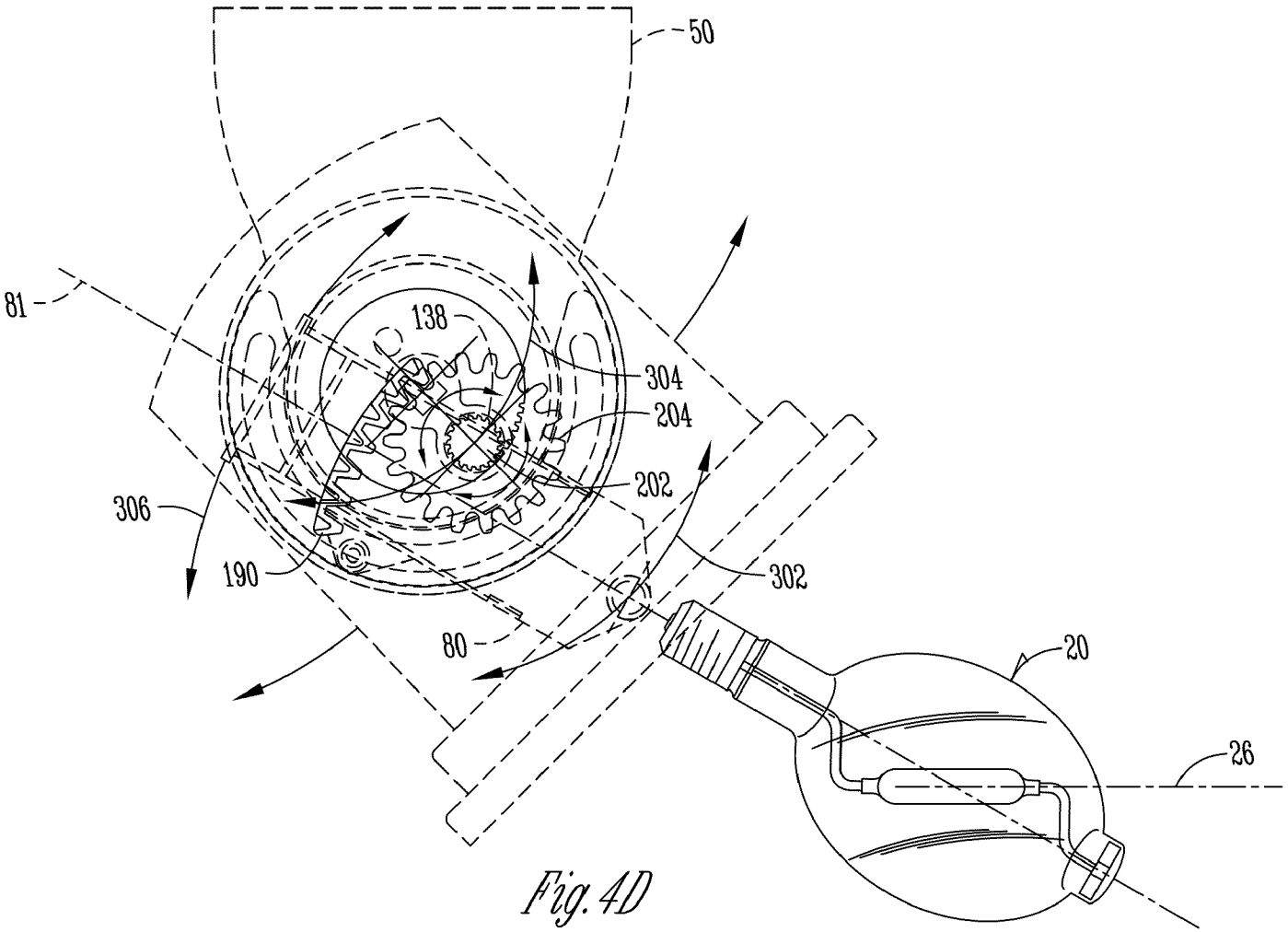

FIG. 3 shows the basic components of sports lighting fixture 10 in exploded form.

Figure 1A:
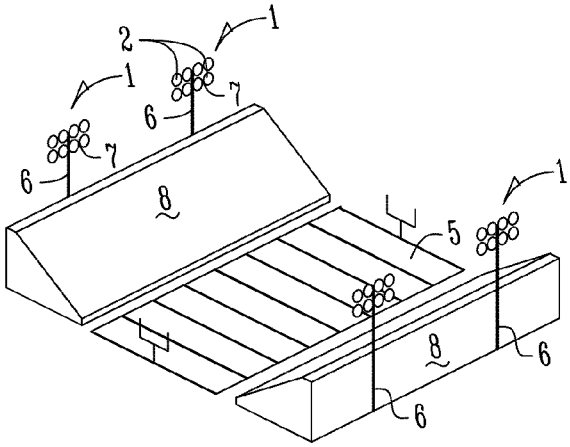
Figure 1B:
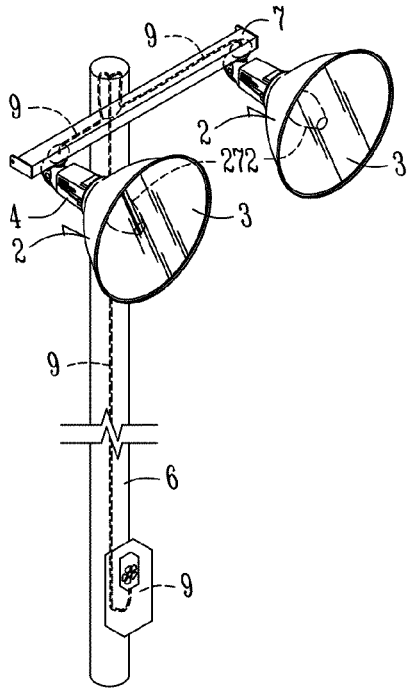
Figure 1C:
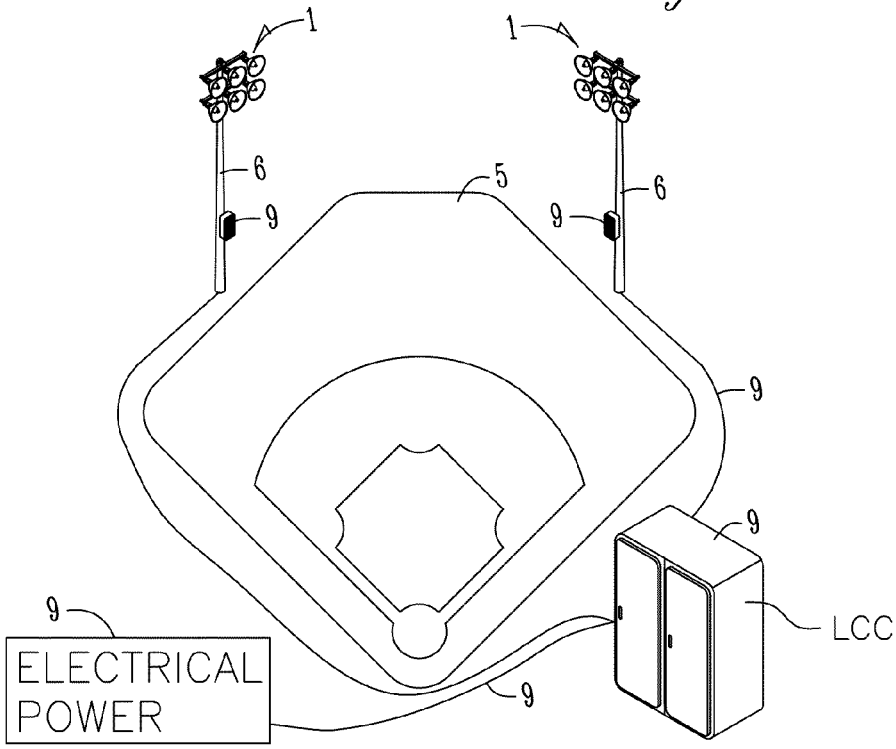
Figure 1D:
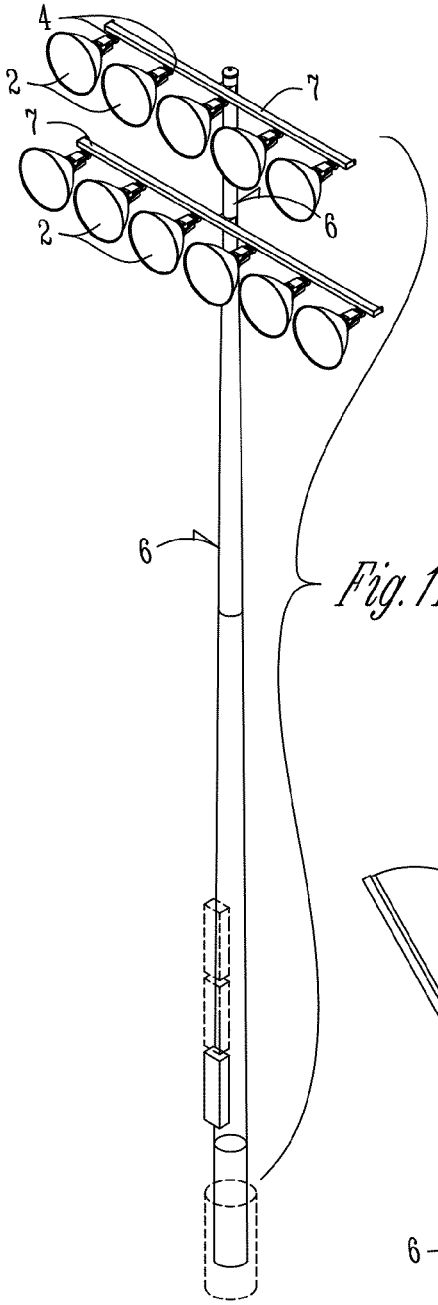
Figure 1G:
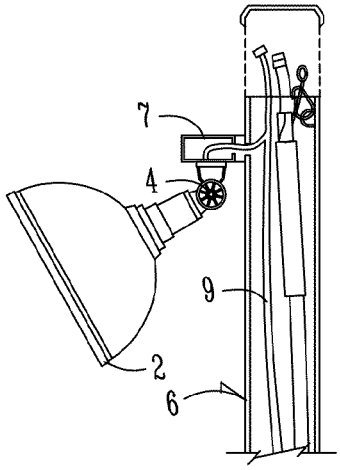
Figure 1E:
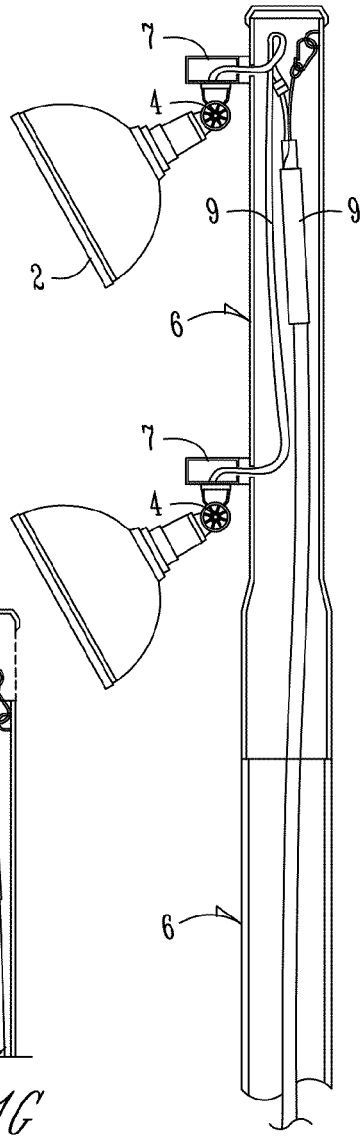
Figure 1F:
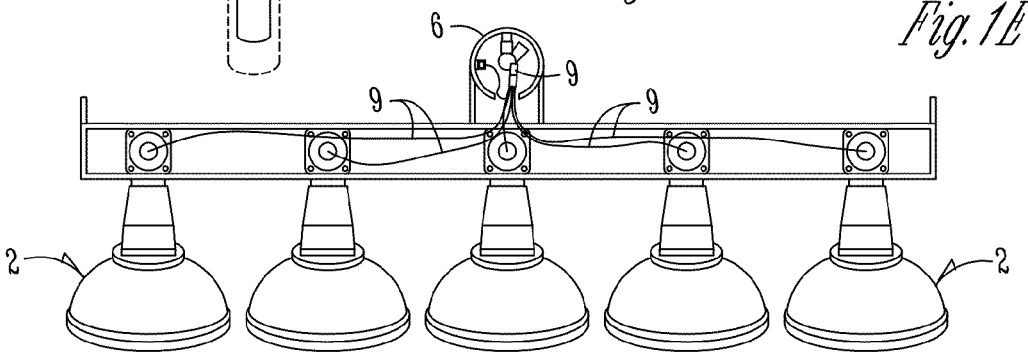
Figure 2A:
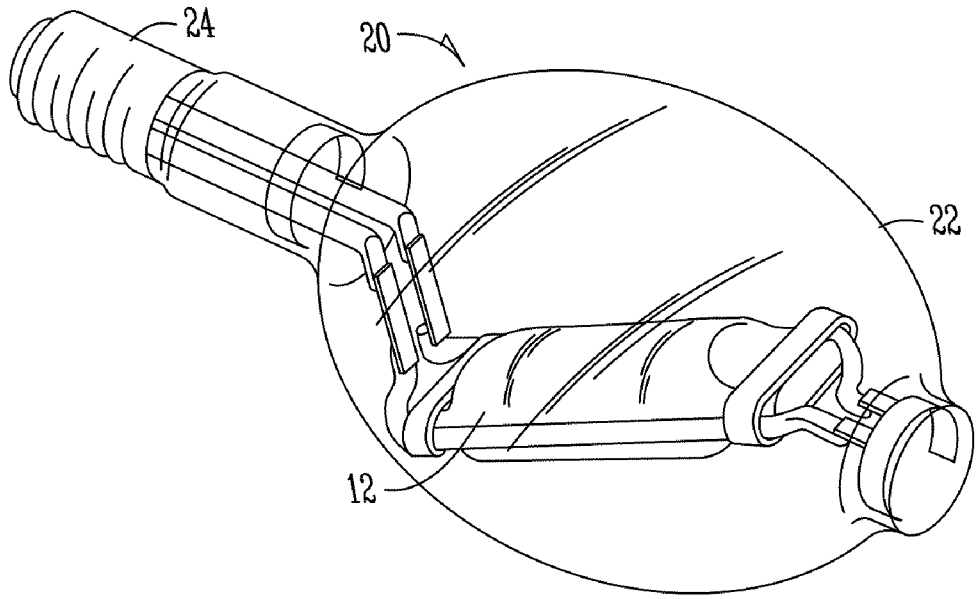
Figure 2B:
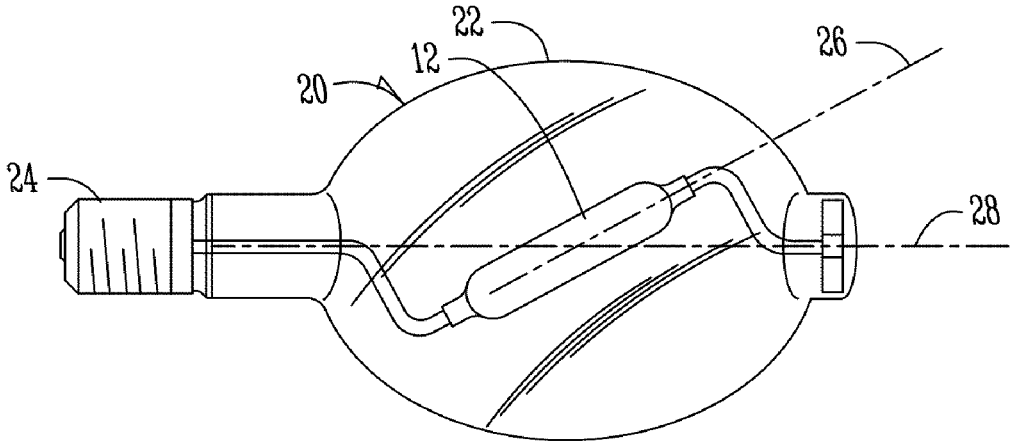
Figure 2C:
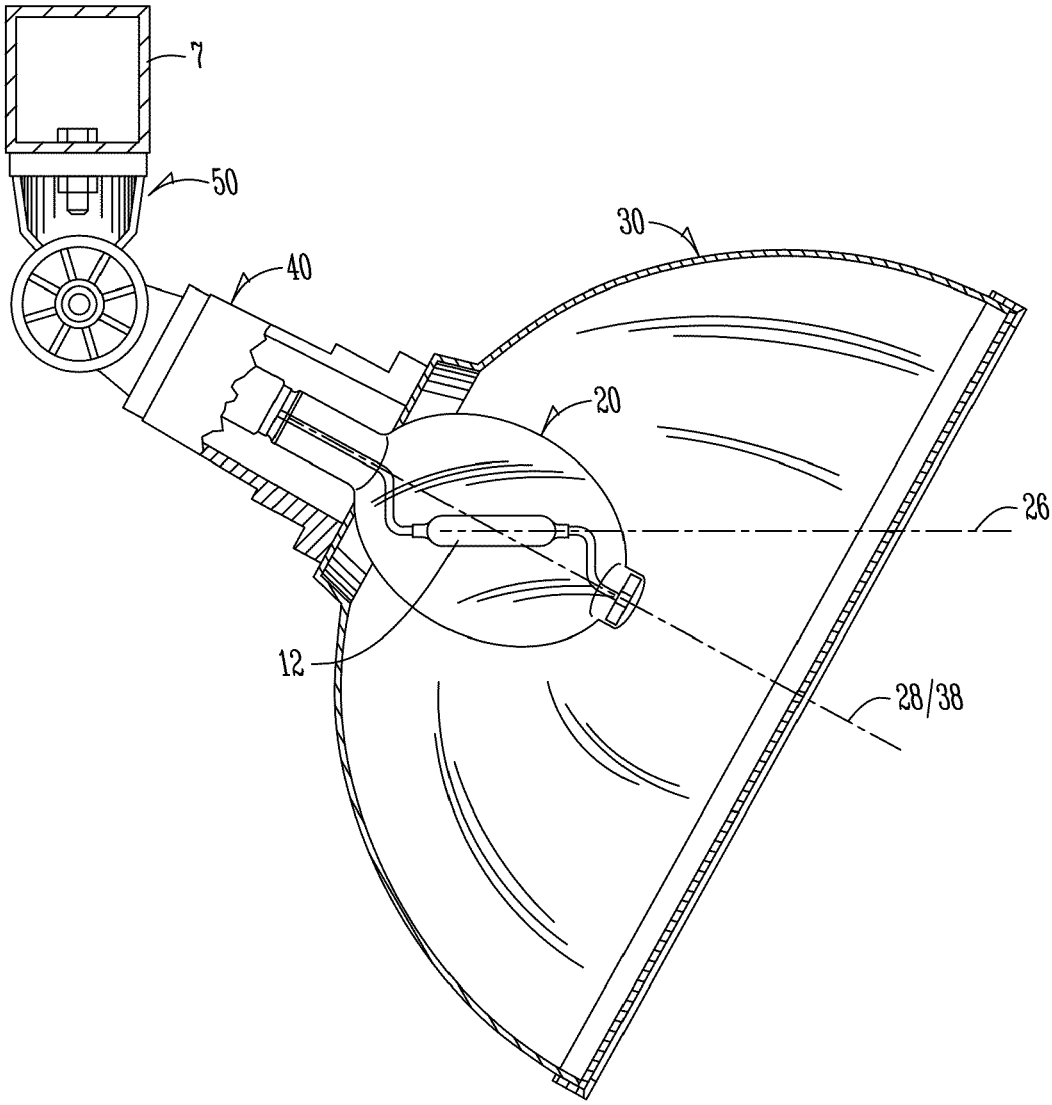
Figure 14A:
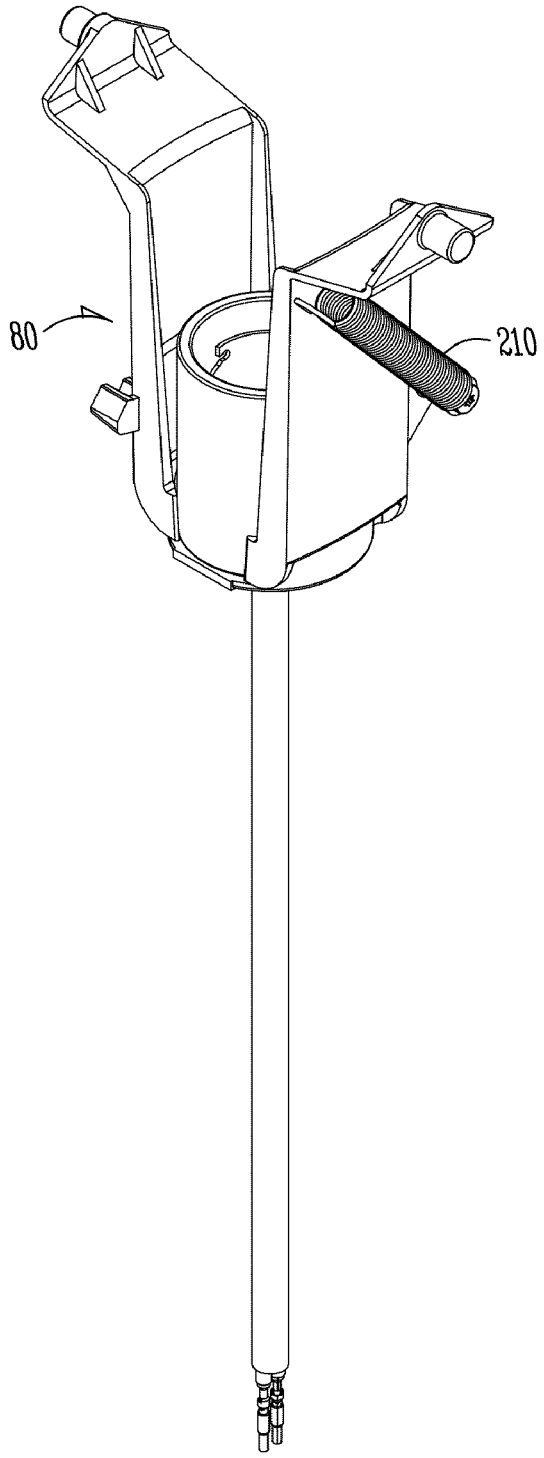

Lamp cone 40 (360 Aluminum with polyester powder coat) pivots around axis 52 relative to knuckle 50, which pivots around axis 62 relative to knuckle plate 60 which is fixed to cross arm 7 (see FIGS. 3 and 7D4); alternatively, knuckle 50 may be fixed to cross arm 7 directly (see FIG. 2C). Lamp cone 40 contains a socket 154 (shown diagrammatically in FIG. 14A, commercially available) which is bolted to flat web 160 between arms 156 and 158 of yoke 80 (see FIG. 14A). Lamp 20 (Musco Corporation Z-LAMP™ brand lamp) has a threaded base 24 that can be screwed in and out of socket 154 (shown screwed into operating position in FIG. 3) to install or removed lamp 20 from fixture 10 which may further comprise a reflector frame 30 (which may house individual reflector components 72), a visor system 70, and a lens 3.

2. Lamp 20

Arc lamp 20 is of the general type disclosed in Musco Corporation U.S. Pat. No. 5,856,721, incorporated by reference herein, with certain modifications. These types of lamps are used by Musco Corporation under the trademark Z-LAMP™ brand lamps and typically are 1000 watt or greater metal halide (MH) HID lamps. Its arc tube 12, housed in lamp envelope 22, is tilted obliquely along axis 26 across longitudinal axis 28 of arc lamp 20. In operation, arc tube 12 is rotationally positioned in fixture 10 such that the longitudinal axis of arc tube 12 is as close to a horizontal plane as possible.

3. Yoke 80

Figure 5A:
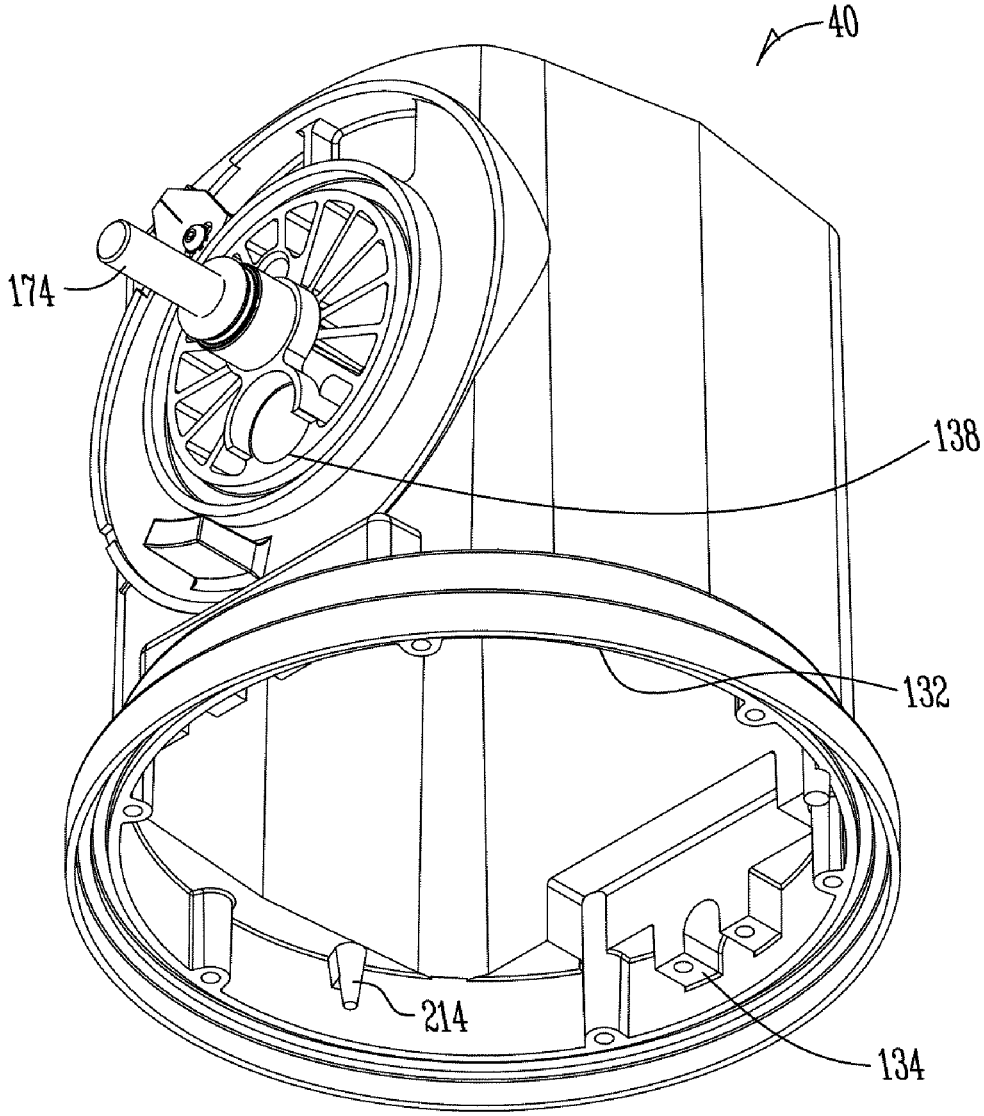
Figure 5B:
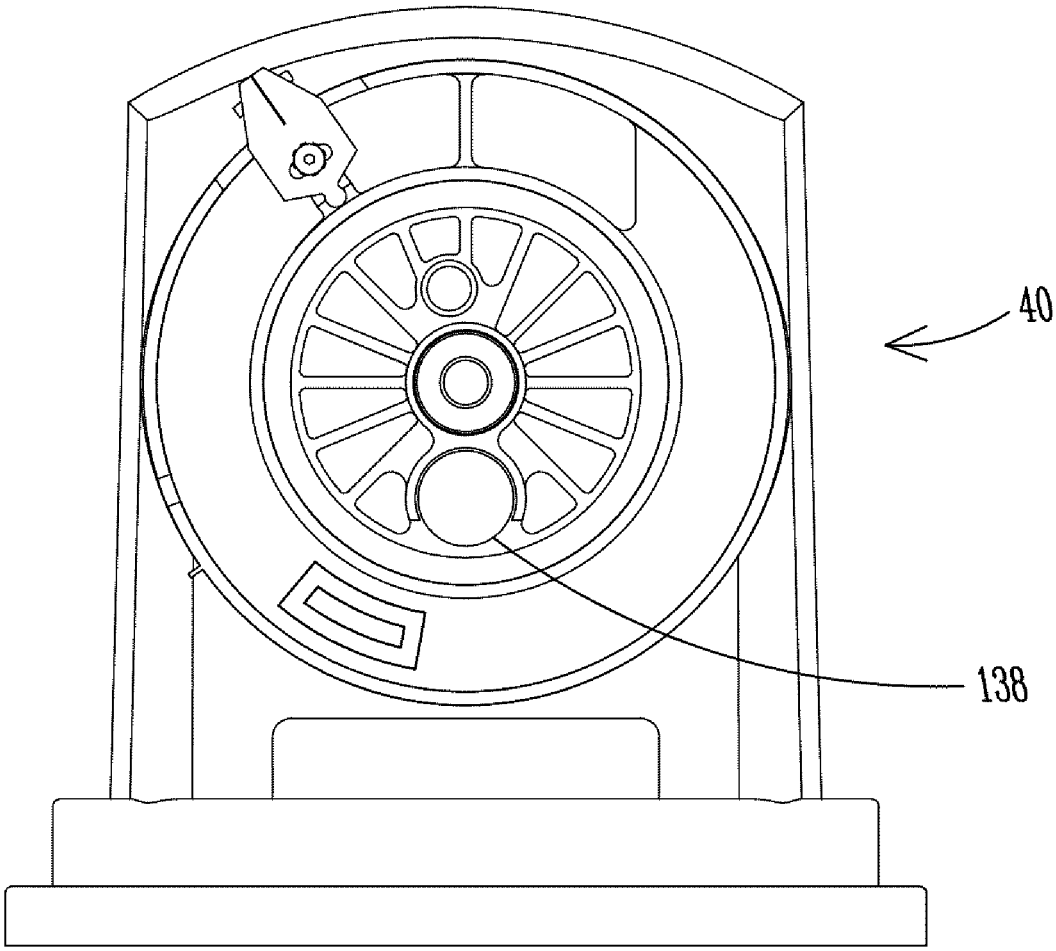
Figure 5C:
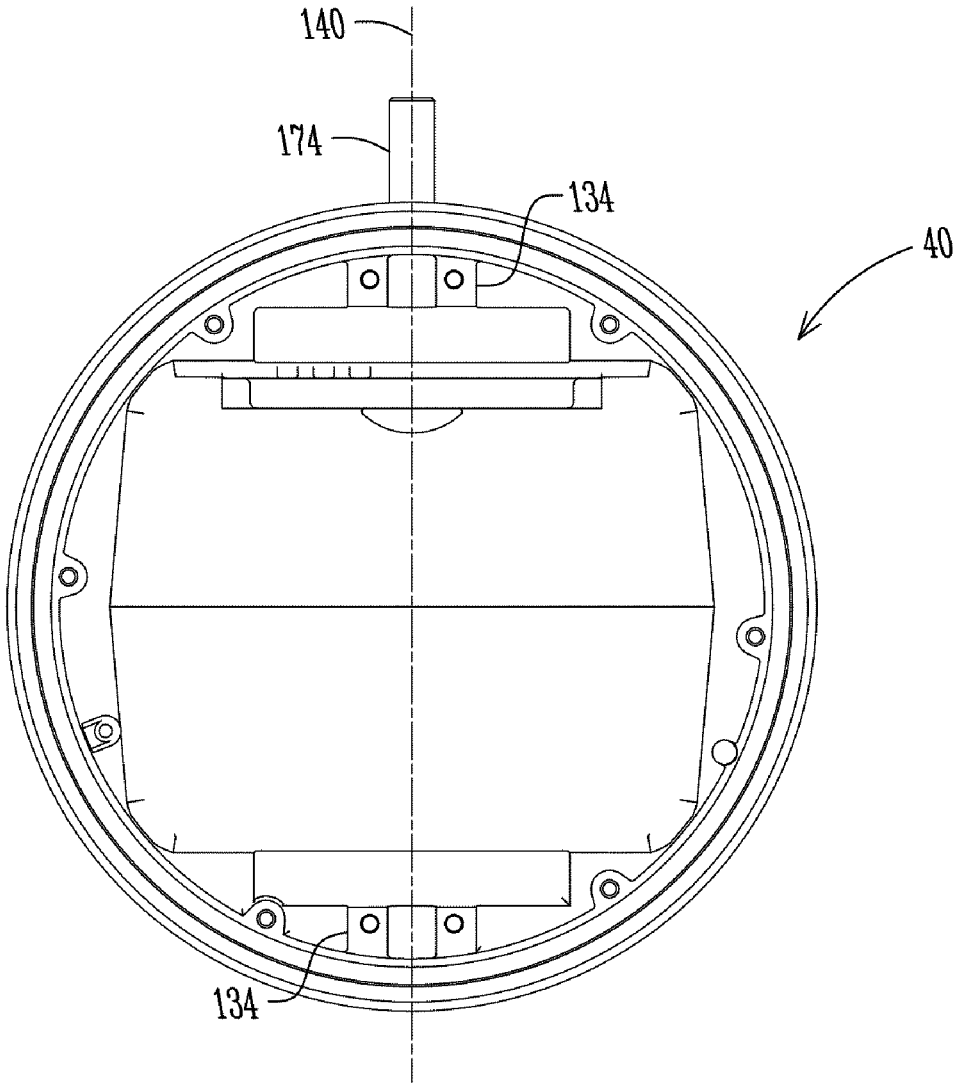
Figure 5D:
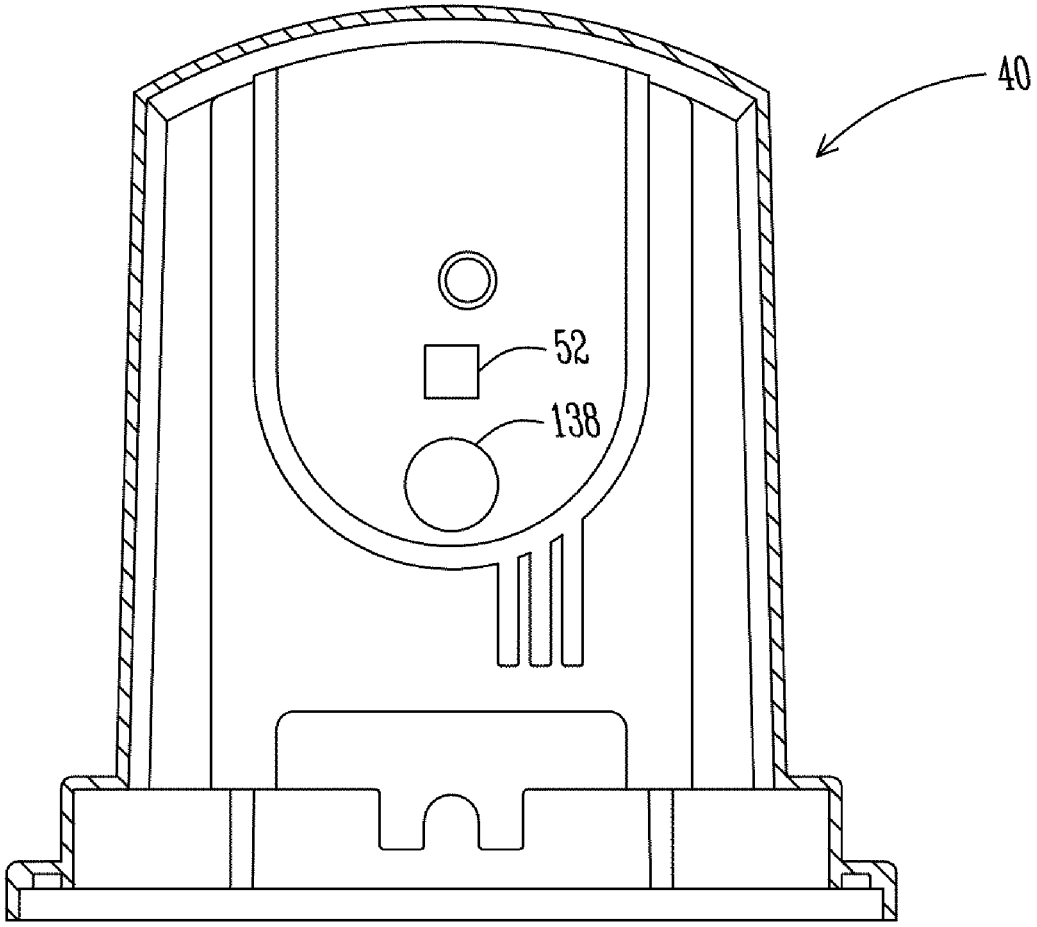
Figure 5E:
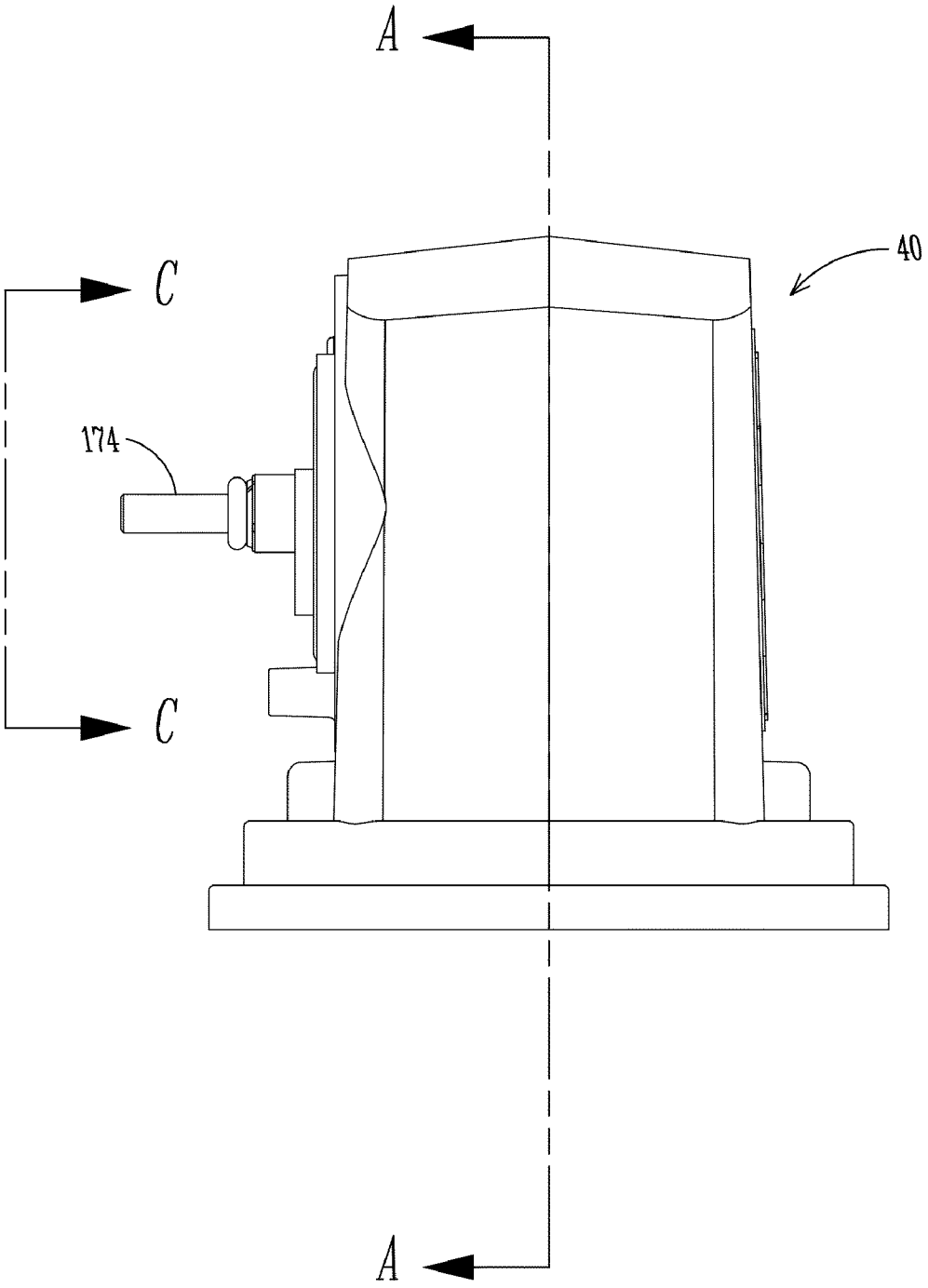
Figure 5F:
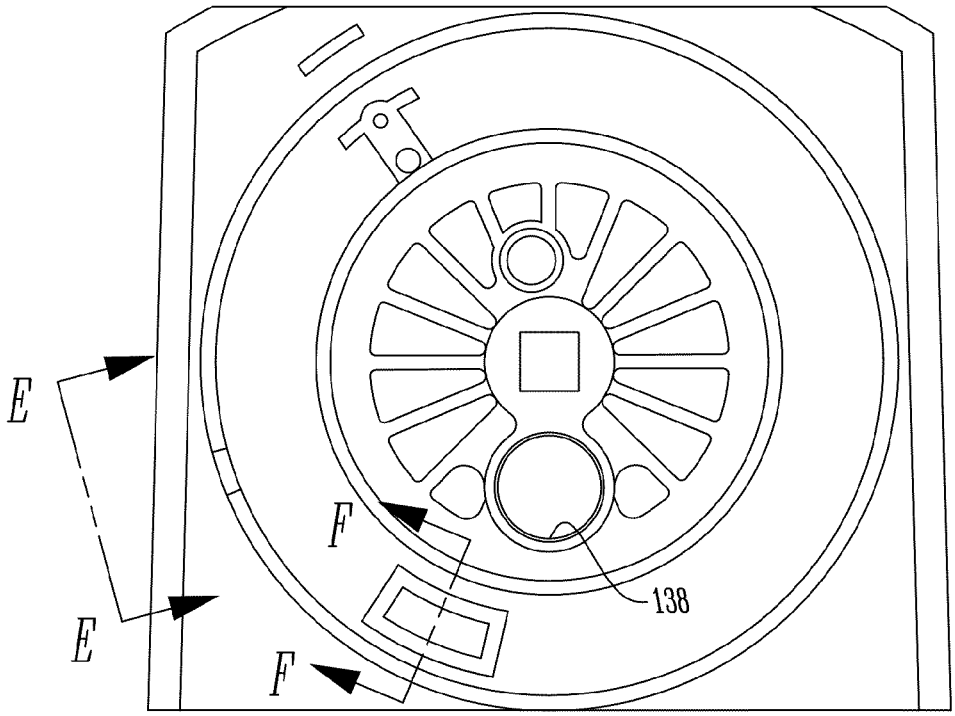
Figure 5H:
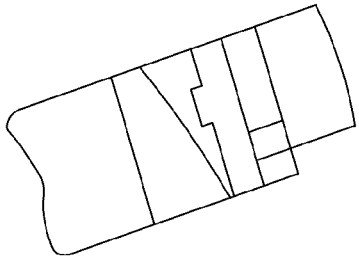
Figure 5I:
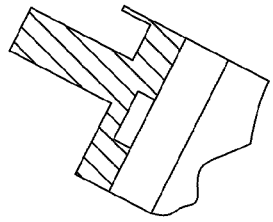
Figure 6A:
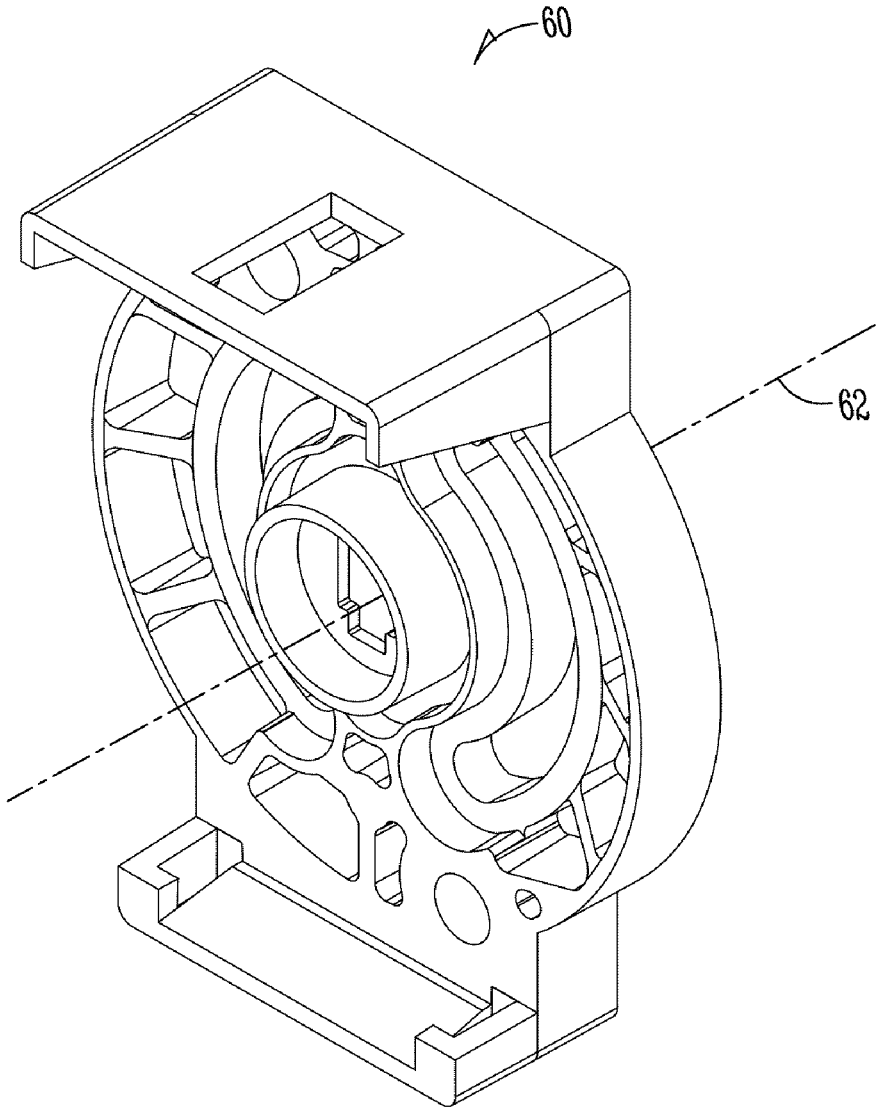
Figure 6B:
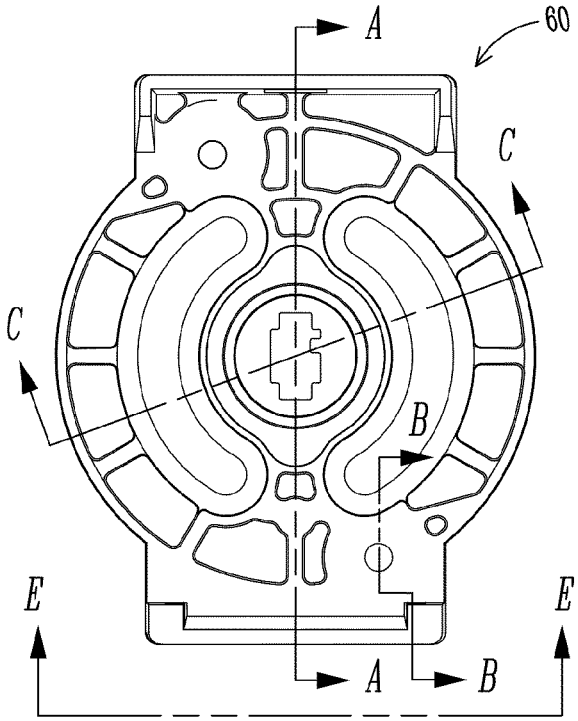
Figure 6C:
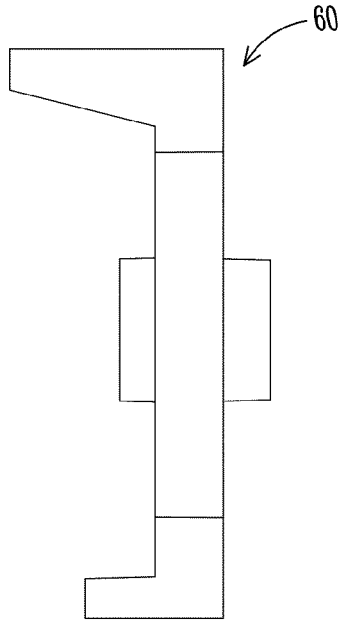
Figure 6D:
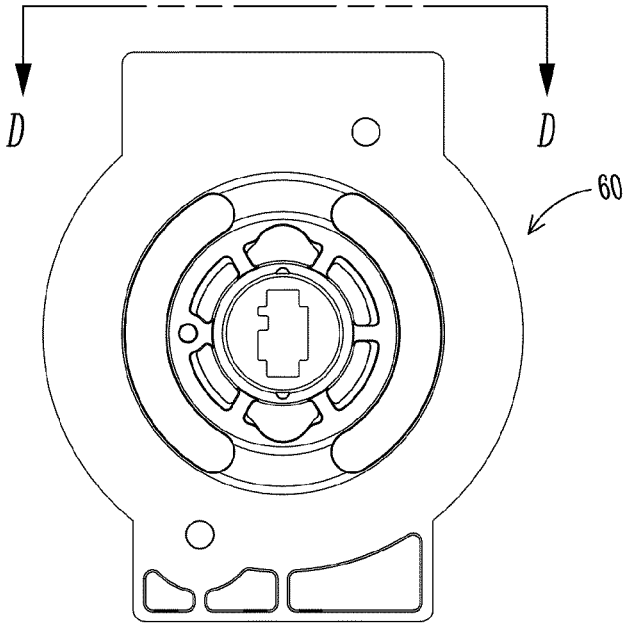
Figure 6G:
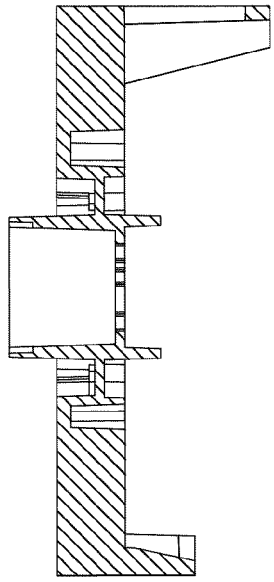
Figure 6E:
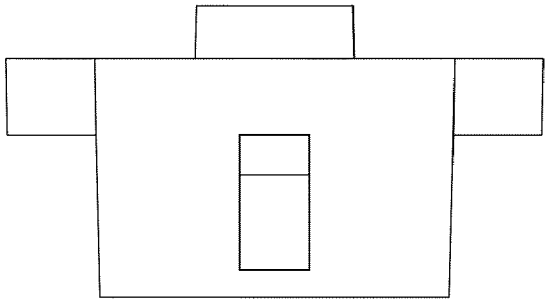
Figure 6F:
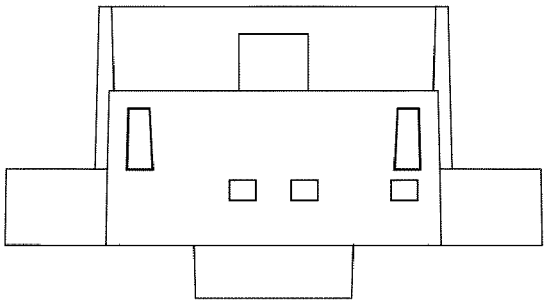
Figure 6H:
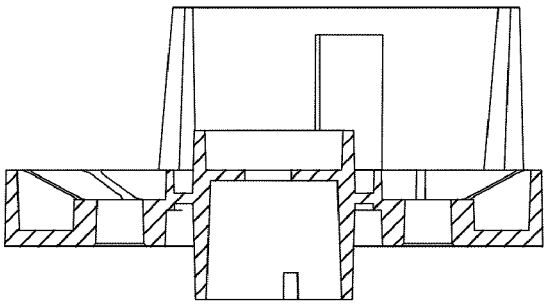
Figure 6I:
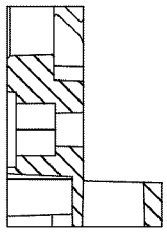

Yoke 80 is pivotally supported at the front of lamp cone 40 at pivot axis 140 (see FIG. 5C arc tube 12)." Pivot pins 152 of lamp yoke 80 (see FIG. 14A—and described in more detail below) slide longitudinally into mating receivers 134 (which define pivot axis 140) on opposite sides of opening 132 to lamp cone 40 and are retained in place by yoke retainers 173 (FIGS. 15A-D) by machine screws 175 in the pair of threaded bores on opposite sides of receivers 134 (see FIGS. 5C and 5J7, respectively).

Figure 14B:
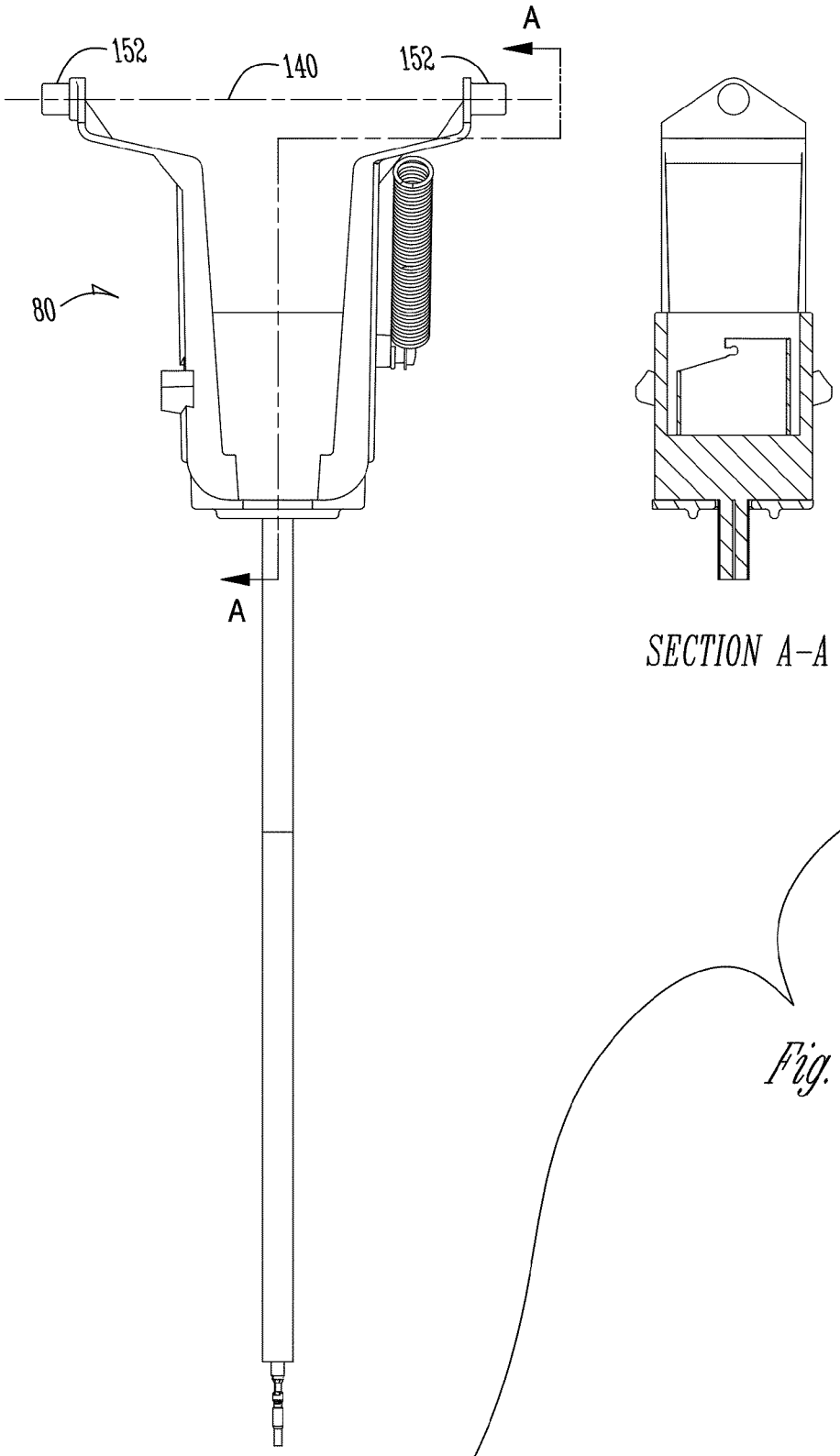
Figure 14C:
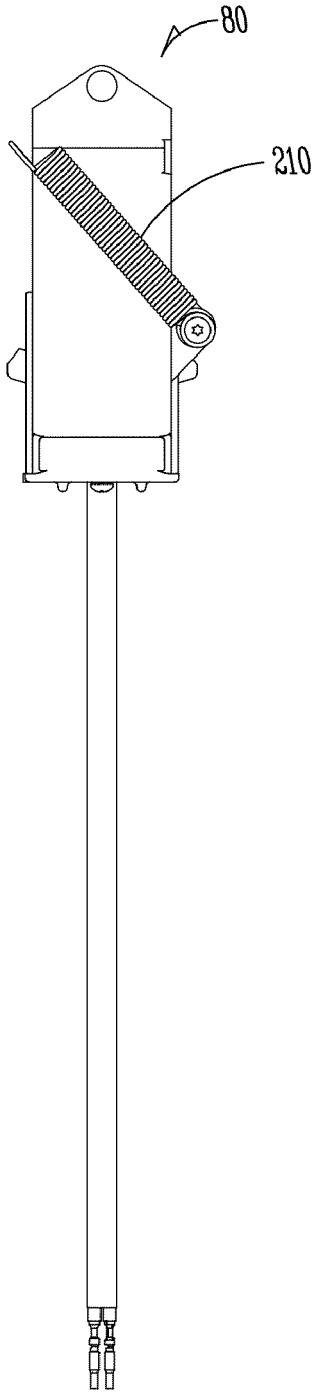
Figure 14D:
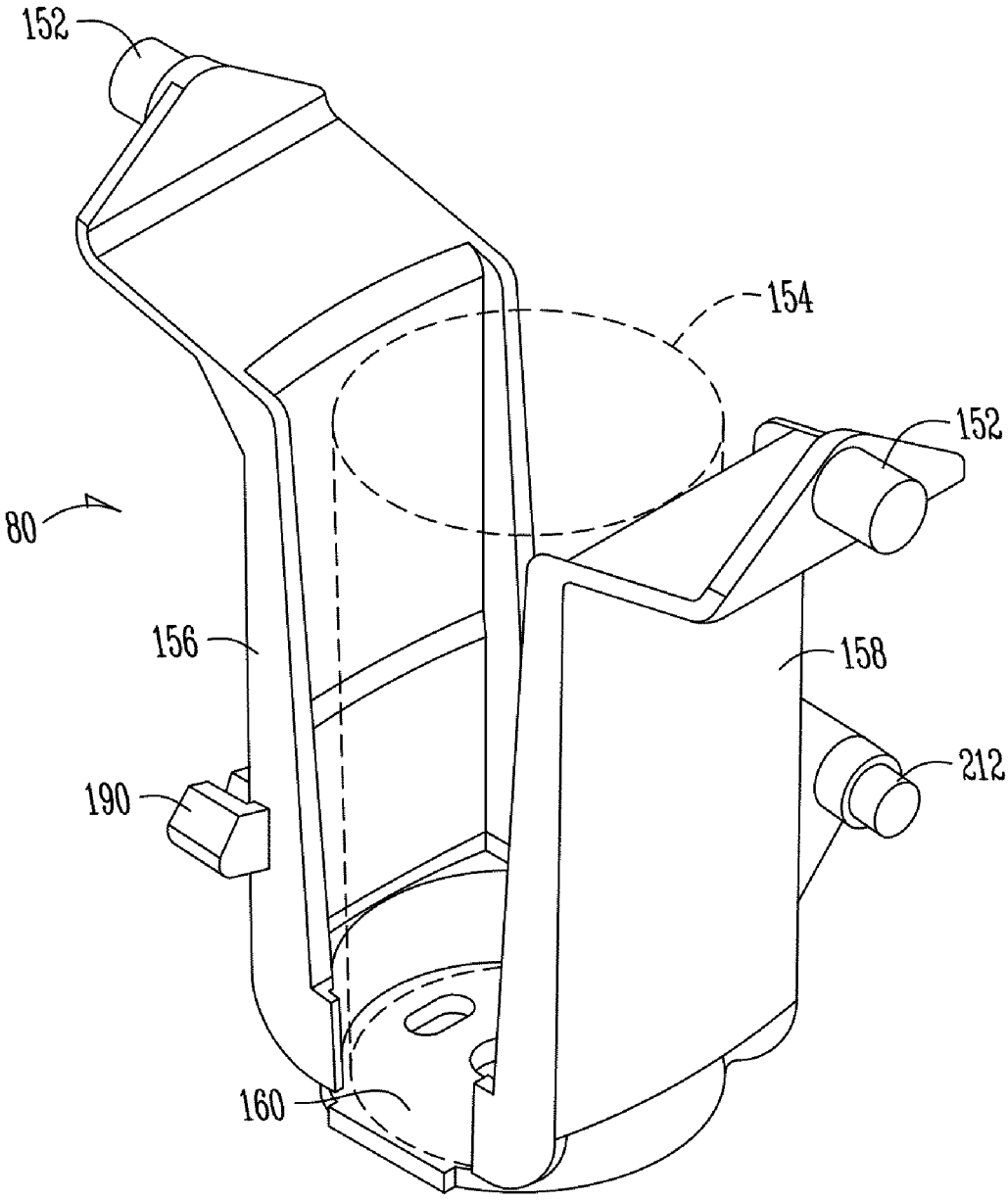
Figure 14E:
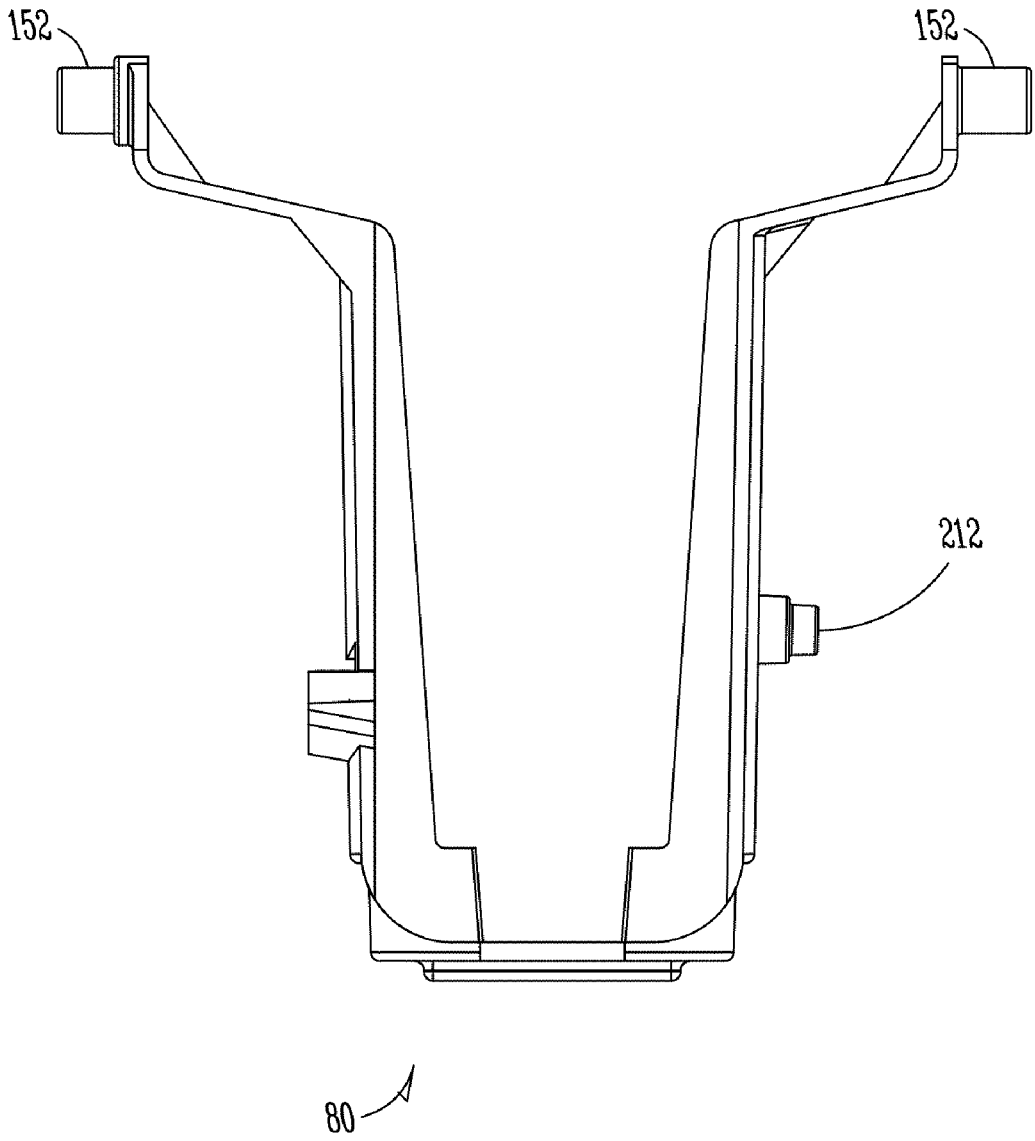
Figure 14F:
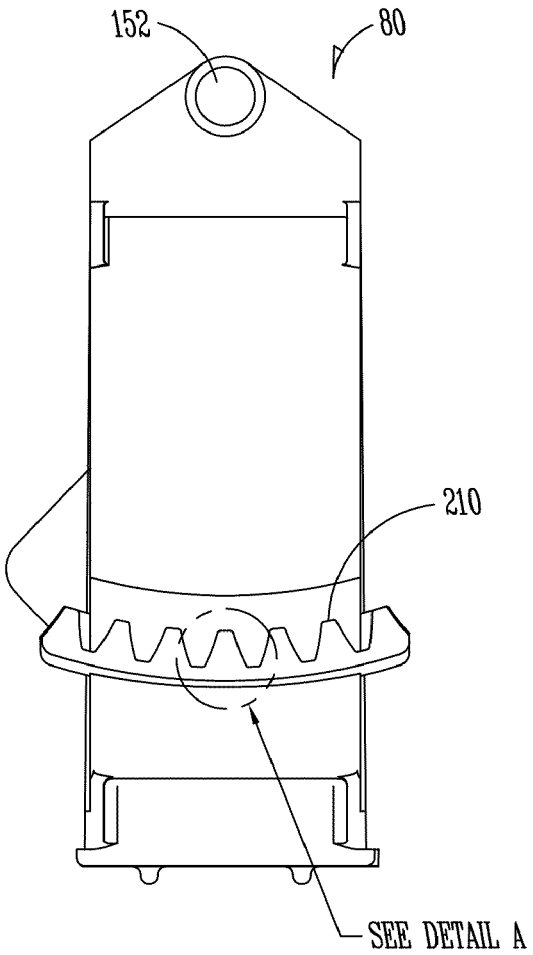

Lamp socket 154 is mounted between arms 156 and 158 of yoke 80 via bolts, screws or other means through the back end 160 of yoke 80. Yoke 80 therefore can pivot around an axis 140 defined by receivers 134 in lamp cone 40. In combination with a setting of gearing, pivotable yoke 80 allows arc tube 12 of arc lamp 20, which is supported by yoke 80, to be maintained in a horizontal position independent of tilt of lamp cone 40. FIGS. 4A-D, along with FIGS. 5A and 14D, illustrate this total tilt factor correction feature of fixture 10.

Pinion gear 202 (FIGS. 8A-D) has a large gear portion 204 spaced parallel from a small gear portion 206 by shaft 208. Shaft 208 is rotatably journaled in opening 138 in the side of lamp cone 40 (offset from the rotational axis of lamp cone 40 relative to knuckle 50). A bushing 203 (plastic sleeve/bushing—FIGS. 9A-E), provides a bearing surface for shaft 208 of gear 202 in opening 138 of lamp cone 40.

Figure 14G:
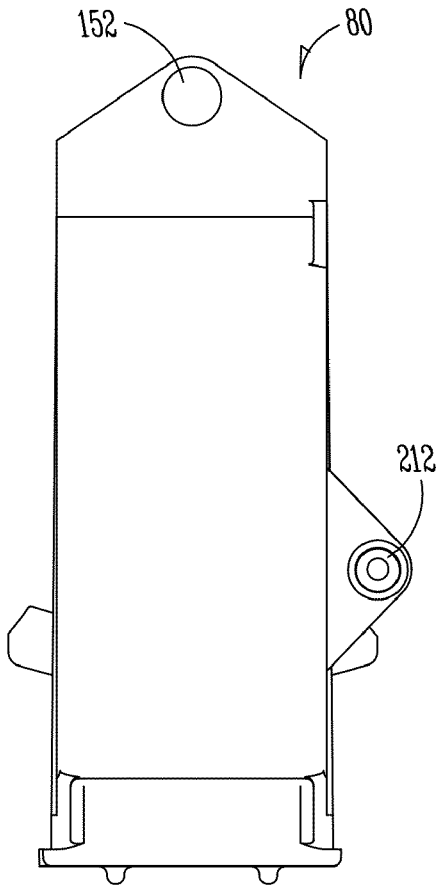
Figure 14H:
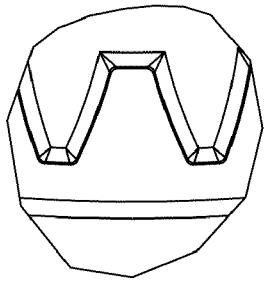
Figure 14I:
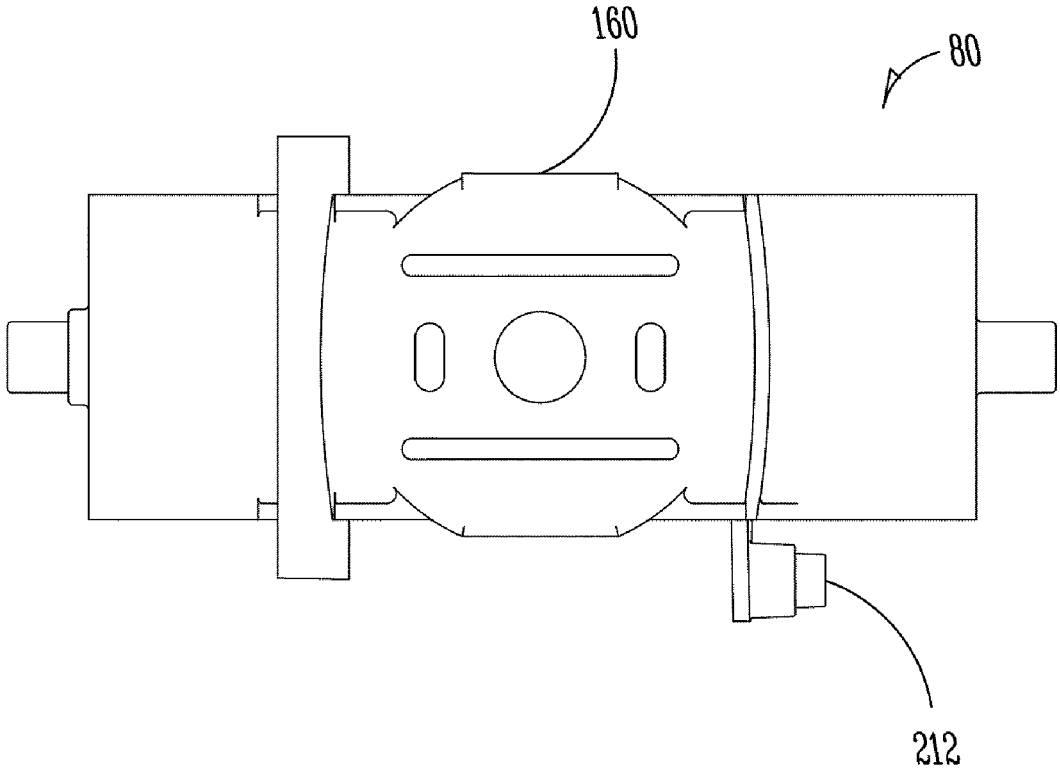
Figure 15A:
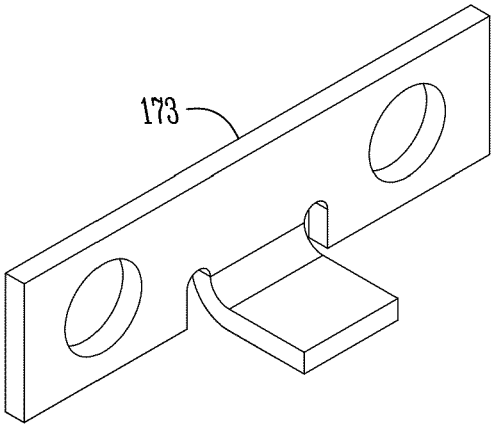
Figure 15B:
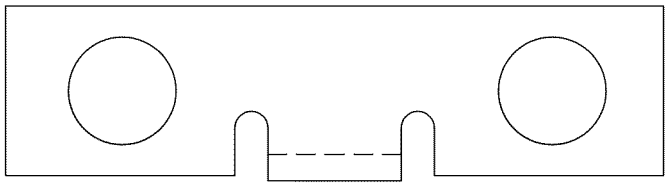
Figure 15C:
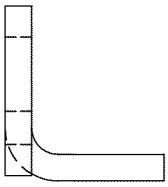
Figure 15D:
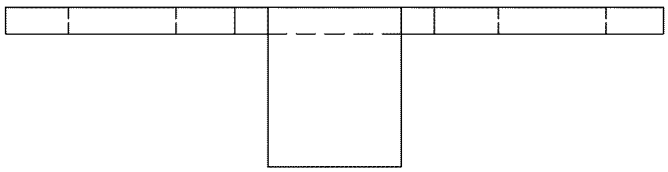

When fixture 10 is assembled, small gear 206 engages gear rack 170 (see FIG. 7G) formed in knuckle 50. Large gear 204, in turn, engages gear rack 190 fixed on one side of yoke 80 (see FIG. 14G). Lamp cone 40 can rotate in a vertical plane around its pivot axis 52 (see FIG. 3) relative to knuckle 50 to allow for different aiming angles for fixture 10 relative the target. Because the front of yoke 80 (at its pivot axis 140) is fixed relative to lamp cone 40, yoke 80 also rotates in a vertical plane when lamp cone 40 does. If yoke 80 were completely fixed relative to lamp cone 40, the longitudinal axis of lamp 20 would also rotate in a vertical plane. However, this would conflict with the preference to operate arc tube 12 in a horizontal plane regardless of aiming angles of the fixture.

Thus, fixture 10 compensates for this as follows. Gear rack 170 is fixed on knuckle 50. Knuckle 50 is attached to knuckle plate 60 and rotational about axis 62 (see FIG. 3), and knuckle plate 60 is fixed relative to cross arm 7; alternatively, knuckle 50 may be fixed relative to cross arm 7 and omit knuckle plate 60 (see FIG. 2C). The gearing and the parts involved with fixture 10 are selected so that pivotal movement of lamp cone 40 around axis 140 causes a proportional pivoting of yoke 80 around its different pivot axis 52. Placement of yoke pivot axis 140 is intentionally chosen to be at or near the front plane of lamp cone 40. When lamp cone 40 is rotated upward, the front of yoke 80 and pinion gear 202 raise with it, but large gear 206, at the same time, lifts the back free end of yoke 80 a proportional amount so that the orientation of lamp 20 and its arc tube 12 remains the same relative to horizontal.

When assembled, longitudinal axis 81 of yoke 80 is aligned or parallel with longitudinal axis 38 of lamp cone 40 (see FIGS. 2C and 4B-D). Thus, when lamp 20 is appropriately mounted on yoke 80, its longitudinal axis would be oblique by the same angle to the longitudinal axes of lamp 20, yoke 80 and lamp cone 40. This is basically a reference position. If lamp cone 40, for example, were tilted 30° down from horizontal relative to cross arm 7 when pole 5 is erected, yoke 80 would also have its longitudinal axis tilted down 30° from horizontal. This would put arc tube 12 in a horizontal plane.

This relationship allows a lamp such as Z-LAMP™ brand 20 (FIGS. 2A-C) to be utilized and operated at a horizontal position, so long as the angular offset of arc tube 12 relative to longitudinal axis 28 of arc lamp 20 is equal to the amount of tilt of lamp cone 40 from horizontal. Thus, if arc tube 12 is tilted 30° to the longitudinal axis of lamp 20 (see, for example, FIG. 2B in which arc tube axis 26 is offset from lamp axis 28), and lamp 20 is rotated into socket 154 of yoke 80 such that the yoke axes and lamp axes are in a vertical plane, arc tube 12 will be horizontal when lamp cone 40 is tilted 30° down from horizontal. As previously described, operation of arc tube 12 at horizontal will correct tilt factor.

However, because not all fixtures will be aimed at 30° down from horizontal, yoke 80 automatically adjusts to maintain the orientation of yoke 80 relative to horizontal for a selected range (e.g. 15° up to 47° down in steps in the plane of knuckle 50) of pivoting of lamp cone 40 on either side of the reference position (e.g., 30° down).

This automatic tilt factor correction is further illustrated at FIGS. 4A-D. If lamp cone 40 is tilted up several degrees from its 30° reference position relative to horizontal, pinion gear 202 will rotate in opening 138 of lamp cone 40 in a counter-clockwise direction as viewed in FIG. 4D. Gear track 170 is fixed with respect to knuckle 50, and with respect to space. The tilting of lamp cone 40 is about its rotational axis 52 (see FIG. 3), which is also stationary in space. The front of lamp cone 40, and thus the front of yoke 80, will move upward in an arc (see reference number 302, FIGS. 4A-D). Pinion gear 202 likewise will move upward in an arc (ref. no. 304). However, the counter-clockwise rotation of pinion gear 202 means large gear 204 will concurrently rotate counter-clockwise. Because large gear 204 is fixed relative to lamp cone 40, the counter-clockwise rotation of large gear 204 will cause gear rack 190 to move in an a still third arc (ref no. 306) inside lamp cone 40 vertically upward separately from the vertical upward movement of lamp cone 40. Thus, the back of yoke 80 will pivot upwardly along with gear track 190 an amount proportional to the amount lamp cone 40 is pivoted upwardly because gear rack 190 is fixed to yoke 80. A similar proportional downward movement of the back of yoke 80 will be automatic when lamp cone 40 is pivoted downward. However, the amount of movement of the back of yoke 80 is less than the amount of movement of lamp cone 40 because the back of yoke 80 is closer to the pivot axis of lamp cone 40.

In this embodiment, the range of tilt up and below horizontal (the arc tube reference position) is approximately +15 to −60°. This covers most conventional sports lighting aiming angles (95% of them at 30° beam and reference axes). It is noted that the guiding factor for operation of the automatic tilt factor correction is the pivot location of yoke 80. It works as described because it is basically in the same plane as the junction between lamp cone 40 and reflector frame 30. It would be more difficult to get precise correction if the yoke was pivoted to lamp cone 40 nearer the back of lamp cone 40. While some change between the position of arc lamp 12 and reflecting surfaces 72 of fixture 10 occurs, it is relatively small. Thus minor re-aiming, if any, is needed.

The gear ratios (large and small gears 204 and 206 have the same number of teeth) are carefully selected such that there will be precise compensation for any upward or downward tilting of lamp cone 40 to maintain the same downward angular orientation of yoke 80. In other words, despite yoke 80 being attached to, and moving with lamp cone 40 when it is pivoted away from its reference position, the gearing causes yoke 80 to pivot to maintain the same orientation relative to horizontal. Because lamp cone 40 pivots about a different axis than yoke 80, selection of the gearing is critical to cause the right proportional movement of yoke 80. Although the actual physical position of yoke 80 relative to lamp cone 40 will change somewhat, the orientation of yoke 80 stays parallel to its reference position. This will allow arc tube 12 of Z-LAMP™ brand lamp 20 to stay horizontal regardless of whether lamp cone 40 is in the reference position or some degree off of the reference position (within the range of the gearing).

Figure 10A:
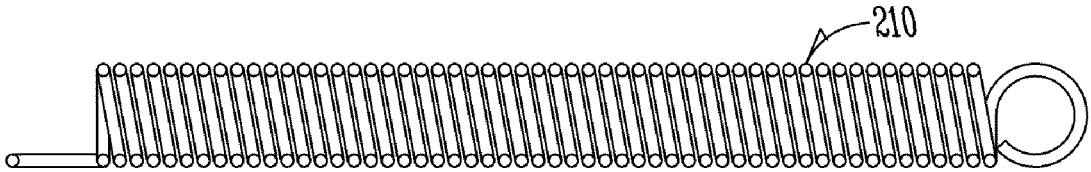
Figure 10B:
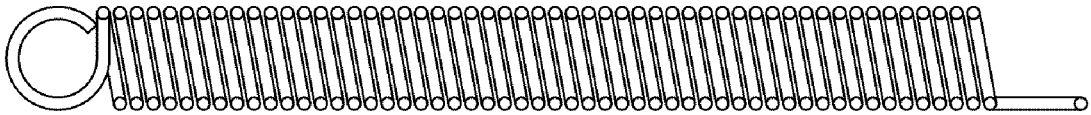
Figure 11A:
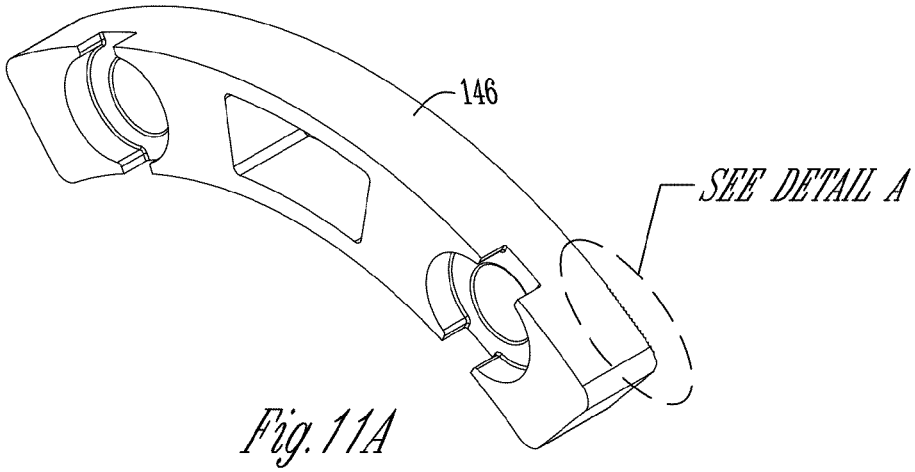
Figure 11B:
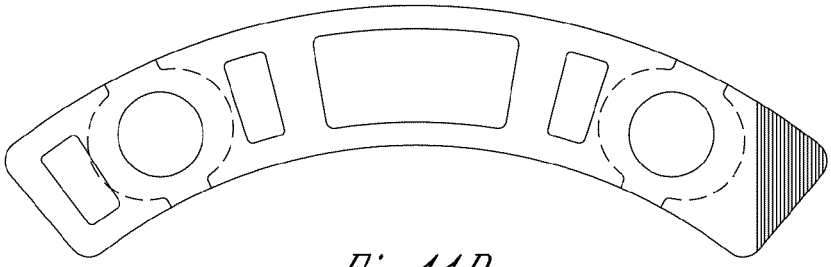
Figure 11C:
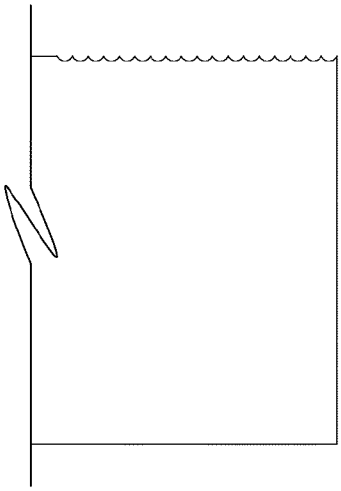
Figure 12A:
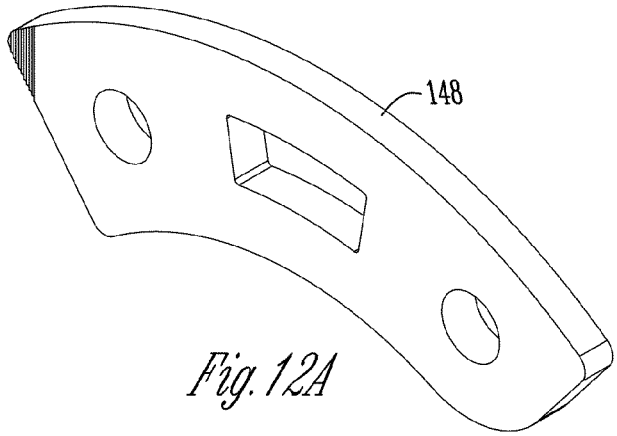
Figure 12B:
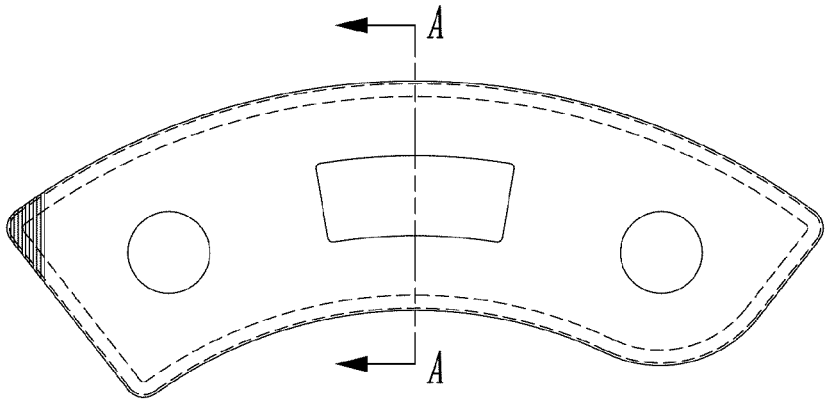
Figure 12C:
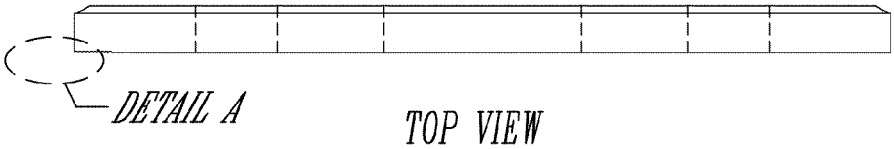
Figure 12D:
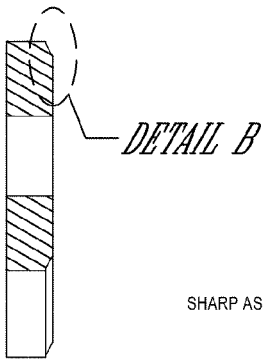
Figure 12E:
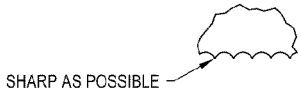
Figure 12F:
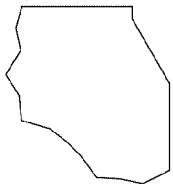
Figure 13A:
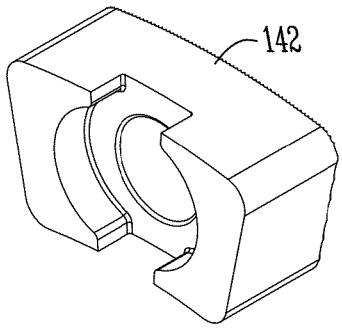
Figure 13B:
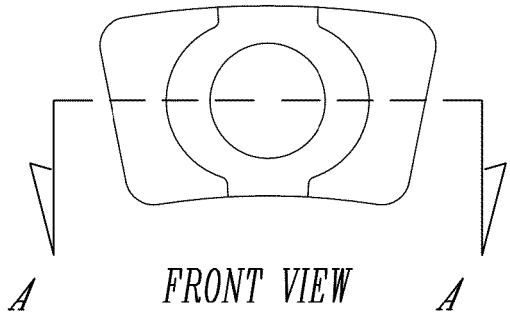
Figure 13C:
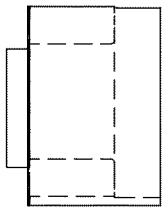
Figure 13D:
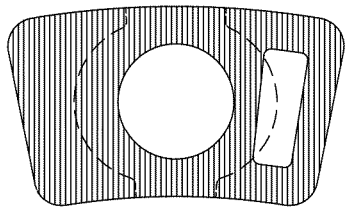
Figure 13E:
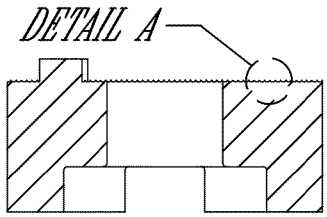
Figure 13F:
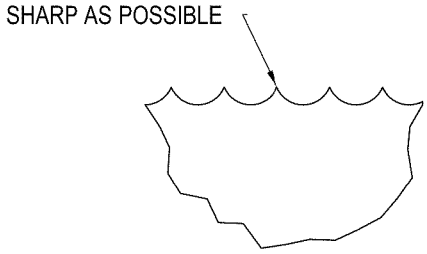

To provide against play and to inject a biasing force relative to yoke 80, an extension spring 210 (see FIGS. 10A-B), attaches between post 212 of yoke 80 and post 214 at the front of lamp cone 40. The spring is selected to maintain a suitable biasing force. It essentially pre-loads the gearing so there is not play in the gears or backlash. This increases the accuracy of the aiming. When maintenance on lamp 10 is performed, spring 120 can be easily disengaged by pulling it off of post 214. The pitch diameter of the last few teeth on large gear 204 are cut off slightly greater than the pitch diameter of the other teeth. This makes that combination less sensitive to reengagement.

Figure 7A:
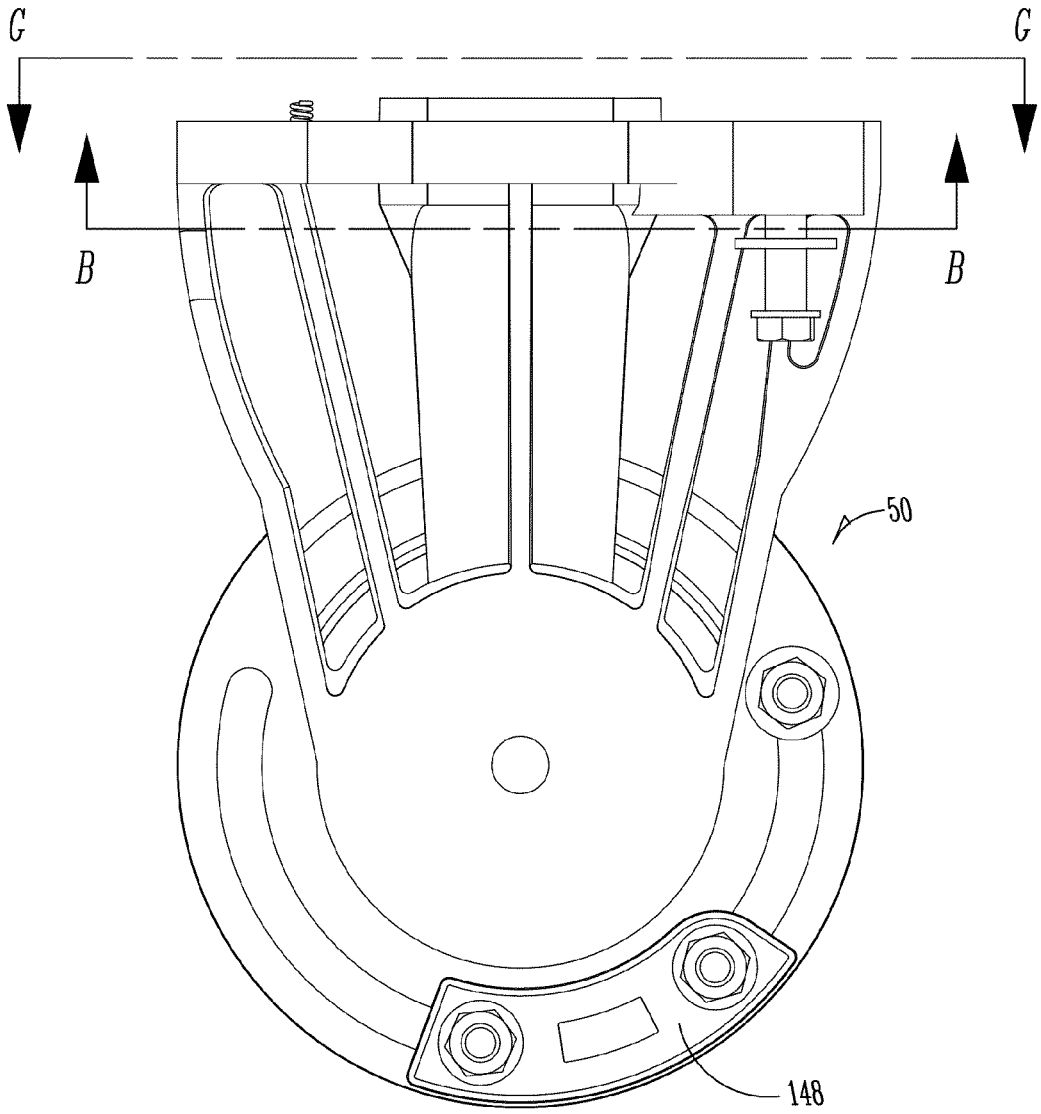
Figure 7B:
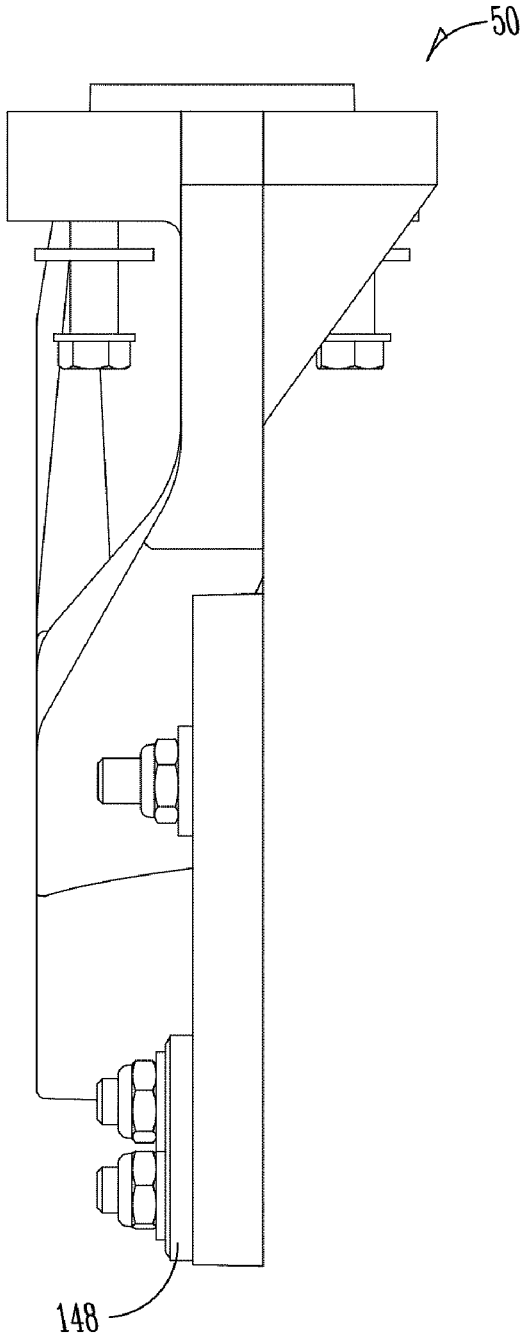
Figure 7C:
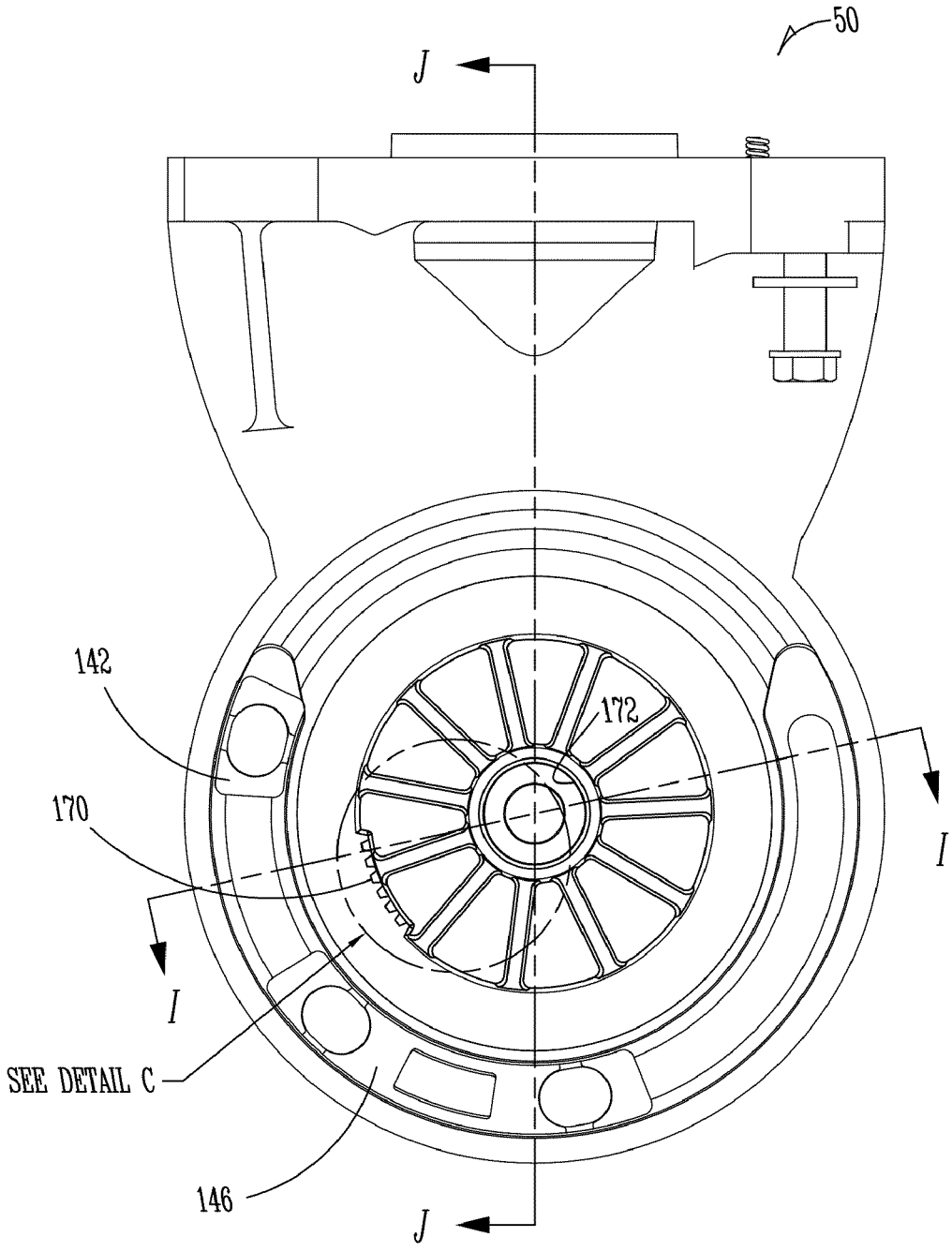
Figure 7E:
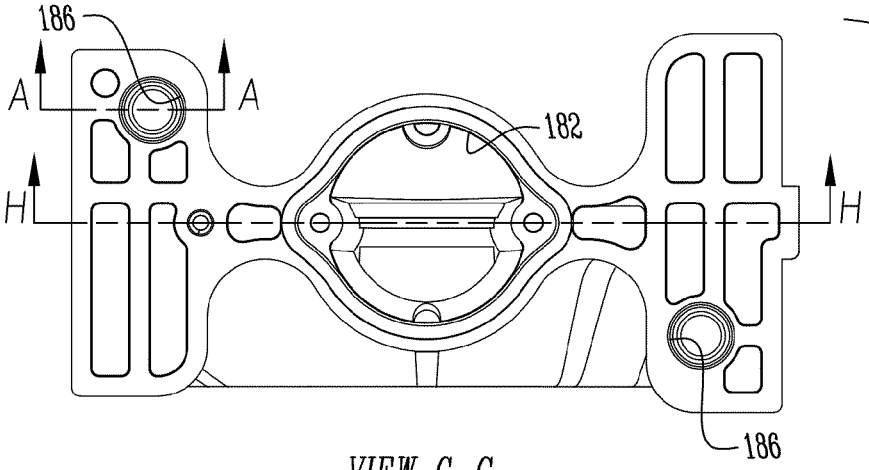
Figure 7E:
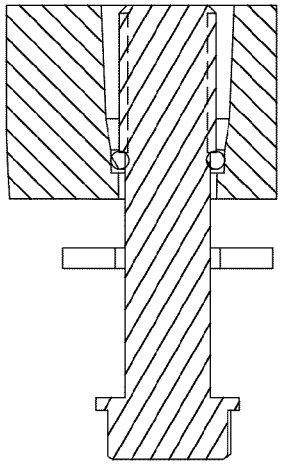
Figure 7F:
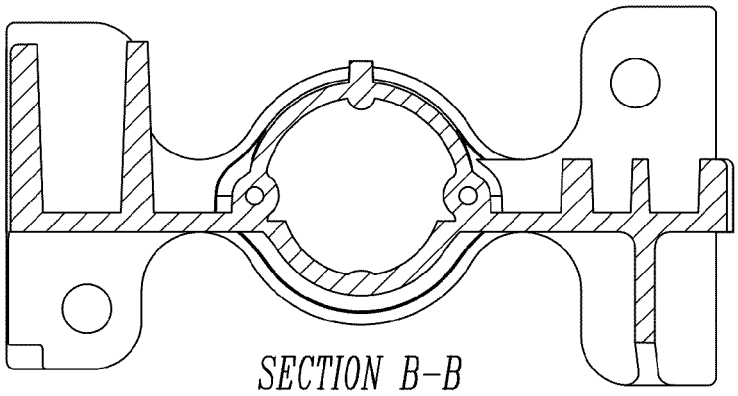
Figure 7G:
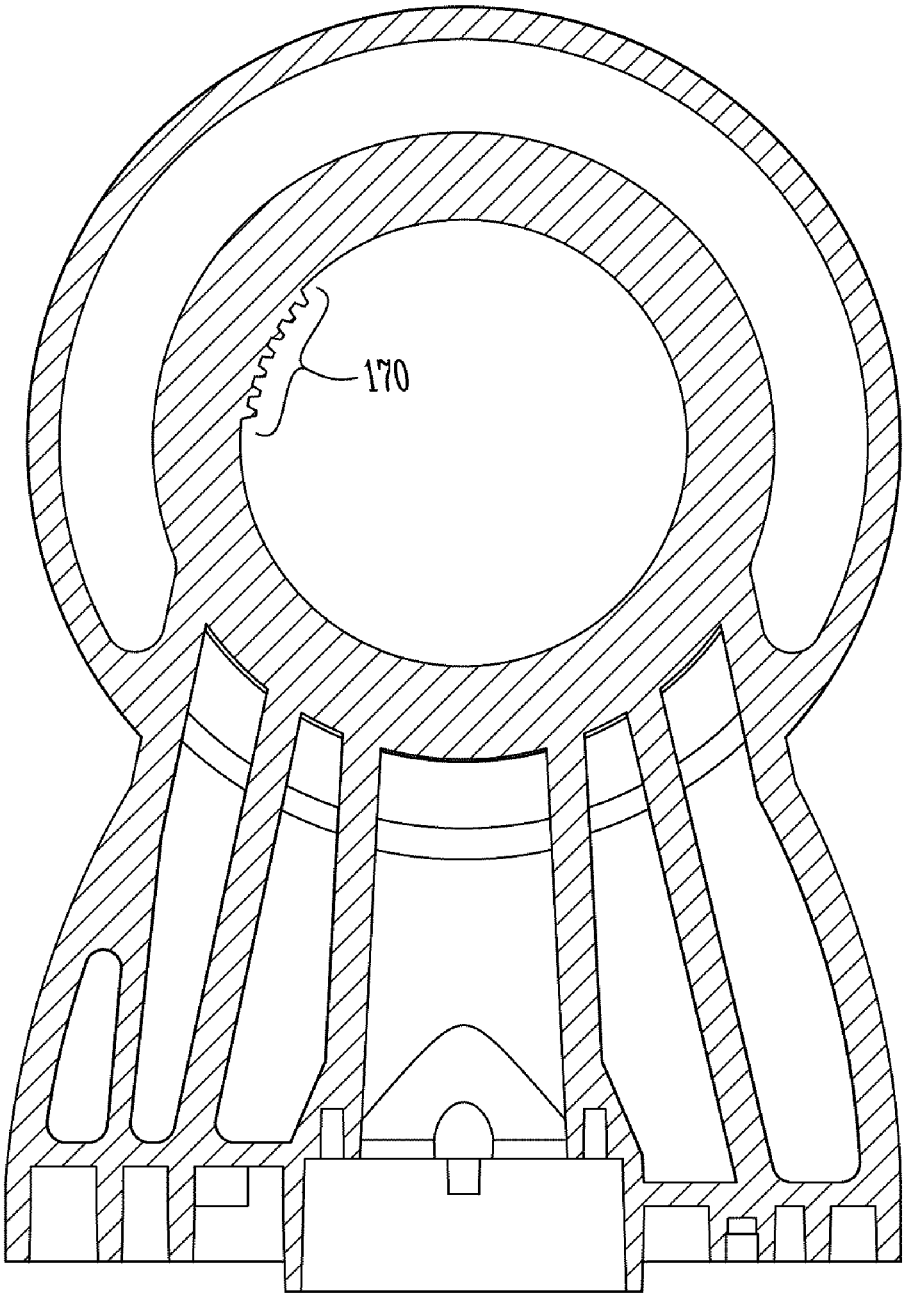
Figure 7I:
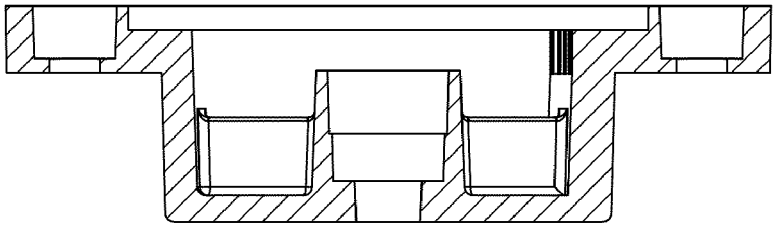
Figure 7J:
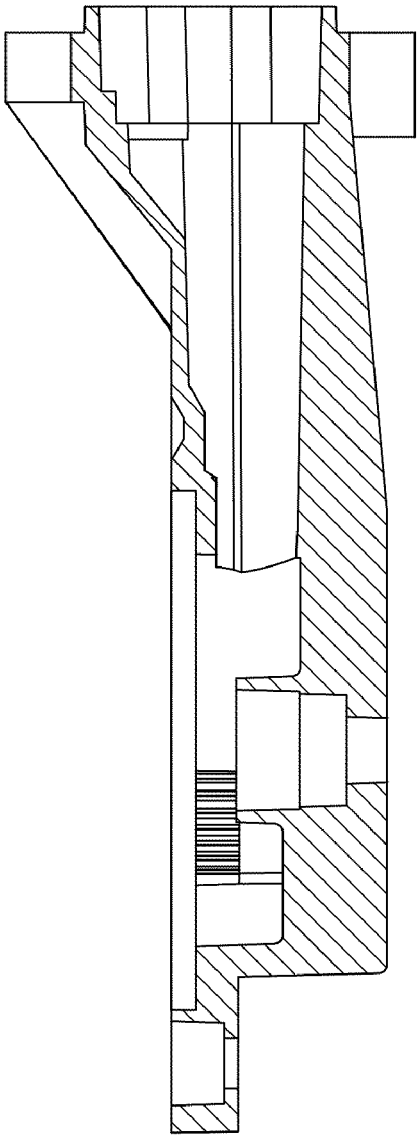
Figure 7H:
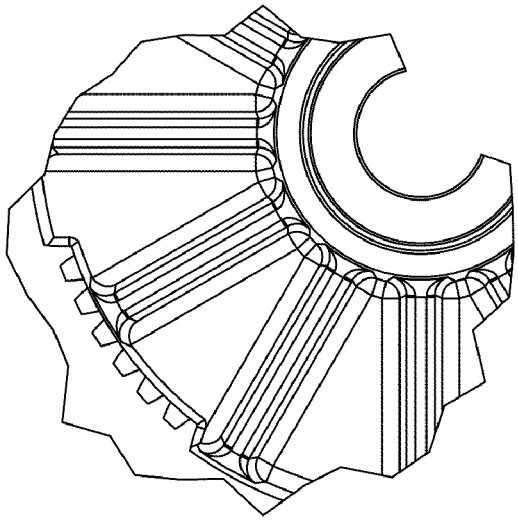
Figure 8A:
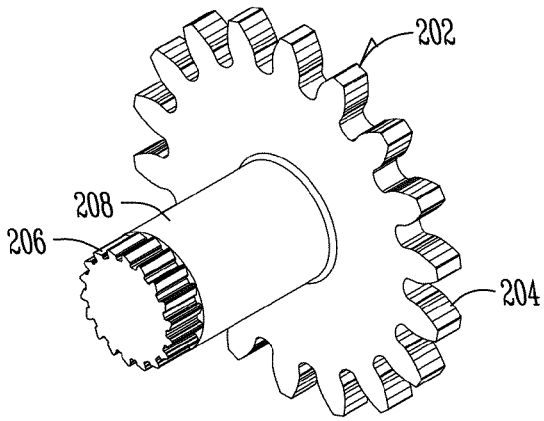
Figure 8B:
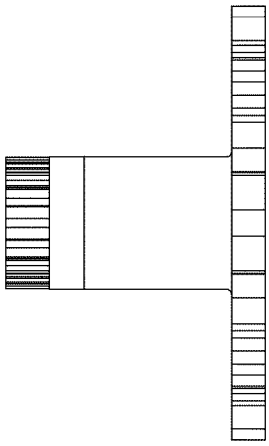
Figure 8C:
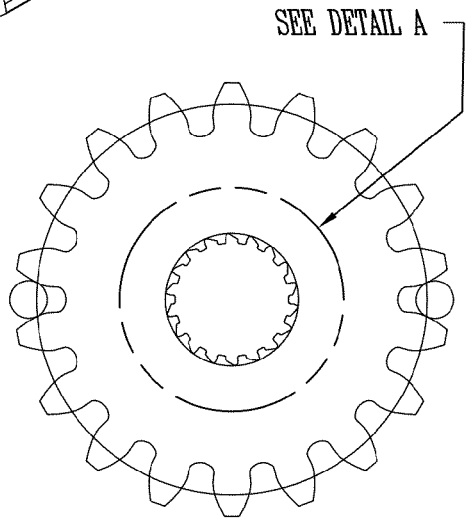
Figure 8D:
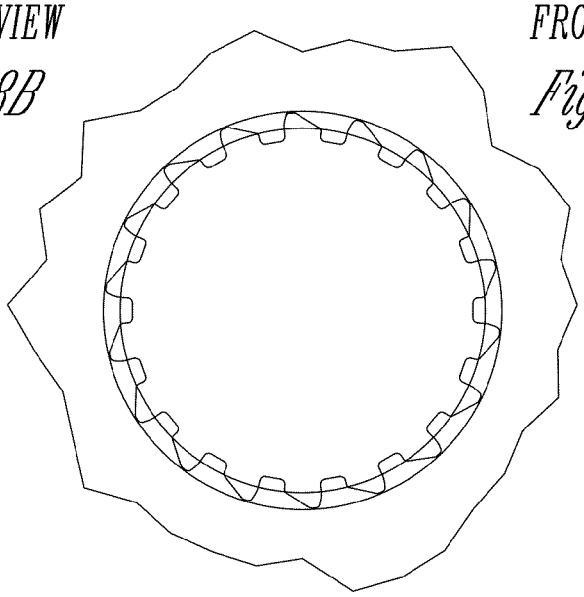
Figure 9A:
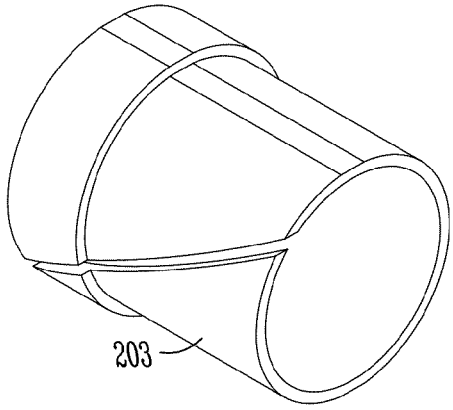
Figure 9B:
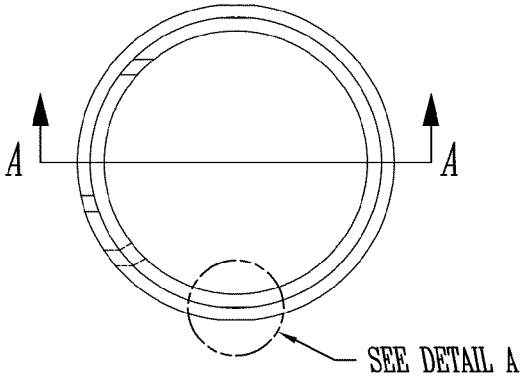
Figure 9C:
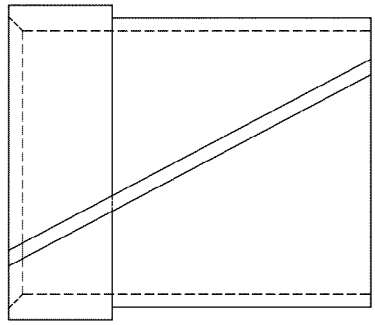
Figure 9D:
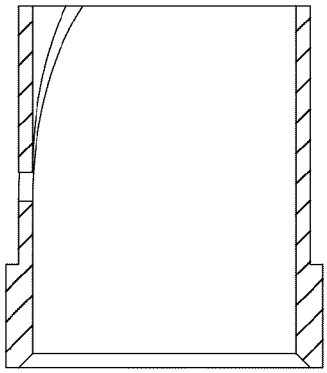
Figure 9E:
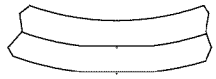

FIGS. 11A-C, 12A-F, and 13A-F show what is called straps and an end stop that can be clamped along the curved slot in knuckle 50 (see FIGS. 7A-C). A projection from the side of cone 40 extends into that curved slot when cone 40 is pivotally connected to knuckle 50 by bolt 174. The angular orientation of cone 40 relative knuckle 50 can therefore be set by where strap pair 146, 148 is clamped in position (as a lower end stop), and where end stop 142 is positioned and clamped in place (as an upper end stop). This combination provides more holding power to withstand torque forces than just relying on the tightening of bolt 174. The straps and end stop can have structure that allow them to be clamped in place along the curved channel by tightening of bolts. Additionally, it allows for relatively easy release of the position for cone 40. Two bolts on the straps for the bottom end stop can simply be released and that end strap pair slid away. This would allow, for example, a maintenance crew to go up and work on a fixture. The lower end stop straps could be released and the fixture tilted down to hang vertically while they worked on it. By leaving the upper end stop clamped into position, when finished, the workers just pivot the lamp and cone 40 back until into abutment with the upper end stop, slide the lower end stop strap pair into abutment with the projection or boss from the end that is in the slot, and retighten the screws. The original aiming of the fixture is therefore retained. It avoids having to do any re-aiming or calibrations.

As discussed above, one feature of the invention is maintaining an orientation of the lamp relative to some reference position substantially independent of the pivoting of the cone 40. As can be appreciated, the exemplary embodiment does this with the multiple pivot axes and gearing. This arrangement, however, while maintaining its substantially consistent orientation of the lamp with some external reference plane does cause slight movement of the lamp relative to the reflector that is attached to cone 40. This can slightly alter the beam pattern from the fixture. For example, if cone 40 is tilted upwardly approximately 15° from a 30° down position, not only would the reflector connected to the cone tilt up 15°, the repositioning of the lamp inside the reflector would cause a beam shift an additional approximately 7½ more degrees up. Being aware of this, and compensating for this, is sometimes required. However, because of fairly known proportionalities once a configuration is selected, this can be built into the design of the system. It actually can be advantageous in that even though there might be some physical limit of how far up or down cone 40 can be adjusted (for example because of physical limitations in the structure of the fixture or for that matter, practical limitations), the beam shift created by that adjustment is proportionally more, thus giving a wider range of potential adjustments.

Further discussion of benefits of the total tilt factor correction structure and options for it can be found in the patents incorporated by reference herein.

It will be appreciated that the foregoing exemplary embodiment is given by way of example only and not by way of limitation. Variations obvious to those skilled in the art will be included in the invention. The scope of the invention is defined solely by the claims.

Utilization of the Musco Z-LAMP™ brand lamp is not necessarily required. By appropriate modification, a standard arc lamp could be utilized.

It will be appreciated that the combination of components shown in the figures is but one way in which adjustability between a mount for the fixture to a cross arm, and the fixture can be accomplished. The figures illustrate how, in the exemplary embodiment, an integration of the gearing and the adjustable yoke allows for compensation and maintenance of an orientation of the arc lamp regardless of orientation vertically of the cone in which the yoke is contained (over a reasonable range). The drawings are intended to show to one skilled in the art one combination. The general concept is to have some compensation or mechanism for the function and result of maintaining a certain orientation of the lamp.

B. Exemplary Embodiment of Light Fixture with Manually Activatable Lamp Adjustment 1. Lighting Fixture 10 Generally FIG. 16 shows the basic components of sports lighting fixture 10 in partially exploded form with lamp adjustment by manual activation.

Figure 16:
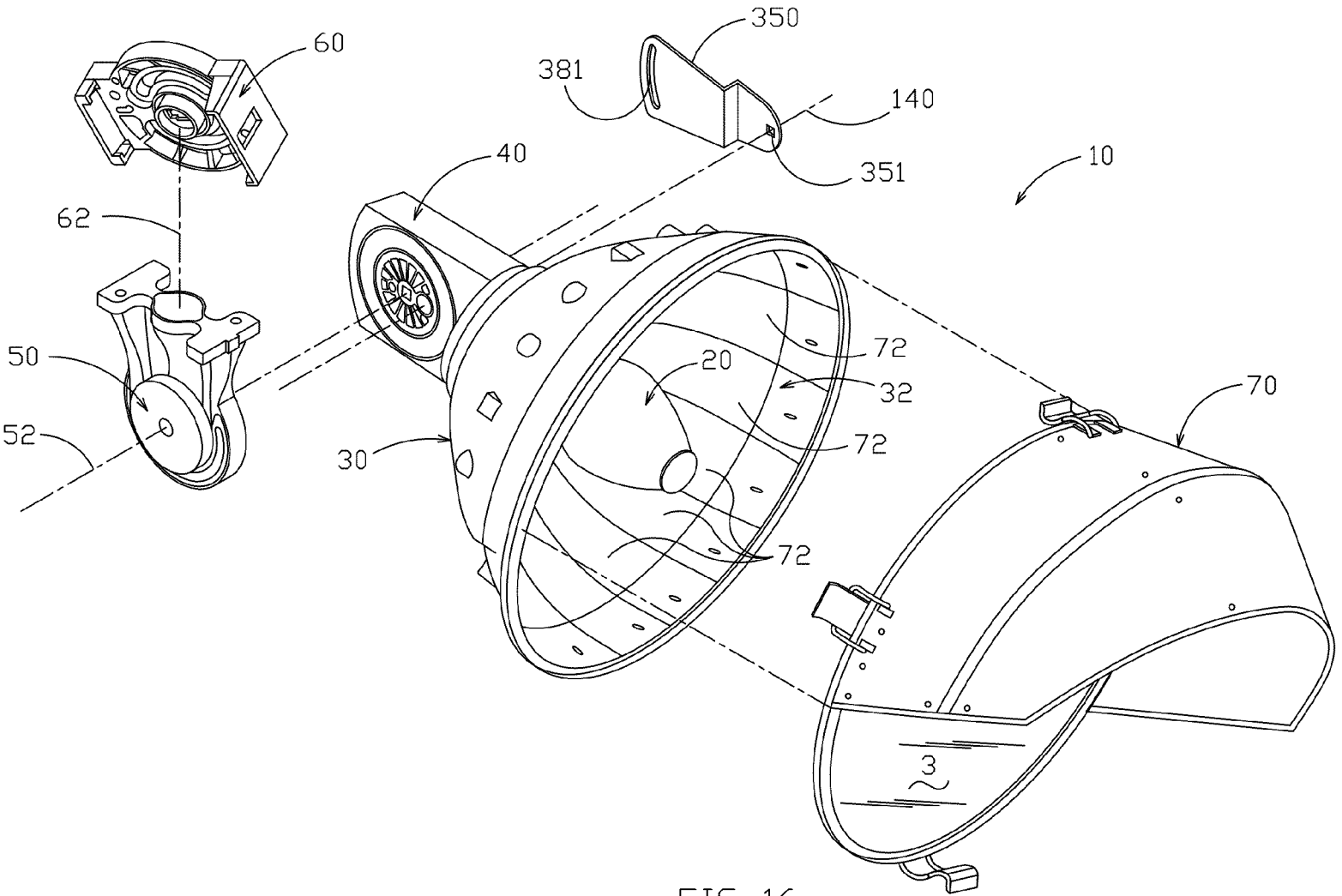
FIG. 16 is a partial exploded perspective view of an embodiment of a light fixture with a manually actuatable lamp adjustment mechanism.

Lamp cone 40 (360 Aluminum with polyester powder coat) pivots around axis 52 relative to knuckle 50, which pivots around axis 62 relative to knuckle plate 60 which is fixed to cross arm 7 (see FIGS. 3 and 7D4); alternatively, knuckle 50 may be fixed to cross arm 7 directly (see FIG. 16). Lamp cone 40 contains a socket 154 (shown diagrammatically in FIG. 17, commercially available) which is bolted or otherwise mounted to flat web 160 between arms 156 and 158 of yoke 80. Lamp 20 (e.g., Musco Corporation Z-LAMP™ brand lamp—see FIGS. 2A-C) has a threaded base 24 that can be screwed in and out of socket 154 (shown screwed into operating position in FIG. 16) to install or removed lamp 20 from fixture 10 which may further comprise a reflector frame 30 (which may house individual reflector components 72), a visor system 70, and a lens 3.

2. Lamp 20

Arc lamp 20 is of the general type disclosed in Musco Corporation U.S. Pat. No. 5,856,721, incorporated by reference herein, with certain modifications. These types of lamps are used by Musco Corporation under the trademark Z-LAMP™ brand lamps and typically are 1000 watt or greater metal halide (MH) HID lamps. Its arc tube 12, housed in lamp envelope 22, is tilted, e.g., obliquely along axis 26 across longitudinal axis 28 of arc lamp 20. In operation, arc tube 12 is rotationally positioned in socket 154 of fixture 10 such that the longitudinal axis of arc tube 12 is as close to a horizontal plane as possible.

3. Yoke 80

Yoke 80 is pivotally supported at the front of lamp cone 40 at pivot axis 140 (see 18E). Pivot pins 152 of lamp yoke 80 (see FIGS. 14B and 17—and described in more detail below) slide longitudinally into mating receivers 134 (which define pivot axis 140) on opposite sides of opening 132 to lamp cone 40 and are retained in place by yoke retainers 173 (FIGS. 15A-D) by machine screws 175 in the pair of threaded bores on opposite sides of receivers 134 (see FIGS. 5C and 5J7, respectively).

Lamp socket 154 is mounted between arms 156 and 158 of yoke 80 via bolts, screws or other means through the back end 160 of yoke 80. Yoke 80 therefore can pivot on round-in-cross-section pin portions 152 of yoke 80 around an axis 140 (see FIG. 18E). The pivotable yoke 80 allows arc tube 12 of arc lamp 20, which is supported by yoke 80, to be maintained in a horizontal position independent (or other selected position) of tile of lamp cone 40. FIGS. 18A, 19, 20, and 21A, illustrate what is sometimes referred to as a total tilt factor correction feature of fixture 10.

Lamp cone 40 can rotate in a vertical plane around its pivot axis 52 relative to knuckle 50 (see FIG. 16) to allow for different aiming angles for fixture 10 relative the target. Typically the central axis out of the open front of cone 40 is between 15°-45° down from horizontal. Because the front of yoke 80 is fixed (by holding yoke pins 152 in receivers 134 in cone 40 along pivot axis 140) relative to lamp cone 40, the front of yoke 80 also rotates in a vertical plane when lamp cone 40 does so (around axis 52). If yoke 80 were completely fixed relative to lamp cone 40 (e.g. front to back), the longitudinal axis of lamp 20 would also rotate in a vertical plane in kind with cone 40. However, this would conflict with the preference to operate arc tube 12 in a horizontal plane regardless of aiming angle of the fixture.

For example, in FIG. 18A, lamp 20 has arc tube 12 with an axis 26 30° offset or tilted relative to the main axis 28 of lamp 20. When cone 40 is pivoted 30° down from horizontal around pivot axis 52 (a common aiming angle for sports lighting fixtures) and adjustment arm 350 is locked at "0" on gauge 362 (meaning the central axis of lamp 20 is co-extensive with the central axis of cone 40), arc tube 12 is horizontal. However, if cone 40 where pivoted around axis 52 either up or down, if lamp 20 remained locked in the position of FIG. 18A, the new position of cone 40 would pivot lamp 20 in kind and arc tube 12 would move out of horizontal.

Thus, fixture 10 compensates for this as follows. Yoke 80 is attached to the adjustment lever 350 (see FIGS. 16 and 18A-E). The adjustment lever 350 is moved as yoke 80 rotates about the pivot axis 140.

Figure 17:
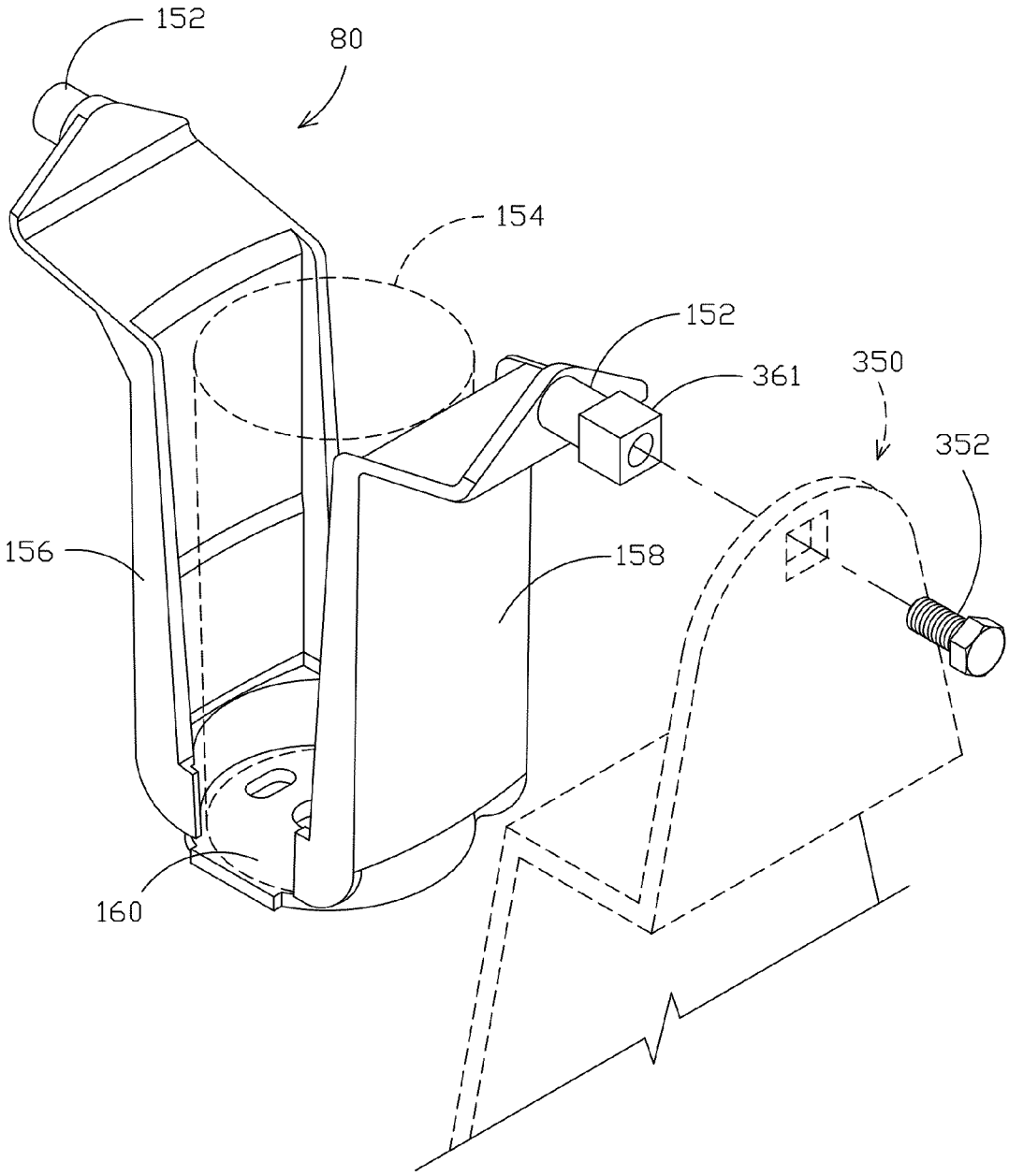
FIG. 17 is an enlarged perspective of a lamp yoke used with the embodiment of FIG. 16.

This happens because of the following structural relationship. As shown in FIG. 17, a square-in-cross-section portion 361 extends from round-in-cross-section pin 152 on one side of yoke 80. The front end of adjustment arm 350 (FIGS. 18C and D) has a square aperture 351 that is complementary to square-in-cross-section portion 361. When arm 350 is assembled in operative position (see FIG. 18B), square aperture 351 is slid over the distal end of square portion 361, which is exposed through an opening in the side of cone 40 along axis 140 (see FIG. 18E). A screw or fastener 352 holds arm 350 so that square aperture 351 is always aligned with square portion 361 of yoke 80. Thus, any rotation of arm 350 around axis 140 causes yoke 80 to rotate in kind around axis 140 (or vice versa).

Following is a description of how this structure can be used.

The other end of arm 350 has an arcuate slot 381 positioned so that it is in alignment with a threaded aperture 382 in cone 40 (see FIGS. 18B and 18E) over the range of slot 381 when arm 350 is pivoted around axis 140. A screw or bolt 380 is complementary with threaded aperture 382. When tightened, bolt 380 fixes arm 350 against pivoting.

By the foregoing structure, lamp yoke 80 can be pivotally adjusted relative to cone 40 by loosening bolt 380, rotating back end of arm 350 up or down (if allowed by the range of slot 381) and then re-tightening bolt 380 to clamp arm 350 in place. This range of movement of the back end of arm 350 allows a commensurate range of movement of yoke 80, and thus any lamp 20 operatively mounted in yoke 80.

The angle to adjust yoke 80 depends on the aiming angle of lamp cone 40, and the orientation of arc tube 12 inside the lamp 20. An angular scale 362 (see FIG. 18A) is printed or engraved on the outer side of the lamp cone 40 to determine the appropriate angle to adjust the yoke orientation. A corresponding angular indicator 363 (FIG. 18A) is engraved or otherwise marked on adjustment arm 350 (see FIG. 18C).

Consider FIG. 18A, for example. If it is desired to rotate cone 40 30° down from horizontal (60° from nadir) around pivot axis 52 associated with mounting elbow 50, to maintain arc tube 12 of lamp 20 horizontal (where arc tube is manufactured to be tilted 30° up from the lamp 20 axis), bolt 380 would be loosened and the back end of arm 350 moved to the position shown in FIG. 18A. Arm 350 and this yoke 80 would be generally aligned with the center axis of cone 40. The downward 30° aiming of cone 40 would be compensated for by the 30° up tilt of arc tube 12 in lamp 20. Lamp 20 can then be operated with arc tube 12 in horizontal position, which can be desirable for reasons previously mentioned. In FIG. 18A, gauge 362 is selected to call this position the "0" position.

Compare FIG. 18A to FIGS. 19 and 20. If cone 40 is aimed 20° down from horizontal (FIG. 19) instead of 30° down (FIG. 18A), and arm 350 is left locked at the "0" position of FIG. 18A, lamp 20 would likewise be only 20° down from horizontal (70° up from nadir). This would result in arc tube 12 being tilted 10° up from horizontal. To compensate for this, a worker can loosen bolt 380 and pivot the back end of arm 350 up until mark 363 on arm 350 aligns with the "10" above "0" in gauge 362. This would rotate yoke 80 and lamp 20 down 10° relative to pivot axis 140 and bring arc tube 12 to horizontal.

On the other hand, if cone 40 is aimed 45° down from horizontal (FIG. 20) (or 45° up from nadir), leaving yoke 80 locked into "0" position of arm 350 would result in arc tube 12 being tilted down 15° too far (relative to horizontal). To compensate, bolt 380 would be loosened and the back end of the arm 350 pushed down until mark 363 on arm 350 aligns with "15" below "0" on gauge 362. Bolt 380 would be tightened and arc tube 12 would be in horizontal position. After yoke 80 has been positioned properly, adjustment arm 350 is secured to prevent any further movement (see FIGS. 18A, 18B, 18E). This is done by tightening a washer head bolt 380 through a radial slot 381 in the adjustment arm 350 (FIG. 18A) and into a threaded hole 382 in the lamp cone 40 (FIG. 18B).

Rather than or in addition to using an angular scale, another method to maintain arc tube's 12 horizontal orientation is with a level (as shown in FIGS. 21A and 21B). A sheet metal clip 370 is temporarily mounted to the adjustment lever 350. The clip 370 is manufactured such that what will be called its main surface 371 is parallel to arc tube 12 of lamp 20. A small bubble level 375 is attached to the main surface 371 of clip 370, such that level 375 is parallel to arc tube 12 of lamp 20. The yoke 80 orientation can be adjusted by means of the adjustment lever 350 until arc tube 12 is horizontal, as shown by level 375. This method may be used after the fixture is installed, or oriented in its installed position while doing factory aiming. After the adjustment is completed, sheet metal clip 370 and level 375 may be removed from lamp cone 40.

In addition to the methods described above, yoke 80 can be positioned in the factory (as shown in FIG. 22) by means of a tool 400 (see FIGS. 23A and B) inserted through the face of lamp cone 40. The large end 401 of tool 400 would insert into the mogul 154 mounted on the yoke 80. End 401 can essentially be a singulated base of a layer (but unthreaded and snugly fit into socket 154). It would have a cylindrical shape that would snugly slide into socket 154. The plate 402 mounted along elongated rod 404 of the tool would mount flush on the front face of the lamp cone 40. An angular scale 403 can be engraved or otherwise printed on the face of the tool 400. The adjustment arm 404 of the tool 400 would have a corresponding angle indicator mark 405. The arm 404 would be adjusted to the proper angle utilizing the scale 403 printed on the face of the tool 400. The proper angle of the yoke 40 would be determined from the preset aiming angle of the light fixture.

Plate 402 is circular (see FIG. 23B), having a perimeter that fits into and/or against the open face of cone 40. It can be attached temporarily perpendicular to the central axis of cone 40 by screws or bolts (not shown) through holes 411 in plate 405.

Rod 404 pivots around axis 410 defined by cross bar 406, which is journaled through openings in parallel arms 408 extending from plate 402 (see FIG. 23A). Rod 404 extends through an aperture in cross bar 406. When assembled, the end of rod 404 opposite large end 401 extends through slot 412 in plate 402.

With these features, tool 400 can be used to measure the position of yoke 80 relative the central axis of cone 40. When end 401 is fit into socket 124 on yoke 80 and plate 402 is mounted on the face of cone 40 (essentially perpendicular to the central cone axis), the pointer 405 along rod 404 would indicate whether yoke 80 is aligned with the cone axis (e.g. when pointer 405 would be at "0" on gauge 403).

If yoke 80 is at a different orientation, or if it is desired to pivot yoke 80 in cone 40 to a specific angle other than the alignment of FIG. 23B, any fastener or hardware holding yoke 80 in that pivotal orientation would be loosened or released and the end of rod 404 opposite to end 401 is pushed up or down in the desired direction. Gauge 403 would indicate the number of degrees of rotation of yoke 80 relative to the central axis of cone 40 away from the "0" position. When the desired new position is achieved (within +/−15° from "0"), the appropriate hardware would be tightened or otherwise configured to lock yoke 80 in that new position.

As can be appreciated, gauge 403 could be used easily as a compensation tool. For example, if a lamp with an arc tube 12 at 30° tilt (like FIG. 18A) is to be used with the embodiment of FIG. 22, and cone 40 is to be aimed 33° down from horizontal, tool 400 could be inserted in operative position, as described above, on cone 40, and rod 404 lifted until pointer 405 is aligned with "3" above "0" on gauge 403. Yoke 80 could then be locked there and when tool 400 is removed from cone 40 and lamp 20 with 30° tilted arc lamp 12 correctly inserted, arc tube 12 would end up at horizontal.

By further example, if cone is to be at 23° down from horizontal, with a 30° tilted arc tube 12, tool 400 would be temporarily installed on cone 40 (without lamp), rod 404 pushed down until pointer 405 points to "7" below "0", and cone 40 locked in place. When lamp 20 is properly inserted (the axis of arc tube 12 is in a vertical plane through the axis of lamp 20), the axis of arc tube 12 would also be in a horizontal plane (even though the cone axis is 23° down from horizontal).

After the yoke 80 has been positioned properly, yoke 80 is secured by tightening the bolts 175 and clips 173 that clamp the pivot pins 152 of the yoke 80 thus preventing it from rotating. The tool 400 is removed after the bolts 175 are tightened.

When assembled, the longitudinal axis of yoke 80 is aligned or parallel with the longitudinal axis of lamp cone 40. Thus, when lamp 20 is appropriately mounted on yoke 80, axis 26 would be oblique by the same angle to the longitudinal axes of lamp 20 (see reference no. 28), yoke 80 and lamp cone 40; see FIG. 18A. This is basically a reference position. If lamp cone 40, for example, were tilted 30° down from horizontal relative to cross arm 7 when pole 5 is erected, yoke 80 would also have its longitudinal axis tilted down 30° from horizontal. This would put arc tube 12 in a horizontal plane.

This relationship allows a lamp such as Musco Z-LAMP™ brand lamp 20 (FIGS. 2A-C) to be utilized and operated at a horizontal position, so long as the angular offset of the arc tube relative to the longitudinal axes of the arc lamp is equal to the amount of tilt of lamp cone 40 from horizontal. Thus, if arc tube 12 is tilted 30° to the longitudinal axis of lamp 20, and lamp 20 is rotated into the socket of yoke 80 such that the arc tube axes and lamp axes are in a vertical plane, arc tube 12 will be horizontal when lamp cone 40 is tilted 30° down from horizontal. As previously described, operation of arc tube 12 at horizontal will correct tilt factor.

However, because not all fixtures will be aimed at 30° down from horizontal, yoke 80 must be adjusted to maintain the orientation of yoke 80 relative to horizontal using the process described above.

FIGS. 11A-C, 12A-F, and 13A-F show what are called straps and an end stop that can be clamped along the curved slot in fixture knuckle 50 (see FIGS. 7A-C). A projection from the side of cone 40 extends into that curved slot when cone 40 is pivotally connected to knuckle 50 by bolt 174. The angular orientation of cone 40 relative knuckle 50 can therefore be set by where strap pair 146, 148 is clamped in position (as a lower end stop), and where end stop 142 is positioned and clamped in place (as an upper end stop). This combination provides more holding power to withstand torque forces than just relying on the tightening of bolt 174. The straps and end stop can have structure that allow them to be clamped in place along the curved channel by tightening of bolts. Additionally, it allows for relatively easy release of the position for cone 40. Two bolts on the straps for the bottom end stop can simply be released and that end strap pair slid away. This would allow, for example, a maintenance crew to go up and work on a fixture. The lower end stop straps could be released and the fixture tilted down to hang vertically while they worked on it. By leaving the upper end stop clamped into position, when finished, the workers just pivot the lamp and cone 40 back until into abutment with the upper end stop, slide the lower end stop strap pair into abutment with the projection or boss from the end cone that is in the slot, and retighten the screws. The original aiming of the fixture is therefore retained. It avoids having to do any re-aiming or calibrations.

As discussed above, one feature of the invention is maintaining an orientation of the lamp relative to some reference position substantially independent of the pivoting of the cone 40. As can be appreciated, the exemplary embodiments of FIGS. 16-23A and B do this with a manual adjustment lever. This arrangement, however, while maintaining its substantially consistent orientation of the lamp with some external reference plane, does cause slight movement of the lamp relative to the reflector that is attached to cone 40. This can slightly alter the beam pattern from the fixture. For example, if cone 40 is tilted upwardly approximately 15° from a 30° down position, not only would the reflector 30 connected to the cone tilt up 15°, the repositioning of the lamp 20 inside the reflector would cause a beam shift an additional approximately 7½ more degrees up. Being aware of this, and compensating for this, is sometimes required. However, because of fairly known proportionalities once a configuration is selected, this can be built into the design of the system. It actually can be advantageous in that even though there might be some physical limit of how far up or down cone 40 can be adjusted (for example because of physical limitations in the structure of the fixture like the end limits of slot 381 in arm 350 or slot 412 of tool 400, or for that matter, practical limitations), the beam shift created by that adjustment is proportionally more, thus giving a wider range of potential adjustments.

Further discussion of benefits of the total tilt factor correction structure and options for it can be found in the patents incorporated by reference herein.

It will be appreciated that the foregoing exemplary embodiments are given by way of example only and not by way of limitation. Variations obvious to those skilled in the art will be included in the invention. The scope of aspects the invention is defined solely by the claims.

Utilization of the Musco Z-LAMP™ brand lamp is not necessarily required. By appropriate modification, a standard arc lamp could be utilized. If a standard lamp (arc tube 12 axis co-axial or parallel to the lamp 20 axis), is used, a worker can use gauge 362 and arm 350 to center arc tube 12 with the axis of cone 40, or tilt lamp 20 relative to cone 40 by an allowable number of degrees. Tool 400 can be used in an analogous manner.

It will be appreciated that the combination of components shown in the figures are but a few ways in which adjustability between a mount for the fixture to a cross arm, and the fixture can be accomplished. The figures illustrate how, in one alternative exemplary embodiment, an integration of the adjustment lever allows for manual compensation and maintenance of an orientation of the arc lamp regardless of orientation vertically of the cone in which the yoke is contained (over a reasonable range). The drawings are intended to show to one skilled in the art one such combination. The general concept is to have some compensation or mechanism for the function and result of maintaining a certain orientation of the lamp. Similarly, tool 400 can take on different configurations.

What is claimed is:

1. A high intensity lighting fixture comprising:

a. a lamp cone;

b. a reflector frame mountable to the lamp cone;

c. a high intensity discharge lamp having a base mountable into a yoke in the lamp cone;

d. the lamp yoke mounted pivotable around a first pivot axis, e. the lamp cone pivotable around a second pivot axis relative the knuckle to set different aiming angles for the lighting fixture;

f. an arm connected to the lamp yoke adapted to move proportionally to pivoting of the lamp yoke around the first pivot axis, g. a locking mechanism adapted to fix the arm relative the lamp cone at a selected location, the amount and direction of proportional pivoting of the lamp yoke in the lamp cone adapted to automatically maintain a selected arc tube position for a range of lighting fixture aiming angles.

2. The fixture of claim 1 wherein the discharge lamp has a glass envelope enclosing an arc tube.

3. The fixture of claim 2 wherein the arc tube has a longitudinal axis which is offset from the longitudinal axis of the glass envelope.

4. The fixture of claim 3 wherein the offset comprises a rotation of a longitudinal axis of the arc tube relative the longitudinal axis of the arc lamp so that the arc tube is generally oblique to the longitudinal axis of the arc lamp.

5. The fixture of claim 4 wherein the oblique angle is approximately 30°.

6. The fixture of claim 1 wherein the discharge lamp comprises an arc tube inside a glass envelope and the arc tube is essentially coaxial or aligned with the longitudinal axis of the arc lamp.

7. The fixture of claim 1 wherein the selected arc tube position is generally horizontal when the fixture is in operating position.

8. The fixture of claim 1 in combination with a sports lighting system.

9. The fixture of claim 1 in combination with a plurality of said fixtures.

10. A method of increasing useful light to a target area from a high intensity discharge light source comprising:

a. selecting an operating orientation for a lighting fixture;

b. manually adjusting the angular orientation of the high intensity discharge light source relative to the lighting fixture.

11. The method of claim 10 further comprising mounting the light source in a structure that is independently moveable relative to the lighting fixture.

12. The method of claim 11 wherein the independently moveable structure is pivotable relative to the light fixture.

13. The method of claim 12 wherein the independently moveable structure is pivotable relative to the light fixture on a separate pivot axis from that of the light fixture.

14. The method of claim 13 wherein any change of orientation of the light fixture, over a certain range, results in proportional pivoting of the independently moveable structure.

15. The method of claim 14 wherein the proportional movement is through a mechanical linkage connected to the independently moveable structure.

16. A lighting fixture for wide area lighting comprising a knuckle plate adapted for connection to a cross arm, a bulb cone adapted to receive high intensity discharge light source, and a knuckle connectable to the knuckle plate and bulb cone, the bulb cone being pivotable around a first pivot axis relative to the knuckle, comprising:

a. a lamp yoke in the cone pivotable around a second pivot axis;

b. a mechanical linkage having a portion connected to the yoke and a portion that can be manually adjusted, the portion that can be manually adjusted adapted to pivot the yoke relative the bulb cone.

17. The lighting fixture of claim 16 wherein the mechanical linkage is an arm.

18. A tool to set angular orientation of a lamp relative a bulb cone in the lighting fixture of claim 17, comprising:

(a) a base;

(b) a mounting structure to removably mount the base to the mechanical linkage in a known relationship to a reference direction associated with the mechanical linkage;

(c) a level device mounted on the base in a known relationship to the base;

(d.) so that the level device indicates mechanical linkage position relative to level.

19. The tool of claim 18 wherein the mechanical linkage comprises an arm connected to the yoke and the arm moves in kind with pivoting of the yoke.

20. A tool for setting angular position of a lamp relative to its bulb cone having an open face wherein the lamp is mountable to a yoke that is adjustable in orientation relative the bulb cone, comprising:

(a) a mounting plate adapted for mounting at or near the open face of the bulb cone;

(b) an elongated member having opposite first and second ends, the first end on one side of the plate extending into proximity with the yoke and the second end extending away from the other side of the plate;

(c) the elongated member pivotally attached to the plate;

(d) a gauge on the plate;

(e) an indicator on the elongated member;

(f) so that the angular relatively of the yoke to the cone is indicated by the indicator relative the gauge.

21. A method of lighting a target area, comprising:

(a) pivotally mounting a yoke in a lamp cone, the lamp cone having a front plane and a back end;

(b) mounting a light source having an arc tube to the yoke;

(c) mounting the lamp cone in operating orientation; and (d) manually adjusting the yoke to adjust the arc tube towards a horizontal plane.

22. The method of claim 21 wherein the manual adjustment is accomplished by a linkage connecting the yoke to the exterior of the lamp cone.

23. The method of claim 21 wherein the pivotally mounting step includes pivotally mounting the yoke at or near the front plane of the lamp cone and the manually adjusting step comprises lifting or lowering the back end of the yoke.

* * * * *